US012280939B2

(12) United States Patent
Sugawara et al.

(10) Patent No.: US 12,280,939 B2
(45) Date of Patent: Apr. 22, 2025

(54) DOUBLE PRESSURIZED CONTAINER, DISCHARGE PRODUCT, DISCHARGE MEMBER, DISPENSER SYSTEM AND MANUFACTURING METHOD FOR DISCHARGE PRODUCT

(71) Applicant: DAIZO CORPORATION, Osaka (JP)

(72) Inventors: Shinya Sugawara, Kyoto (JP); Kazuhiro Yamaguchi, Kyoto (JP); Kimio Kataoka, Kyoto (JP); Hidetoshi Miyamoto, Kyoto (JP); Satoshi Mekata, Osaka (JP)

(73) Assignee: DAIZO CORPORATION, Osaka (JP)

( * ) Notice: Subject to any disclaimer, the term of this patent is extended or adjusted under 35 U.S.C. 154(b) by 331 days.

(21) Appl. No.: 18/102,952

(22) Filed: Jan. 30, 2023

(65) Prior Publication Data

US 2023/0174293 A1 Jun. 8, 2023

Related U.S. Application Data

(62) Division of application No. 17/260,685, filed on Jan. 15, 2021, now Pat. No. 11,603,257.

(51) Int. Cl.

| | |
|---|---|
| ***B65D 83/38*** | (2025.01) |
| ***B65D 77/04*** | (2006.01) |
| ***B65D 83/384*** | (2025.01) |
| ***B65D 83/48*** | (2006.01) |
| ***B65D 83/62*** | (2006.01) |

(52) U.S. Cl.

CPC ..... *B65D 83/384* (2013.01); *B65D 77/04* (2013.01); *B65D 83/48* (2013.01); *B65D 83/62* (2013.01)

(58) Field of Classification Search

CPC .... B65D 83/384; B65D 777/04; B65D 83/48; B65D 83/62; B65D 83/42; B65D 83/206; B65D 83/382; B65B 31/003

See application file for complete search history.

*Primary Examiner* — Vishal Pancholi

(74) *Attorney, Agent, or Firm* — IP Business Solutions, LLC

(57) ABSTRACT

A method for manufacturing a discharge product includes the steps of: preparing the double pressurized container including an outer container; an inner container stored inside the outer container and having flexibility; and a plug for sealing both of the outer container and the inner container; charging a concentrate inside the inner container; contracting the inner container before or after charging the concentrate; tightly mounting the plug to a mouth of the inner container; charging the pressurizing agent between the outer container and the inner container through a space between a mouth of the outer container and the mouth of the inner container; and tightly closing the space between the mouth of the outer container and the mouth of the inner container by the plug.

10 Claims, 41 Drawing Sheets

DOUBLE PRESSURIZED CONTAINER, DISCHARGE PRODUCT, DISCHARGE MEMBER, DISPENSER SYSTEM AND MANUFACTURING METHOD FOR DISCHARGE PRODUCT

CROSS-REFERENCE TO RELATED APPLICATIONS

This is a divisional application claiming priority to U.S. patent application Ser. No. 17/260,685, filed on Jan. 15, 2021, which is incorporated herein by reference. The contents of this application are incorporated herein by reference in their entirety.

BACKGROUND OF THE INVENTION

Field of the Invention

The present invention relates to a double pressurized container, a discharge product, a discharge member, a dispenser system using the same, and a manufacturing method for the discharge product. Note that in the following explanation, instead of "discharge product", it may be called as "pressurized product" or "double pressurized product", but it refers to the same product.

Description of the Related Art

FIG. 11 of Patent Document 1 discloses a contents storage container provided with a container body having an opening part at the upper end and a valve housing part which closes the opening part and is fixed to the container body, in which the valve housing part has a cylindrical housing part and a sealed part detachably fitted to a hole formed at the bottom face of the housing part. Further, FIG. 7 of Patent Document 1 discloses the contents storage container provided with a closing part which is to be opened by breaking the bottom part of the valve housing part. Those containers are used by detachably storing a pump valve or an aerosol valve in the valve housing part, and by fixing with a screw cap, so as to dismount the sealed part with a dip tube or to break the closing part. Therefore, there are advantages such that the valve can be used repeatedly, and the contents storage container can be manufactured at a lower cost.

Patent Document 2 discloses a bilayer discharging container provided with an outer container, an inner container stored in the outer container and a valve assembly which closes the outer container and the inner container. Patent Document 2 discloses a technology in which the inner container is filled with a concentrate and a space between the inner container and the outer container is filled with a pressurizing agent, and a technology in which the outer container and the inner container are formed by biaxial stretch blow molding at the same time.

Patent Document 3 discloses a manufacturing method for a double aerosol product in which after making a negative pressure inside the inner container by fitting the valve to the mouth of the inner container and sucking air inside the inner container against the resilience of the inner container, a pressurizing agent is charged in a space between the outer container and the inner container from a gap between the mouth of the outer container and the valve, and after fixing and sealing the valve to the outer container, the concentrate is charged into the inner container from the valve. Further, in paragraphs [0046] and [0047] of the specification, there is disclosed a manufacturing method for a double bottle in which a preform for an inner container is inserted into a preform for an outer container, and the obtained double preform is blow-molded so as to mold the outer container and the inner container at the same time.

Patent Document 4 discloses a double pressurized container which is provided with an outer container, an inner container stored inside the outer container and having flexibility and a mounting sleeve (plug) holding a valve provided at the upper end of the inner container, where the mounting sleeve itself is mounted on the outer container and seal the outer container. Further, Patent Document 4 discloses a manufacturing method combining an under-cup charging and an ultrasonic wave welding in which a pressurized gas is charged in a space between the outer container and the inner container through a gap between the mounting sleeve and the outer container, and after that, the periphery of the mounting sleeve is welded to the outer container by the ultrasonic-wave welding.

PRIOR ART DOCUMENT

Patent Document

[Patent Document 1] International Patent Application Publication No. WO2015/80252
[Patent Document 2] Japanese Patent Application Publication No. 2016-16896
[Patent Document 3] Japanese Patent Application Publication No. 2017-119534
[Patent Document 4] Japanese Patent No. 5138777

DISCLOSURE OF THE INVENTION

Problems to be Solved by the Invention

Since the contents storage container of Patent Document 1 is opened by screwing the valve provided with a dip tube on the container, the tip end is easily shifted from the position of the sealed part by the curvature of the dip tube. Further, the dip tube is made of soft material and so, it is bend easily, and it hardly performs an opening operation. Further, when erroneously turning upside down and discharging, only the pressurizing agent is discharged, and the remaining concentrate cannot be discharged. In the case that the container is made of synthetic resin, when it is dropped during distribution processes such as at the time of transportation, at the time of storage in a warehouse, at the time of display at a shop, etc., it may be destroyed or the pressurizing agent or the concentrate may be leaked.

In the bilayer discharging container of Patent Document 2, the concentrate and the pressurizing agent are separately charged, so that it is not necessary to use the dip tube, and the discharge member is simplified. However, since the valve is projected from the discharging container, it is necessary to be protected very carefully in order not to operate the valve in the distribution process.

In the manufacturing method in Patent Document 3, temporarily, the air inside the inner container is sucked for pressure reduction, and therefore, the inner container shrinks and is separated from the outer container. After that, the concentrate is charged into the inner container via the valve. Therefore, it takes time to charge the concentrate.

SUMMARY OF THE INVENTION

A technical object in the present invention is to provide a double pressurized container, a discharge product, a discharge member, a dispenser system and a manufacturing method for the discharge product, which provide high safety at the time of distribution, easy to use by consumers, safe and environment-friendly.

A double pressurized container 11, 31 of the present invention is provided with an outer container 13, 33, an inner container 14, 34 stored inside the outer container 13, 33 having flexibility, and a plug 15, 35 fixed to at least one of the outer container 13, 33 and the inner container 14, 34 and sealing both of the outer container 13, 33 and the inner container 14, 34. The inside of the inner container 14, 34 is a concentrate chamber Sc to be filled with the concentrate C. A space between the outer container 13, 33 and the inner container 14, 34 is a pressurizing agent chamber Sp to be filled with the pressurizing agent P. The plug 15, 34 is provided with an openable seal part (a part to be unsealed) 15*d*, 44 for opening the concentrate chamber.

The double pressurized container of the present invention is used with charging the concentrate in the inner container. Since the plug seals the inner container which is the concentrate chamber and the plug is provided with the openable seal part capable of unsealing, it cannot be discharged unless a dedicated discharge member to open the openable seal part. Therefore, there is no accidental discharge at the time of distribution, and high safety is performed. Further, in the case that both of the outer container and the inner container are made of synthetic resin, when the concentrate is charged in the concentrate chamber of the inner container, and the pressurizing agent is charged into the pressurizing agent chamber between the outer container and the inner container, the outer container becomes high elasticity by the pressure of the pressurizing agent, so that it is strong against impact due to falling, etc. and reduces the influence on the inner container. In addition, in case, if a crack is formed in the outer container by the impact, only the pressurizing agent (compressed gas) escapes but the concentrate does not splash. Therefore, the safety is highly enhanced. In the case that the concentrate chamber is filled with the concentrate in a liquid-tight state, and the shoulder part and the bottom part of the inner container abut to the shoulder part and the bottom part of the outer container, respectively, specifically, the elasticity becomes high and it becomes strong against impact due to falling.

Accordingly, since the safety of the double pressurized container is high, it is not required to use a strong dedicated container for distribution of dangerous goods, and therefore, it is easily transported. Further, the consumers can easily purchase it through internet sales.

In such double pressurized container 11, 31, it is preferable that the plug 15, 35 is provided with a flange part 15*b*, 40 covering the upper end surface 13*e*, 34*e*, 14*e*, 34*e* of the outer container 13, 33 and the inner container 14, 34, and a bottomed cylindrical shaped closing part 15*a*, 39 to be inserted into the opening of the inner container 14, 34; and it is provided with the openable seal part 15*d*, 44 at the bottom part 15*c*, 42 of the closing part 15*a*, 39.

In the double pressurized container in which the plug has a flange part covering the upper end surface of the outer container and the inner container, and the bottomed cylindrical shaped closing part to be inserted into the opening of the inner container, and it is provided with the openable seal part at the bottom part of the closing part, the users are more difficult to open and discharge it without the dedicated discharge member since the openable seal part is positioned in the inner part. Therefore, it has further high safety. Further, since the plug has a flange, it is easily fixed to the outer container or the inner container.

It is preferable that the inner container 34 is provided with a flange 38*b* which is held on the upper end surface 13*f* of the outer container 33, and that the flange 40 of the plug 35 is provided with an annular disk part 46 which covers the upper end surface 38*a* of the inner container 34, and an outer cylindrical part 47 in which the outer periphery surface of the flange 40 of the inner container 34 is internally inserted.

In the case that the inner container is provided with the flange which is held on the upper end surface of the outer container, and that the flange of the plug is provided with the annular disk part, which covers the upper end surface of the inner container, and an outer cylindrical part in which the outer periphery surface of the flange of the inner container is internally inserted, when the pressurizing agent is charged in the pressurizing agent chamber, the pressurizing agent is hardly mixed in the concentrate chamber erroneously. Further, even if the plug is fixed by welding, it can prevent the plug from slipping, so that the position of the openable seal part is hardly shifted.

It is preferable that the annular projection 38*c* is provided on the upper end surface 38*a* of the inner container 34 or the lower surface of the annular disk part 46 of the plug 35, and the annular projection 36*b* is provided on the upper end surface 36*a* of the outer container 33 or the lower end surface of the outer cylindrical part 47 of the plug 35.

In the case that the annular projection is provided on the upper end surface of the inner container or the lower surface of the annular disk part of the plug, and the annular projection is provided on the upper end surface of the outer container or the lower end surface of the outer cylindrical part of the plug, the plug is easily fixed to the inner container and the outer container at one time welding step.

It is preferable that the upper end surface 13*f* of the outer container 13 and the upper end surface 14*e* of the inner container 14 are arranged at the same height, and that the flange 15*b* of the plug 15 covers the upper end surface 14*e* of the inner container 14 and the upper end surface 13*f* of the outer container 13.

In the case that the upper end surface of the outer container and the upper end surface of the inner container are arranged at the same height, and the flange of the plug covers the upper end surface of the inner container and the upper end surface of the outer container, the plug is easily fixed to the outer container and the inner container, and they are easily and equally fixed.

In this case, it is preferable that the annular step part 13*h* is formed at the upper end inner periphery of the outer container 13, and that the inner container 14 is provided with the flange 14*f* which is held to the annular step part 13*h* of the outer container 13.

In the case that the annular step part is formed at the upper end inner periphery of the outer container, and the flange held to the annular step part of the outer container is provided, it is easy to arrange the upper end surface of the outer container and the inner container at the same height, and the plug is easily and equally fixed to the outer container and the inner container.

Further, an inclined part 15*b*2 for welding may be formed at a base part between the flange 15*b* of the plug 15 and the closing part 15*a*.

In the case that the inclined part for welding is formed at a base part between the flange of the plug and the closing part, fixing and sealing in both the horizontal direction and the vertical direction can be obtained at one sealing.

It is preferable that the closing part 39 is provided with an inner cylindrical part 15*a*1 extending downwardly along the inner surface of the neck part 14*d* of the inner container 14, a fitting cylindrical part 41 provided concentrically with the inner cylindrical part 15*a*1 at the lower side of the inside of the inner cylindrical part 15*al*, a connection part (step part) 15*a*7 connecting the lower end of the inner cylindrical part 15*a*1 and the upper end of the fitting cylindrical part 41, 15*a*2, and a bottom part 42, 15*c* closing a part which is slightly higher position than the lower end of the fitting cylindrical part 41, 15*a*2, and that the bottom part 42, 15*c* of the fitting cylindrical part is provided with the openable seal part 44, 15*d*.

In the case that the closing part is provided with an inner cylindrical part extending downwardly along the inner surface of the neck part of the inner container, a fitting cylindrical part provided concentrically with the inner cylindrical part at the lower side of the inside of the inner cylindrical part, a connection part connecting the lower end of the inner cylindrical part and the upper end of the fitting cylindrical part, and a bottom part closing a part which is slightly higher position than the lower end of the fitting cylindrical part, and that the bottom part of the fitting cylindrical part is provided with the openable seal part, a dimensional accuracy of the inner periphery surface of the fitting cylindrical part can be enhanced. Therefore, the reliability of the sealing with the valve is enhanced.

It is preferable that the closing part 15*a* is provided with an inner cylindrical part 15*a*1 extending downwardly along the inner surface of the neck part 14*d* of the inner container 14, a fitting cylindrical part (sealing cylindrical part) 15*a*2 provided concentrically with an inner cylindrical part 15*a*1 inside the inner cylindrical part 15*a*1, a connection part 15*a*6 connecting both lower ends of the inner cylindrical part and the fitting cylindrical part 15*a*2, and a bottom part 15*c* closing a part which is slightly higher than the lower end 15*a*5 of the fitting cylindrical part 15*a*2, and that the bottom part 15*c* is provided with the openable seal part 15*d*.

In the case that the closing part is provided with an inner cylindrical part extending downwardly along the inner surface of the neck part of the inner container, a fitting cylindrical part (sealing cylindrical part) provided concentrically with an inner cylindrical part inside the inner cylindrical part, a connection part connecting both lower ends of the inner cylindrical part and the fitting cylindrical part, and a bottom part closing a part which is slightly higher than the lower end of the fitting cylindrical part, and that the bottom part of the fitting cylindrical part is provided with the openable seal part, when a horn abuts to the upper surface of the plug and the ultrasonic wave welding is performed, the vibration transmitted to the lower side through the inner cylindrical part is transmitted to the concentrate side, and therefore, it is hardly transmitted to the openable seal part of the bottom part. Accordingly, it can prevent the openable seal part from melting or falling by the vibration at the time of ultrasonic wave welding.

In this case of the double pressurized container 58, it is preferable that the neck part 14*d* of the inner container 14 is provided with a cylindrical upper part 14*d*1 and a tapered part 14*d*2 which becomes narrower toward the lower side, and further that the lower part of the inner cylindrical part 15*a*1 of the plug 15 fits to the tapered part 14*d*2 of the neck part 14*d* of the inner container 14.

In the double pressurized container having the connection part connecting both lower ends of the inner cylindrical part and the fitting cylindrical part, in the case that the neck part of the inner container is provided with the cylindrical upper part and the tapered part which becomes narrower toward the lower side, and the lower part of the inner cylindrical part of the plug is formed in a taper shape to fit to the tapered part of the neck part of the inner container, the concentrate can be smoothly discharged when the user starts using it, since the space (head space, gas phase) which is positioned higher than the liquid surface of the concentrate becomes small.

The discharge product 11*a*, 31*a* of the present invention is provided with any of the aforementioned double pressurized containers 11, 31, the concentrate C charged in the concentrate chamber Sc, and the pressurizing agent P charged in the pressurizing agent chamber Sp.

In the discharge product of the present invention, since the aforementioned double pressurized containers are used, the effect of the double pressurized containers is obtained.

In the discharge product 11*a*, 31*a*, it is preferable that the fixation of the plug 15, 35 is welding, and the openable seal part 15*d*, 44 contacts with the concentrate C in the concentrate chamber Sc.

Further, in the discharge product in which the fixation of the plug is welding and the openable seal part contacts with the concentrate in the inner container, the openable seal part is cooled by the concentrate, so that it prevents the openable seal part from transmitting heat or energy at the time of welding, and it can suppress the problems such as melting the openable seal part. Therefore, the openable seal part can be made thinner so that it is easily opened.

The discharge member 12, 32 of the present invention is the discharge member 12, 32 used for the aforementioned discharge products 11*a*, 31*a*, and is provided with a mounting part (cap 20) detachably mounted to the outer container 13, 33, an seal opening part 27 opening the openable seal part 15*d*, 44 of the plug 15, 35, a valve (21) communicating with the inner container 14, 34 via the seal opening part 27 and switching between the communicating and blocking with the outside, and an operation part (23) mounted to the valve (21) and discharging the concentrate C by the operation.

Since the discharge member of the present invention is provided with the mounting part detachably mounted to the outer container and the seal opening part opening the openable seal part of the plug, the aforementioned discharge products can be opened by the user's intension. Further, when the concentrate is used up all and the container becomes empty, the discharge member can be removed and replaced to new discharge product. Therefore, it contributes a resource saving.

The discharge device 10, 30 of the present invention is provided with any of the aforementioned discharge products 11*a*, 31*a*, and the aforementioned discharge members 15, 32 which are detachably mounted to the discharge products 11*a*, 31*a*.

In the discharge device of the present invention, since the aforementioned discharge products and the discharge members are used, the effect is obtained by them.

The dispenser system of the present invention is provided with the first discharge device group made of the aforementioned discharge devices 10, 30 in which the concentrate chamber is filled with the first concentrate, the second discharge device group made of the aforementioned discharge devices 10, 30 in which the concentrate chamber is filled with the second concentrate which is different from the first concentrate, and the discharge member 15, 32 of the discharge device 10 of the first and second groups is capable of being mounted to the discharge product 11*a*, 31*a* of the same group, and it is made so as not to be mounted to the other group of the discharge product 11*a*, 31*a*.

The dispenser system of the present invention can prevent improper mounting by the user, by forming a shape to be able to fit with the discharge product and discharge member depending on an object, for example, for hair or for skin, etc., product categories such as cosmetics or pharmaceuticals, etc., a discharge form such as spray or foam, etc., a use form such as upright or inverted, etc.

In the aforementioned double pressurized container, it is preferable that the plug is provided with the openable seal part 15*d* which is surrounded by an annular weakening line and is to be opened by pressing from the upper part, and it is preferable that the openable seal part 15*d* is provided with a pressure receiving part 15*d*1 which is projected higher than the periphery on the upper surface of the openable seal part 15*d*.

Since the openable seal part is provided with the pressure receiving part on the upper surface, it is pressed down at the time of opening. Therefore, it is easily broken along the weakening line.

It is preferable that the pressure receiving part 15*d*1 is provided on the central axis of the plug, and the shape is approximately circular shape.

When the pressure receiving part is provided on the central axis of the plug, and the shape is approximately circular shape, an equal force is applied to the pressure receiving part by pressing, the openable seal part is easily pressed straight down, and the breaking along the weakening line is facilitated further.

Further, it is preferable that the weakening line 15*f* is partially interrupted, and the openable seal part 15*d* continues with the periphery by the interrupted part 15*e*.

In the case that the weakening line is partially interrupted, and the openable seal part continues with the periphery by the interrupted part, the interrupted part is hardly broken, and therefore, the openable seal part is hardly fallen to the inside of the container body.

It is preferable that the interrupted part 15*e* of the weakening line 15*f* is provided with a reinforcement part 15*g* which is thicker than the periphery.

Further, when the interrupted part of the weakening line is provided with a reinforcement part which is thicker than the periphery, the breaking of the interrupted part is suppressed further.

Another aspect of the discharge device of the present invention comprises the discharge product having the aforementioned double pressurized container, the concentrate C and the pressurizing agent P charged in the double pressurized container, and the aforementioned discharge member, and the bottom face 27*a* of the seal opening part 27 at the time of opening abuts to almost whole of the pressure receiving part 15*d*1.

When the bottom face of the seal opening part abuts to almost whole of the pressure receiving part, a reaction force can be surely received at the time of opening, and the deformation of the top end is suppressed. Therefore, the discharge member can be used repeatedly. When the mounting part is screwed to the container body, the bottom face of the seal opening part gradually presses the pressure receiving part of the openable seal part, so that the openable seal part easily stretches by the extensibility of the synthetic resin and it is hardly broken. However, the openable seal part is surrounded by the weakening line, and the pressure receiving part is projected, so that the weakening line can be broken, and tearing off and falling off the openable seal part can be suppressed. Further, the bottom face of the seal opening part is hardly deformed, and the discharge member can be repeatedly used.

The discharge device system of the present invention is provided with the first discharge device group made of the discharge device 10, 30, 230 in which the concentrate chamber Sc is filled with the first concentrate, and the second discharge device group made of the discharge device 10A, 30A, 230 in which the concentrate chamber Sc is filled with the second concentrate which is different from the first concentrate, and there is a misuse prevention means, so that the first group discharge member 15 can be used in the first group discharge product 11*a*, and it cannot be used in the second group discharge product 11*a*A.

In the discharge device system of the present invention, the misuse prevention means is provided in order not to mount the discharge member of the first discharge device to the discharge product of the second discharge device, or even if it is mounted, the plug cannot be opened, so that it can prevent the discharge member of the first discharge device from being erroneously mounted to the discharge product of the second discharge device. When the use of the first discharge device is for non-human body, for example, an insecticide, etc., and the use of the second discharge device is for human body, for example, hair care products, etc., it can prevent the discharge member used for discharging the concentrate for non-human body from discharging the concentrate for human body, so that it is safe. Such discharge device system can be preferably employed in a case that a product group used for multiple purposes is provided for a market as series of product groups in which the appearance is unified.

Further, it is preferable to provide the second misuse prevention means in order not to mount the discharge member 12A of the second discharge device 10A to the discharge product 11*a* of the first discharge device 10, or so as not to open the plug even if it is mounted.

In the case that the second misuse prevention means is provided in order not to mount the discharge member of the second discharge device to the discharge product of the first discharge device, or even if it is mounted, so as not to open the plug, it can prevent the discharge member of the second discharge device from being erroneously used to the discharge product of the first discharge device. In the aforementioned examples, it can prevent the discharge member for discharging the concentrate for human body from discharging the concentrate for non-human body. Therefore, for example, when the discharge device for discharging the concentrate for human body is mounted to the discharge product in which the insecticide is charged, it can prevent the user from using the insecticide to the human body when the user misunderstands.

The misuse prevention means may be the mounting prevention means which prevents the discharge member 12 of the first group from being mounted to the discharge product 31*a* of the second group, and the mounting prevention means may be to control a radial direction of the outer container 13, 33 to the discharge member 12.

In the case that the misuse prevention means is the mounting prevention means preventing the discharge member from being mounted to the discharge product, even if the user tries to erroneously mount the discharge member of the first discharge device to the discharge product of the second discharge device, the user cannot mount it. Therefore, it can prevent an erroneous use.

The misuse prevention means may be the mounting prevention means which prevents the discharge member 15 of the first group from being mounted to the discharge product 31*a* of the second group, and the mounting prevention means may be to control a radial direction of the plug 15 to the discharge member 12.

In the case that the mounting prevention means is to control a radial direction of the plug and the discharge member, by preventing the axial direction movement of the discharge member with respect to the plug, the mounting can be prevented.

The misuse prevention means may be a mounting prevention means which prevents the discharge member 15 of the first group from being mounted to the discharge product 31*a* of the second group, and the mounting prevention means may be to control a screw shape of the container body 16 and the discharge member 12.

In the case that the mounting prevention means is to control the screw shape of the container body and the discharge member, it can prevent the container body and the discharge member from screwing.

Further, it is preferable that the misuse prevention means is provided with an opening prevention means, so that it is possible to perform the opening of the openable seal part by the seal opening part with respect to the discharge product of the same group, and the opening of the openable seal part is prevented by the seal opening part when it is mounted to the discharge product of another group.

When the misuse prevention means is the opening prevention means which prevents the opening of the plug by the seal opening part, even if the user erroneously mounts the discharge member of the first discharge device to the discharge product of the second discharge device, the plug of the discharge product cannot be opened. Therefore, it can prevent an erroneous use.

In this case, the opening prevention means can be realized by control (setting a dimension) in the axial direction of the plug 15 and the seal opening part 27 of the discharge member 12.

In the case that the opening prevention means is a control of the axial direction of the plug and the seal opening part of the discharge member, even if it is erroneously mounted, the length in the axial direction of the discharge member is not enough, or engaging in the axial direction is stopped in a halfway, etc., so that the opening of the plug can be prevented.

Another aspect of the double pressurized container 11 of the present invention is that among the portions with respect to the upper end surface 13*f*, 14*e* of the neck part 13*d*, 14*d* and the plug 15, at the position slightly inside than the outer periphery edge of at least one of sides, the annular projection 13*g*, 13*g*1, 13*g*2 for welding is formed, and at the outer periphery edge on the top surface 17*c* of the plug 15, an annular outer periphery cut portion 17*d*, 130*a*, 41 is provided.

Since the double pressurized container of the present invention is provided with an annular outer periphery cut portion at the outer periphery edge on the top surface of plug, when a horn for oscillating an ultrasonic vibration abuts to the top surface, and further, when the ultrasonic vibration is oscillated from the horn in the pressurized state, the oscillation of the horn to the lower side of the outer periphery cut portion is controlled. Therefore, the vibration energy flowing to the periphery of the plug is reduced. Accordingly, the melted annular projection stays within a range between the upper surface of the mouth and the lower surface of the plug, and the protrusion toward the outer periphery surface side is reduced. Thus, it prevents the appearance of the discharge product, in which the contents are charged and the plug is sealed by the ultrasonic wave welding, from deteriorating by the resin piece (welding waste) which is made of the cooled protrusing resin. Further, it prevents the welding from interrupting by the welding waste, and the welding part (portion where the welding members are abutted and pushed each other) can be surely welded, and the welding strength is enhanced, so that the occurrence of contents leakage can be suppressed.

It is preferable that the outer periphery cut portion 17*d*, 130*a*, 41 is provided more outside than the portion with respect to the annular projection 13*g*, 13*g*1, 13*g*2.

In the case that the annular outer periphery cut portion is provided more outside than the portion with respect to the annular projection on the top surface of the plug, the vibration energy is easily transmitted to the annular projection via the plug, and the melting of annular projection is facilitated, so that the plug and the container body (outer container and the inner container) are easily welded. Further, the vibration energy is hardly transmitted to the lower side of the annular outer periphery cut portion, and specifically, the vibration energy flowing to the portion which is more outside than the annular projection is reduced. Therefore, the melted annular projection easily stays within the range between the upper surface of the mouth and the lower surface of the plug, and the protrusion toward the outer peripheral surface side is reduced.

Further, in a preferable case, the container body 16 is provided with the outer container 13 having a cylindrical neck part 13*d*, and the inner container 14 which is stored inside the outer container 13 and has a neck part 14*d* fitting with the neck part 13*d* of the outer container 13; and the inner container 14 is provided with a flange 14*f* projected upward from the upper end surface 13*f* of the outer container 13 at the upper end of the neck part 14*d* and engaged with the upper end surface 13*f* of the neck part 13*d* of the outer container 13; and the plug 15 seals the upper end opening of the outer container 13 and the inner container 14 by mounting the plug 15 and welding it on the upper end surface of the neck parts 13*d*, 14*d* of the outer container 13 and the inner container 14, respectively.

In the case that the container body is provided with the outer container having a cylindrical neck part, and the inner container which is stored inside the outer container and has a neck part fitting with the neck part of the outer container; the inner container is provided with a flange projected upward from the upper end surface of the outer container at the upper end of the neck part of the inner container and engaged with the neck part of the outer container; and the upper end opening of the outer container and the inner container is sealed by mounting the plug and welding it on the upper end surface of the neck parts of the outer container and the inner container, respectively, although the heights of the welding part of the outer container and the welding part of the inner container are different, any of these welding parts are highly sealed.

That is, normally, in the case that the heights of the welding part of the outside and the welding part of the inside are different, the vibration energy tends to be concentrated at only one side (usually high inside), and the welding at the other side (usually lower outside) becomes insufficient. However, in the pressurized container of the present invention, spreading the vibration energy to the outer periphery of the plug is suppressed, and it is easily transmitted to the annular projection which is the lower side of the surface abutted with the horn, so that both of the welding parts having different heights can be sufficiently welded. Accordingly, the contents leakage is suppressed for long time.

Further, it is preferable that the plug 15 is provided with the outer cylindrical part 17*a* fitting with the outer periphery of the flange 14*f* of the inner container 14, the inner cylindrical part 15*a*1 to be inserted into the neck part 14*d* of the inner container 14, and the flat part 17 abutted with the upper end surface 14*e* of the flange 14*f* of the inner container 14, and the lower end 17a1 of the outer cylindrical part 17a is abutted with the upper end surface 13f of the neck part 13d of the outer container 13.

In the case that the plug is provided with the outer cylindrical part fitting with the outer periphery of the flange of the inner container, the inner cylindrical part to be inserted into the neck part of the inner container, and the flat part abutted with the upper end surface of the flange of the inner container, and the lower end of the outer cylindrical part is abutted with the upper end surface of the neck part of the outer container, since the position of the plug and the container body is not shifted during the vibration energy is applied, the welding strength between the plug and the inner container and between the plug and the outer container is high, and the sealability is further enhanced.

In this case, at the upper end inner side of the inner cylindrical part 15a1 of the plug 15, an annular inner periphery cut portion 133 which is different from the outer periphery cut portion 17d may be formed.

In the case that at the upper end inner side of the inner cylindrical part of the plug, and an annular inner periphery cut portion which is different from the outer periphery cut portion is formed, when the vibration energy is applied by abutting the horn to the top surface of the plug, flowing the vibration energy to the lower side from the inner cylindrical part can be suppressed. Therefore, the welding strength of the welding part is further enhanced, and the sealability is further enhanced. Further, in the case that there is a bottom part at the lower side of the inner cylindrical part, and the bottom part is provided with the openable seal part, flowing the vibration energy to the bottom part can be suppressed, so that it can prevent the bottom part from melting.

In any of the cases, the outer periphery cut portion 17d, 130a, 41 is preferably a rectangular shape in cross section.

Further, when the outer periphery cut portion is a rectangular shape in cross section, spreading the vibration energy to the outer periphery is suppressed, and therefore, the protrusion of the welding waste is suppressed and it is easily welded.

The plug 15 used for the double pressurized container of the present invention is provided with the flange 15b covering the upper end surface 13f of the outer container 13 and the neck part 14d of the inner container 14 and welding the lower surface to the upper end surface 13f, and an annular outer periphery cut portion 17d, 130a, 41 is formed at the outer periphery edge on the top surface 17c of the flange 15b.

The plug used for the pressurized container of the present invention, since the annular outer periphery cut portion is provided at the outer periphery edge on the top surface of the flange, when the horn for oscillating the ultrasonic vibration is abutted to the top surface, and further, when the ultrasonic vibration is oscillated from the horn in the pressurized state, the oscillation of the horn to the lower side of the outer periphery cut portion is controlled. Therefore, the vibration energy flowing to the periphery of the plug is reduced. Accordingly, the melted annular projection stays among the range between the upper surface of the mouth and the lower surface of the plug, and the protrusion toward the outer periphery surface side is reduced. Thus, it prevents the appearance of the discharge product, in which the contents are charged and the plug is sealed by the ultrasonic wave welding, from deteriorating by the resin piece (welding waste) which is made of the cooled protrusion or overflow resin. Further, it prevents the welding from interrupting by the welding waste, and the welding part (portion where the welding members are abutted and pushed each other) can be surely welded, and the welding strength is enhanced, so that the occurrence of contents leakage can be suppressed.

In such plug 15, it is preferable that the flange 15b has a flat part 17 and an outer cylindrical part 17a provided at the outer periphery lower surface of the flat part, and that the lower surface 17a1 of the outer cylindrical part 17a is the portion to be which is welded to the neck part 13d.

In such plug, in the case that the flange has a flat part and an outer cylindrical part provided at the outer periphery lower surface of the flat part, and that the lower surface of the outer cylindrical part is the portion to be welded to the neck part, the vibration energy easily flows downward via the outer cylindrical part, and the welding between the outer cylindrical part and the container body becomes more secure.

Further, it is preferable that the inner cylindrical part 15a1 is provided on the inner periphery lower surface of the flange 15b, and makes a space from the outer cylindrical part, and is provided concentrically with the outer cylindrical part 17a.

Further, in the case that the inner cylindrical part is provided on the inner periphery lower surface of the flange, and makes a space from the outer cylindrical part, and is provided concentrically with the outer cylindrical part, when the horn abuts to the plug for the oscillation, and the inner cylindrical part is stored inside the container body, the plug is stably held against oscillation.

It is preferable that an annular inner periphery cut portion 133 which is different from the outer periphery cut portion 17d is formed at the upper end inner side of the inner cylindrical part 15al.

Further, in the case that the annular inner periphery cut portion which is different from the outer periphery cut portion is formed at the upper end inner side of the inner cylindrical part, the oscillation is hardly transmitted to the lower side of the inner cylindrical part, so that the vibration energy is easily concentrated to the welding part, and therefore, the welding is more secured.

It is preferable that a bottomed cylindrical shaped closing part 15a is provided at the lower part of the inner cylindrical part 15al.

In the case that the bottomed cylindrical shaped closing part is provided at the lower part of the inner cylindrical part, the vibration energy is hardly transmitted to the closing part, so that although the openable seal part is provided at the bottom part of the closing part, it is not melted by the oscillation.

In any of the aforementioned plugs, it is preferable that the outer periphery cut portion 17d, 130a, 41 is a rectangular shape in a cross section.

In the case that the outer periphery cut portion 17d is a rectangular shape in cross section, spreading the vibration energy to the outer periphery is more suppressed, so that the protrusion of the welding waste is suppressed and it is easily welded.

In yet another aspect of the double pressurized container 11, 31, 51 of the present invention, the openable seal part 15d is divided from the periphery by the breakable annular weakening line 15f, and is provided with a sharp point 15e2 perforating the inner container 14 in the lower surface side.

At the time of opening the closing part when the double pressurized container is used, the breaking part is broken by applying a force to the pressure receiving part in which the upper surface is flat, and the closing part is torn off and falls to the bottom of the inner container. When almost all the concentrate inside the inner container is discharged and the inner container is largely contracted by the pressure of the pressurizing agent, the sharp point penetrates through the inner container. Therefore, it is possible to discharge the pressurizing agent, which is sealed between the outer container and the inner container, to the outside, so that it can be safely discarded. Further, the closing part provided with the sharp point is automatically fallen inside the inner container, so that it is not required to be inserted before charging the concentrate, and the manufacturing is facilitated.

It is preferable that the breaking part 15*f* is formed at the periphery of the pressure receiving part 15*d*1.

In the double pressurized container in which the breaking part is formed at the periphery of the pressure receiving part, the shearing force is applied to the breaking part, so that the closing part is easily teared off.

Further, it is preferable that the rod-shaped project part 15*e*1 which projects downward is provided to the lower surface side of the openable seal part 15*d*, and the sharp point 15*e*2 is formed at the lower end of the project part 15*e*1.

In the case that the rod-shaped project part 15*e*1 projecting downward is provided to the lower surface side of the closing part, and the sharp point 15*e*2 is provided at the lower end of the project part 15*e*1, the rod-shaped project part 15*e*1 is laid, and the sharp point of the closing part breaks through the bottom part or the body part of the inner container.

Further, it is preferable that a hemispherical project part 232 projecting downward is provided to the lower surface side of the openable seal part 15*d*, and the sharp point 15*e* is provided at the lower end of the project part 232.

In the case that the hemispherical project part projecting downward is provided to the lower surface side of the openable seal part and the sharp point is provided at the lower end of the project part, the project part is easily arranged along the bottom face of the inner container, and the sharp point is easily abutted perpendicular to the bottom face. Therefore, the sharp point easily penetrates the bottom part of the inner container, and the inner container is more surely penetrated.

In any of the cases, it is preferable to provide a flexible protection part 53 surrounding the periphery of the sharp point 15*e*2.

In the case that the flexible protection part 53 surrounding the periphery of the sharp point is provided, it can prevent the inner container from being perforated and releasing the pressurizing agent before contracting it sufficiently. Further, it can prevent the user from being injured by the sharp point during assembly, etc., so that it is safe.

In yet another aspect of the double pressurized container 11 of the present invention, the outer container 13 and the inner container 14 are made of synthetic resin, and have a joint part 13*a*3, 14*a*3 mutually connecting a part of the bottom part of the outer container 13 with a part of the bottom part of the inner container 14.

When the concentrate is discharged from the concentrate chamber, the inner container is contracted by receiving a pressure from the pressurizing agent of the pressurizing agent chamber. At this time, the joint part of the inner container pulls the joint part of the outer container inwardly, and finally, the joint part of the outer container is teared off. Therefore, a hole corresponding to the joint part is made in the outer container, and the pressurizing agent is released outside.

Further, the joint part 13*a*3 or its periphery is preferably made thin compare to other part of the bottom part 13*a*.

In the case that the joint part or its periphery of the outer container is made thin compare to other part of the bottom part, it becomes easy to tear off the joint part of the outer container.

Further, it is preferable that the bottom part 13*a* of the outer container 13 and the bottom part 14*a* of the inner container 14 are overlapped, and these bottom parts 13*a*, 14*a* are internally projected while curving.

Specifically, in the case that the bottom part of the outer container and the bottom part of the inner container are overlapped, and these bottom parts are internally projected while curving, the joint part is easily molded. In addition, even when the inner pressure inside the outer container is reduced due to the discharge of the concentrate, the shape of the bottom part of the outer container is hardly deformed. Therefore, it is easy to tear off the joint part of the outer container.

Further, it is preferable that the joint part 13*a*3, 14*a*3 is recessed in the outer surface side and is projected in the inner surface side.

In the case that the joint part is recessed in the outer surface side and is projected in the inner surface side, the molding is facilitated, and it is easy to tear off the joint part.

As the manufacturing method of the double pressurized container, the blow molding is performed in the state that the outer container and the inner container are overlapped, and before the resin is cured at the time of the blow molding or after the molding, a part of the outer container and the inner container is pushed inwardly, and they are bonded with each other by thermo-compression so as to be the joint part.

In the manufacturing method of the double pressurized container, by only performing a simple processing or machining in the middle of manufacturing, a gas discharge function can be applied.

The manufacturing method of the discharge product of the present invention includes the steps of preparing the outer container 13 and the inner container 14 which is stored inside the outer container 13, contracts by the outside force, and the concentrate C is charged inside (S1 to S3, S11 to S12); tightly mounting the plug 15 to the mouth 14*f*2 of the inner container 14 (S4); releasing the outside force which contracts the inner container 14 (S5); charging the pressurizing agent P between the outer container 13 and the inner container 14 via the gap between the mouth 13*g*1 of the outer container 13 and the mouth 14*f*2 of the inner container 14 (S6); and sealing the gap between the mouth 13*g*1 of the outer container 13 and the mouth 14*f*2 of the inner container 14 by the plug 15 (S7).

In the manufacturing method of the present invention, the concentrate can be charged to the inner container from the mouth before the plug is mounted to the inner container. Therefore, it can be charged efficiently compare to the case in which it is charged via the valve. Since the concentrate is incompressible fluid, even when the contract of the inner container is released, in the state that the air cannot be entered from the outside when the plug is mounted, the shape of the inner container cannot be returned, so as to maintain the contracted state. Therefore, the pressurizing agent is easily charged between the outer container and the inner container. In addition, when the pressurizing agent is charged, the pressurizing agent does not enter the inside of the inner container.

In such manufacturing method of the discharge product 10, the inner container 14 may be compressed by compressing the outer container 13 in the preparation steps (S1 to S3), so that the inner container 14 is contracted.

In such double pressurized product manufacturing method, in the case that the inner container is compressed together by compressing the outer container in the aforementioned preparation steps, the contraction can be performed by a simple operation, and it is easy to maintain the contracted state.

The compressing step S2, S12, may be performed before the concentrate C is charged (S2), or after the concentrate C is charged (S12).

In the case that the compressing step is performed before the concentrate is charged, it can be quickly compressed since there is no concentrate at the time of the compressing operation.

In the case that the compressing step is performed after the concentrate is charged, the charging of the concentrate is facilitated since it can be filled with remaining a head space.

In the manufacturing method S1 to S8 in which the outer container 13 and the inner container 14 are compressed together, it is preferable to release the compress of the outer container 13 (S5) and elastically return to the original state before the pressurizing agent P is charged between the outer container 13 and the inner container 14.

In the case that the compressing of the outer container is released and elastically returned to the original state before the pressurizing agent is charged between the outer container and the inner container, the inner container does not expand, and only the outer container expands. Accordingly, the space to be filled with the pressurizing agent can be easily formed between them, and the charging of the pressurizing agent is facilitated.

In any of the aforementioned manufacturing methods, it is preferable to seal the gap between the outer container 13 and plug 15, the gap between the inner container 14 and the plug 15, or both of the gaps by the ultrasonic wave welding (S7).

In the case that the gap between the outer container and the plug, the gap between the inner container and the plug, or both of the gaps is sealed by the ultrasonic wave welding, the charging of the pressurizing agent and the sealing can be continuously performed, so that it is efficient.

Another aspect of the manufacturing method of the discharge product 10 of the present invention includes the steps of preparing the outer container 13 and the inner container 14 which is stored in the outer container 13, contracting the inner container 14 (S2, S21); charging the concentrate C inside the inner container 14 in the state that the volume inside the inner container 14 is reduced to the specified volume (S3); tightly mounting the plug 15 to the mouth **14*f*2 of the inner container 14 (S4); charging the pressurizing agent P between the outer container 13 and the inner container 14 through the gap between the mouth 13*g*1 of the outer container 13 and the mouth 14*f*2 of the inner container 14 (S5); and sealing the gap between the mouth 13*g*1 of the outer container 13 and the mouth 14*f*2 of the inner container 14 by the plug 15 (S6**).

In the manufacturing method of the present invention, the concentrate can be charged in the inner container from the mouth before the plug is mounted to the inner container. Therefore, it can be efficiently charged compare to the charging via the valve. Further, since the inner container is contracted before the charging of the pressurizing agent, the pressurizing agent is easily charged between the outer container and the inner container. In addition, since the inner container is sealed by the plug at the time of charging the pressurizing agent, the pressurizing agent does not enter the inside of the inner container when the pressurizing agent is charged.

In such manufacturing method of the discharge product 10, the inner container 14 may be contracted by reducing the pressure inside the inner container 14 in a state that the gap between the mouth **13*g*1 of the outer container 13 and the mouth 14*f*2 of the inner container 14** is opened.

In such double pressurized product manufacturing method, when the inner container is contracted by reducing the pressure inside the inner container in a state that the gap between the mouth of the outer container and the mouth of the inner container is opened, the inner container can be easily contracted.

Further, the inner container 13 may be contracted by charging fluid between the outer container 13 and the inner container 14 through the gap of the mouth **13*g*1 of the outer container 13 and the mouth 14*f*2 of the inner container 14 in the state that the mouth 14*f*2 of the inner container 14** opens.

Further, in the case that the inner container is contracted by charging fluid between the outer container and the inner container through the gap of the mouth of the outer container and the mouth of the inner container in the opening state of the mouth of the inner container, the inner container can be easily contracted.

In any of the aforementioned manufacturing methods, it is preferable that the gap between the outer container 13 and the plug 15, the gap between the inner container 14 and the plug 15, or the both is sealed by the ultrasonic wave welding (S6).

In the case that the gap between the outer container and the plug, the gap between the inner container and the plug, or the both is sealed by the ultrasonic wave welding, the charging of the pressurizing agent and the sealing can be continuously performed, so that it is efficient.

Yet another aspect of the discharge product manufacturing method of the present invention, it includes a step of charging the concentrate C to the inside of the inner container 14; a step of charging the pressurizing agent P between the inner container 14 and the outer container 13; a step of fixing the plug 15 to the opening; and a step of contracting the inner container 14 by dissolving gas G inside the inner container 14 to the concentrate C. Note that the phrase "gas G inside the inner container 14" refers to the gas existed inside the inner container 14.

The discharge product manufacturing method of the present invention includes the step of contracting the inner container by dissolving gas inside the inner container to the concentrate. In this way, when the gas inside container is dissolved to the concentrate, the formation of the gas-phase inside the inner container can be suppressed.

It may include a replacement step to replace the gas G inside the inner container 14 with another gas of which solubility to the concentrate C is higher than air.

In the case that it includes the replacement step to replace the gas G inside the inner container 14 with another gas of which solubility to the concentrate C is higher than air, the gas inside the inner container is easily dissolved to the concentrate, and the formation of the gas-phase inside the inner container can be suppressed.

Further, it may includes the replacement step to replace the gas G inside the inner container 14 with another gas of which solubility to the concentrate C is higher than the pressurizing agent P.

In the case that it includes the replacement step to replace the gas inside the inner container with another gas of which solubility to the concentrate is higher than the pressurizing agent, the gas inside the inner container is easily dissolved to the concentrate, and the formation of the gas-phase inside the inner container can be suppressed.

It is preferable that the solubility of the gas G inside the inner container 14 with respect to 1 ml of the concentrate under 1 atm at 25° C. is more than 0.02 ml.

In the case that the solubility of the gas inside the inner container with respect to 1 ml of the concentrate under 1 atm at 25° C. is more than 0.02 ml, the gas inside the inner container is easily dissolved to the concentrate.

Further, it is preferable that the step in which the plug 15 is fixed to the opening is the welding, and after the welding step, the step in which the inner container 14 is contracted is performed by dissolving the gas G inside the inner container 14 to the concentrate C.

When the plug is welded to the opening, if there is the concentrate in the vicinity of the welding part, there is a possibility that the welding may not be sufficient due to the oscillation or the heat on the concentrate at the time of welding. Therefore, the welding has to be performed in the state that the inner container is not charged full with the concentrate and a gas-phase is remained. However, when the step to contracting the inner container is performed after welding the plug by dissolving the gas inside the inner container to the concentrate, the gas-phase inside the inner container can be minimal, or can be disappeared.

Yet another aspect of the discharge product manufacturing method of the present invention includes a step of preparing the outer container 13 and the inner container 14 having a gas permeable; a step of charging the concentrate C into the inside of the inner container 14; a step of charging the pressurizing agent P into the pressurizing chamber Sp; a step of fixing the plug 15 to the openings of the outer container and the inner container; and a step of contracting the inner container 14 by permeating the pressurizing agent P charged between the inner container 14 and the outer container 13 through the inner container and dissolving the pressurizing agent P to the concentrate C.

The discharge product manufacturing method of the present invention includes the step of contracting the inner container by dissolving the pressurizing agent charged between the inner container and the outer container to the concentrate. When the pressurizing agent is dissolved to the concentrate, the gas inside the inner container permeates the inner container, so that the formation of the gas-phase inside inner container can be suppressed.

The solubility of the pressurizing agent P to the concentrate C is preferably higher than the gas G inside the inner container 14.

In the case that the solubility of the pressurizing agent to the concentrate is higher than the gas inside the inner container, the pressurizing agent is easily dissolved to the concentrate, and the formation of the gas-phase inside inner container can be suppressed.

The solubility of the pressurizing agent P with respect to 1 ml of the concentrate under 1 atm at 25° C. is preferably more than 0.02 ml.

In the case that the solubility of the pressurizing agent with respect to 1 ml of the concentrate under 1 atm at 25° C. is more than 0.02 ml, the pressurizing agent is easily dissolved to the concentrate.

Further, it is preferable that the step of fixing the plug 15 to the openings is the welding, and after the welding step, the step of contracting the inner container 14 is performed by dissolving the pressurizing agent P to the concentrate C.

When the plug is welded to the opening, if there is the concentrate in the vicinity of the welding part, there is a possibility that the welding is not sufficient due to the oscillation or the heat on the concentrate at the time of welding. Therefore, the welding has to be performed in the state that the inner container is not charged full with the concentrate and a gas-phase is remained. However, when the step to contracting the inner container is performed after welding the plug by dissolving the pressurizing agent inside the inner container to the concentrate, the gas-phase inside the inner container can be minimal, or can be disappeared.

The gas containing food manufacturing method of the present invention includes preparing the aforementioned double pressurized container, a food C in which the dissolved quantity of the gas is equal to or less than 0.05, and a compressed gas P for dissolving in the food in which the solubility to water under 25° C. is equal to or less than 0.05; charging the food C to the concentrate chamber Sc; after charging the gas P to the pressurizing agent chamber Sp, welding the plug 15 to the container body 16 by the ultrasonic wave welding and sealing the outer container 13 and the inner container 14; and permeating the gas P to be contained in the food C.

According to the gas containing food manufacturing method of the present invention, the food in which the dissolved quantity of the gas is equal to or less than 0.05 is charged, so that almost all the gas does not evaporate from the food when the plug is welded to the container body by the ultrasonic wave welding, and it can be surely welded. Further, since the gas is dissolved to the food by permeating the inner container, the food in which the gas is dissolved is obtained. Since the container body and the plug are made of the same material, the recycling becomes easy after discharging the food. Further, even when a space (head space) exists inside the inner container right after the concentrate is charged, the gas is dissolved to concentrate by permeating the inner container, and the inner container is contracted so as to eliminate the head space. Therefore, when the plug is opened, the concentrate is prevented from scattering. Further, since the pressure is largely lowered due to the dissolution of the gas, the container body can be thin.

It is preferable that the food C is charged to the inner container 14, and the pressurizing agent P is charged to the space between the outer container 13 and the inner container 14.

In the case that the food is charged to the inner container, and the pressurizing agent is charged to the space between the outer container and the inner container, the heat is hardly transmitted from the outside to the food inside the inner container, and when the food cooled in advance is charged inside the inner container, the gas between the outer container and the inner container is easily and quickly dissolved.

Further, it is preferable that the gas inside the inner container 14 is replaced with the aforementioned gas P after the food C is charged to the inner container 14.

When the gas inside the inner container is replaced with the aforementioned gas, the gas is easily dissolved to the food.

DETAILED DESCRIPTION OF THE INVENTION

Figure 1:
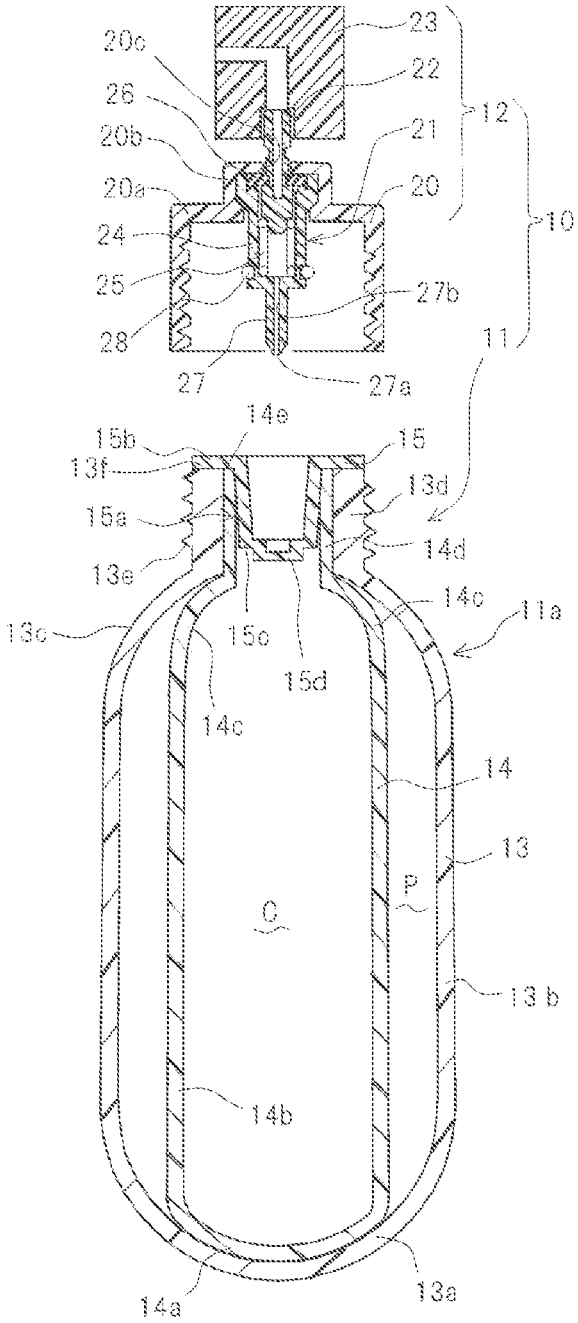
FIG. 1A is a schematic cross-sectional view showing an embodiment of selling state of a discharge device of the present invention.
FIG. 1B is a schematic cross-sectional view showing an embodiment of selling state of a discharge device of the present invention.
Figure 1:
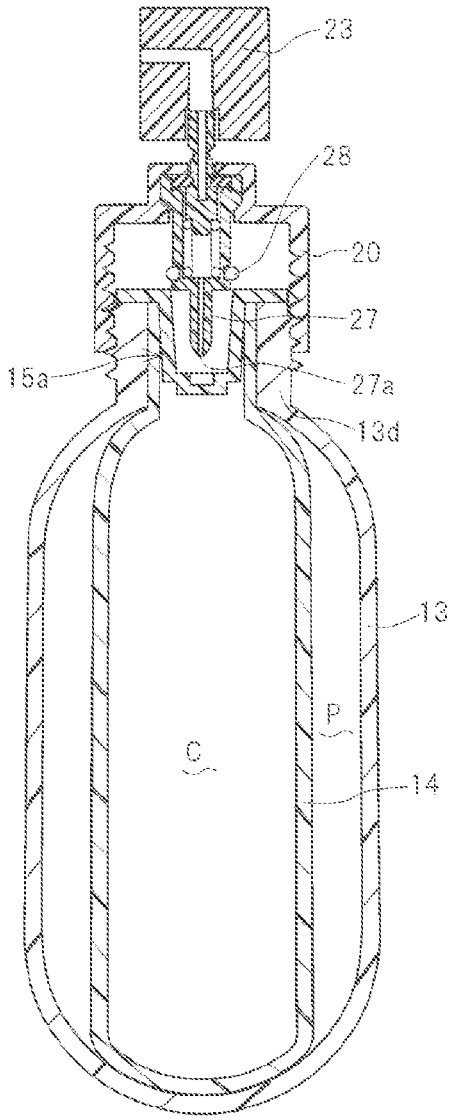

First, the outline of a discharge device of the present invention will be described with reference to FIGS. 1A and 1B. The discharge device 10 shown in FIG. 1A is provided with a double pressurized container 11, a discharge member 12, and concentrate C and pressurizing agent (propellant) P charged in the double pressurized container 11. The double pressurized container 11 filled with concentrate C and the pressurizing agent P is the discharge product (the pressurized product, and the double pressurized product) 11*a*. The discharge product 11*a* and the discharge member 12 are sold as a set product before assembling (see FIG. 1A), or it is sold in the unopened half assembled state (see FIG. 1B). The discharge product 11*a* may be sold together with the discharge member 12, and also, it is sold individually for a replacement. Also, the discharge member 12 may be sold individually.

The double pressurized container 11 is provided with an outer container 13, an inner container 14 stored inside the outer container and having flexibility, and a plug 15 sealing the outer container 13 and the inner container 14. The valve or a pump is not provided. The inside of the inner container 14 is a concentrate chamber for charging the concentrate C, and a space between the container 13 and the inner container 14 is a pressurizing agent chamber for charging the pressurizing agent P. They are sealed by the plug 15.

The outer container 13 is provided with a hemispherical bottom part 13*a*, a cylindrical body part 13*b* continued from its upper end, a shoulder part 13*c* continued from its upper end, and a thick cylindrical neck part 13*d* which projects upward from its upper end. A male screw 13*e* is formed at the outer periphery of the neck part 13*d*. The upper end surface 13*f* of the neck part 13*d* is approximately flat in order to fix the plug 15. Note that an annular projection (see reference numeral 36*b* in FIG. 3A) may be provided at the upper end surface 13*f* Since the bottom part 13*a* is formed in a hemispherical shape, the pressure resistance is enhanced, and the impact resistance at the time of dropping, etc. is enhanced. Therefore, it is safe at the time of distribution in a single item or delivery as a home delivery.

The inner container 14 is the same as the outer container 13 and is provided with a bottom part 14*a*, a body part 14*b*, a shoulder part 14*c*, and a neck part 14*d*. The outer surface of the neck part 14*d* of the inner container 14 is tightly attached to the inner surface of the neck part 13*d* of the outer container 13. The inner surface of the neck part 14*d* of the inner container 14 is a smooth cylindrical surface. At the upper end of the neck part 14*d* of the inner container 14, a flange for engaging with the upper end surface 13*f* of the neck part 13*d* of the outer container 13 may be provided (see reference numeral 38*b* in FIG. 3A). The bottom part 14*a* of the inner container 14 abuts to the bottom part 13*a* of the outer container 13, and at the time of charging the pressurizing agent or fixing the plug 15, etc., the inner container 14 is supported so as not to drop down.

Both the outer container 13 and the inner container 14 are made of synthetic resins, and specifically, made of thermoplastic resin such as polyethylene terephthalate, polyethylene naphthalate, polyethylene, polypropylene, etc., and for example, they can be manufactured by inserting a preform for the inner container into a preform for the outer container, and blow-molding the parts lower than the shoulder parts 13*c*, 14*c* at the same time. Specifically, it is preferable to use an injection-blow-molding method in which a predetermined shaped preform is performed by injection-molding and next the blow-molding is performed. As described above, by perform the blow-molding at the same time, the outer container 13 and the inner container 14 can be molded in approximately the same shape except the neck parts 13*d*, 14*d*. The outer container 13 is made thick to have pressure resistance, and the inner container 14 is made thin to have flexibility or collapsibility. Note that when the outer container 13 is made by blow molding with using a preform which is mixed with fine bubbles, it becomes white opaque by elongating the bubbles. Accordingly, the shape of the inner container 14 can be hidden. In this case, since it does not include a pigment, it is easy for recycling.

The plug 15 is provided with a bottomed cylindrical shaped closing part 15*a* which is inserted into the inside of the neck part 14*d* of the inner container 14, and an annular flange 15*b* continuing to its upper end. At the bottom part

15*c* of the closing part 15*a*, an openable seal part 15*d* which is made thin is provided. Since the openable seal part 15*d* is easily opened by the seal opening part 27 which will be described later, a weakening line such as annular thin part, annular groove, etc. can be formed. Further, the closing part 15*a* or the openable seal part 15*d* is partially hardened by cooling condition at the time of molding, and the elongation at the time of opening is suppressed, so that it may be easily broken. It is preferable that the outer periphery surface of the cylindrical part of the closing part 15*a* provides a fitting state with the inner surface of the neck part 14*d* of the inner container so that the air inside the inner container 14 can be discharged from a gap between them when the plug 15 is mounted to the neck part 14*d* of the inner container, and can liquid-seal the concentrate C inside the inner container 14. Further, the inner periphery surface of the cylindrical part of the closing part 15*a* is a preferably a smooth cylindrical surface so as to form a sealing with a valve when the openable seal part 15*d* is opened and not to leak the concentrate, or the inner periphery surface may be a tapered shape which decreases in a diameter toward lower side. After charging the concentrate C or the pressurizing agent P, the flange 15*b* of the plug 15 is fixed to the upper end surface 13*f* of the neck part 13*d* of the outer container 13 and the upper end surface 14*e* of the neck part 14*d* of the inner container 14 by an ultrasonic wave welding, a laser welding, a high frequency welding, etc., and they are sealed at the same time.

As the material of the plug 15, a thermoplastic resin having high thermal bondability to the outer container 13 and the inner container 14 is used and in the case that it is fixed by welding, the material is preferably the same as the material of the outer container 13 and the inner container 14. Other than the welding, the plug 15 may be adhered by an adhesive agent. By sealing the concentrate chamber and the pressurizing agent chamber with the plug 15, and by welding to any of the inner container 14 and the outer container 13, or both of them, the contents (concentrate C, pressurizing agent P) can be safely stored for a long time without leaking.

As the concentrate C, it includes human body goods such as skin supplies such as face cleanser, detergent, bath agents, moisturizers, cleansing agents, sunscreen, skin lotions, shaving agents, depilatory agents, antiperspirants, sterilizing disinfectants, pest repellents, etc., hair supplies such as treatment agents, styling agents, hair dyeing agents, etc., foods such as whipped cream, etc., household goods such as deodorants, fragrances, insecticide, insect repellent, pollen remover, germicide, etc. However, it is not limited to these applications. The concentrate C is preferably attached to the inner surface side of the openable seal part 15*d*. With this, when the plug 5 is welded to the outer container 13 or the inner container 14, the openable seal part 15*d* is cooled by the concentrate C. Therefore, the problem such that the openable seal part 15*d* is melted by heat can be solved.

As the pressurizing agent P, it is preferable to include compressed gas such as nitrogen gas, compressed air, carbon dioxide, etc. The pressure inside the double pressurized container by the pressurizing agent is preferably 0.1 to 0.5 MPa (25° C., gauge pressure), and it is preferable to have pressure 0.3 to 0.5 MPa (25° C., gauge pressure) which is almost same pressure as a carbonated drink. Further, the capacity of the outer container 13 is preferably 30 to 500 ml. The capacity of the inner container (concentrate chamber) 14 is preferably approximately 20 to 300 ml. The capacity of the pressurizing agent chamber is preferably approximately 10 to 200 ml.

As describe above, the number of parts of the double pressurized container 11 is few, and it does not include a moving part such as a valve, so that it can be manufactured at low cost. Since the pressure of the double pressurized container 11 is low and is almost same as the carbonated drink, it is safe when consumers carries or when distributors delivery. Further, in case, if the outer container 13 cracks, only the pressurizing agent P leaks, but the concentrate C does not leak. Therefore, safety can be further enhanced.

The discharge member 12 is provided with a cap (mounting part) 20 screwing with a male screw 13*e* of the neck part 13*d* of the outer container 13, a valve (valve) 21 held by the cap 20, and an operation button (operation part) 23 mounted to the stem 22 of the valve 21. The cap 20 is a bottomed cylindrical shape, and a female screw is formed in the inner periphery surface. The upper bottom 20*a* is provided with a shallow bottomed cylindrical shaped valve holding part 20*b* for holding an upper part of the housing 24 of the valve 21 in the manner of being upwardly projected, and a hole 20*c* for passing through a stem 22 is formed at the center of the upper bottom.

The valve 21 has a known basic structure which has a bottomed cylindrical shaped housing 24, the stem 22 movably vertically stored inside the housing, a spring 25 energizing the stem 22 upwardly, and a stem rubber 26 provided between the upper end of the housing 24 and the upper bottom face of the valve holding part 20*b*. Further, in this embodiment, the housing 24 is provided with a thin tubular seal opening part 27 which is projected downward at the lower end thereof, and a seal member 28 such as O-ring, etc. is mounted at the lower part outer periphery of the housing 24. The lower end 27*a* of the seal opening part 27 is sharp in order to easily break the openable seal part 15*d*. The seal member 28 is a member to seal between the inner periphery surface of the closing part 15*a* of the plug 15 and the housing 24 at the time of opening and after the opening.

At the time of distribution and sale, the cap 20 is attached to the outer container 13 as shown in FIG. 1B, and the double pressurized container 11 and the discharge member 12 are temporarily connected by loosely screwing the cap 20. Accordingly, the consumer who purchases it can easily perform the opening operation. In this state, the seal member 28 does not abut to the inner surface of the closing part 15*a*. It sometimes sales and distributes as a set in which the discharge product 11*a* and the discharge member 12 are not assembled.

When the user purchases the discharge device 10 and uses it, first, the cap 20 is screwed in. Accordingly, the seal member 28 seals between the plug 15 and the housing 24. Next, when the cap 20 is further screwed in, the lower end 27*a* of the seal opening part 27 of the housing 24 breaks through the openable seal part 15*d* of the plug 15, and connects the concentrate chamber inside the housing 24 with inside the inner container 14 (see FIG. 2A).

When the openable seal part 15*d* is broken, there is a possibility that the concentrate C leaks from the gap between the inner periphery of the openable seal part 15*d* and the outer periphery of the seal opening part 27. However, since the gap between the closing part 15*a* and the housing 24 is sealed by the seal member 28, the concentrate C remains inside the closing part 15*a*, and it does not leak outside. Further, the inner pressure functions as pushing up the housing 24, but the cap 20 and the outer container 13 are screwed, so that scattering out the discharge member 12 is suppressed.

Since the concentrate C inside the concentrate chamber is pressurized by the pressurizing agent P through the inner container 14, when the user presses the operation button 23 attached to the stem 22, the stem 22 is lowered and the stem rubber 26 is deflected. Then the stem hole opens, so that the concentrate C inside the inner container 14 is discharged to the outside through the seal opening part 27, the housing 24, the stem 22, and the operation button 23. When stop pressing, the stem 22 is raised, and it stops discharging. The pressurizing agent chamber in which the pressurizing agent P is charged is closed, and it does not connect with the outside or the concentrate chamber, so that the pressurizing agent P does not leak outside.

Figure 2:
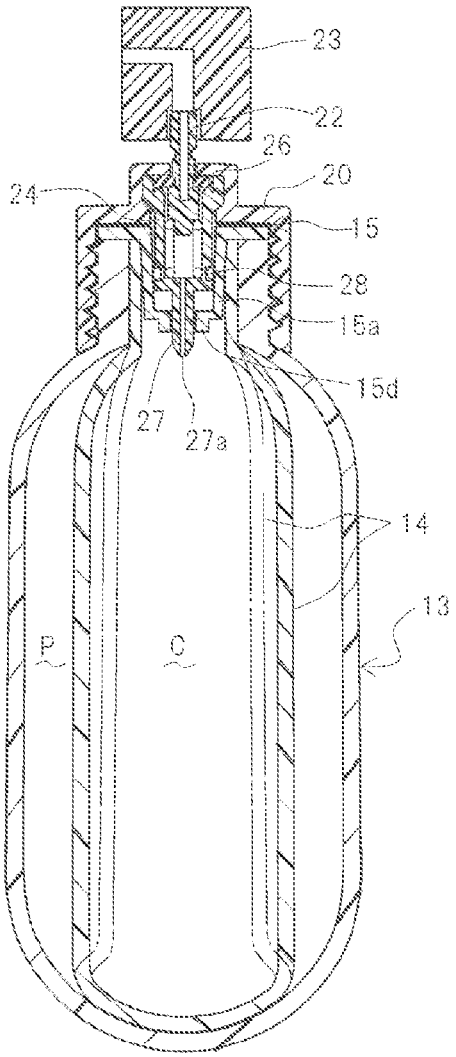
FIG. 2A is a schematic cross-sectional view of the discharge device of FIG. 1 after it is opened.
FIG. 2B is a schematic cross-sectional view of the discharge device of FIG. 1 after it is used.
FIG. 2C is a main part cross-sectional view showing another embodiment.
Figure 2:
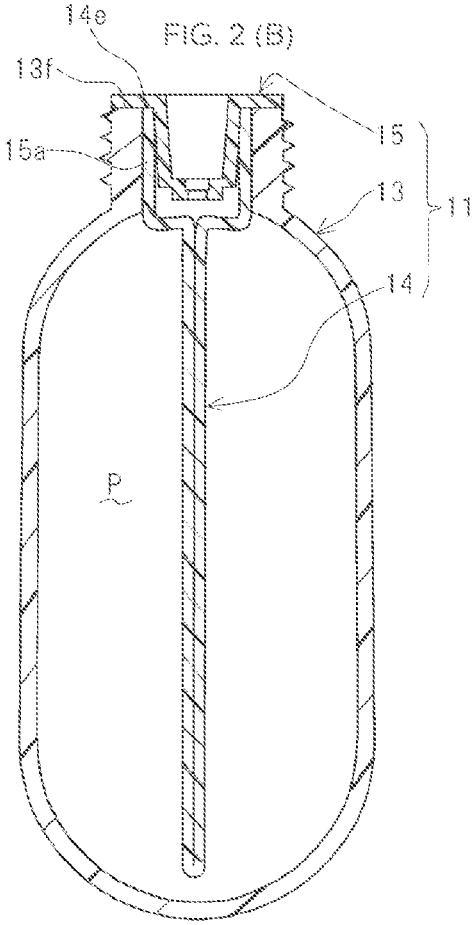
Figure 2:
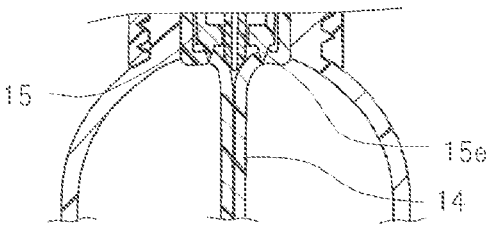

When the amount of the concentrate C in the inner container 14 decreases, the inner container 14 is contracted as shown by the imaginary lines in FIG. 2A. And, after discharging all, the walls of the inner container 14 are tightly contacted to each other and become flat as shown in FIG. 2B. Further, since the inner container 14 is molded by the blow molding, an area from the lower end of the neck part 14*d* to the shoulder part 14*c* is thicker than the body part 14*b*. Therefore, at last, the shoulder part 14*c* is deformed and pushed up into the neck part 14*d*. In this state, the cap 20 is removed from the outer container 13. Since the double pressurized container 11 uses compressed gas as the pressurizing agent P, when the concentrate C becomes empty, the pressure decreases as approximately 0.01 to 0.2 MPa (gauge pressure). However, in order to discharge the pressurizing agent P in the outer container 13, it is preferable to provide a spike 15*e* extending downward at the bottom part of the seal part 15*a* as shown in FIG. 2C, so that a hole is automatically made when the inner container 14 is contracted and the shoulder part 14*c* is pushed up. With this, the pressurizing agent P inside the outer container 13 can be safely discharged, and the outer container 13 can be crushed, volume-reduced, and discarded. Note that the removed discharge member 12 is reused so as to be mounted to a new double pressurized container 11. It is preferable that a plurality of spikes 15*e* is projected downwardly.

Next, another embodiment of the discharge device will be described with reference to FIGS. 3A and 3B. The double pressurized container 31 and the discharge member 32 of the discharge device 30 of FIG. 3A are provided in the same basic structure as the double pressurized container 11 and the discharge member 12 of FIGS. 1A and 1B, and these are partially changed.

The double pressurized container 31 is provided with an outer container 33, an inner container 34, and a plug 35. An annular projection 36*b* is formed at the upper end surface 36*a* of the neck part 36 of the outer container 33, to make a seal point with the plug 35 by increasing the contact pressure when performing the ultrasonic wave welding. The annular projection may be provided at the plug 35 side, or it may be provided at both sides. A plurality of inclined parts 36*c* are provided at the inside of the upper end surface 36*a*, and these provide a space to store resin pieces which are made by cooling the resin melted when performing the ultrasonic wave welding, so that it is not projected. The upper end surface 38*a* of the neck part 38 of the inner container 34 is projected higher than the upper end surface 36*a* of the outer container 33, and a flange 38*b* engaging with the upper end surface 36*a* of the outer container 33 is formed at the projected part. The thickness of the flange 38*b* (dimension of radial direction) is approximately ⅓ to ½ of the thickness of the neck part 36 of the outer container 33. Further, at the upper end surface 38*a* of the neck part 38 of the inner container 34, an annular projection 38*c* for welding is formed in order to make a seal point by increasing the contact pressure with the plug 35. Such annular projection may be provided at the plug 35 side, or it may be provided at both sides.

At the lower surface of the flange 38*b* of the inner container 34, a horizontal groove 38*d* for charging the pressurizing agent extending in the radial direction is formed. Further, at the outer periphery surface of the neck part 38 of the inner container 34, a vertical groove 38*e* continuing to the horizontal groove 38*d* is formed. The upper part of the neck part 38 of the inner container 34 is tightly fitted to the inner periphery surface of the neck part 36 of the outer container 33 except the vertical groove 38*e*.

The plug 35 is provided with a bottomed cylindrical shaped seal part 39 to be inserted into the neck part 38 of the inner container 34, and an annular flange 40 continuing to the upper end of the seal part. It is preferable that the inner surface of the neck part 38 of the inner container 34 fits with the outer surface of the seal part 39 in a fitting state that air inside the inner container 34 can be discharged when the plug 35 is mounted to the neck part 38 of the inner container, and further, the concentrate inside the inner container 34 can be sealed. The seal part 39 is provided with a tubular shaped fitting cylindrical part 41 projecting downwardly at the center of the bottom part of the seal part. The bottom part 42 is provided in a position slightly higher than the lower end of the fitting cylindrical part 41, and an openable seal part 44 surrounded by the annular weakened line 43 is provided at the center of the bottom part 42. The weakened line 43 has sufficient seal function in the unopened state, and it has a shape which is easily broken. In this embodiment, the weakened line 43 is formed in a V-groove.

The bottom part 42 is provided at the position slightly higher than the lower end of the fitting cylindrical part 41 to enhance the rigidity of the bottom part 42 and to facilitate the breaking of the weakened line 43. The diameter of the fitting cylindrical part 41 becomes smaller than the diameter of the seal part 39 in order to enhance the molding accuracy of the inner surface of the fitting cylindrical part 41, and in order to decrease the upward force applied to the plug 35 by reducing the area which is surrounded by the seal member 45 of the discharge member 32 and receives the internal pressure. Further, this is to secure a space for storing the valve holding part 20*b* which is projected downwardly. The lower end of the fitting cylindrical part 41 may be a tubular shape, but a groove may be provided so as not to accumulate gas between the lower end and the bottom part 42, or a spike may be provided to penetrate the inner container 32 (see reference numeral 15*e* in FIG. 2C).

The flange 40 of the plug 35 is provided with an annular disk part 46 which expands radially outward from the upper end of the seal part 39, and an outer cylindrical part 47 which extends downward from the outer edge of the annular disk part 46. The lower surface of the annular disk part 46 is a part to be sealed by abutting to the upper end surface 38*a* of the neck part 38 of the inner container 34, and the lower surface of the outer cylindrical part 47 is a part to be sealed by abutting to the upper end surface 36*a* of the neck part 36 of the outer container 33. Also in this embodiment, welding and sealing of those sealing surfaces are performed at the same time by the ultrasonic wave welding, etc.

Figure 4:
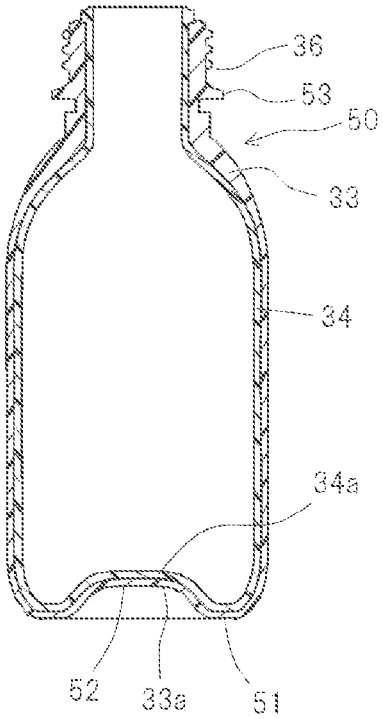
FIG. 4A is a cross-sectional view showing another embodiment of a double container related to the discharge device of the present invention.
FIG. 4B is a cross-sectional view showing another embodiment of a discharge product related to the discharge device of the present invention.
FIG. 4C is a cross-sectional view showing another embodiment of a discharge device related to the present invention.
Figure 4:
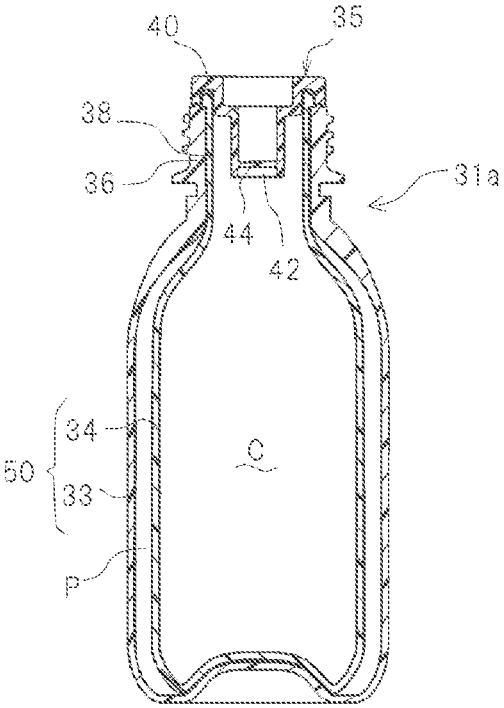
Figure 4:
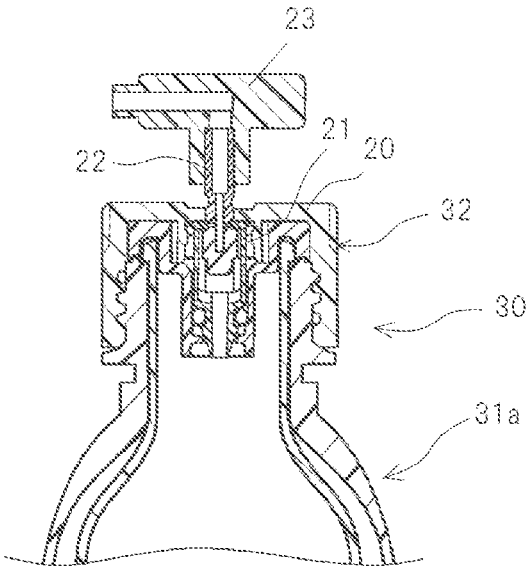

The discharge member 32 is provided with a cap 20, a valve 21 held by the cap 20, and an operation button (see FIG. 4C) mounted to the stem 22 of the valve 21. In this embodiment, a cylindrical valve holding part 20*b* is projected downward from the center of the cap 20. The valve 21 is provided with a housing 24, a stem 22 which is stored inside the housing in a up-down movable manner, a spring 25 energizing the stem 22 upwardly, and a stem rubber 26. At the outer periphery of the housing 24, an annular groove is formed, and a seal member 45 such as an O-ring, etc. is stored in the annular groove. Those are practically the same as the embodiment of FIGS. 1A and 1B, so that the detailed description will be omitted.

In this embodiment, the lower end of the housing 24 is a seal opening part 27 which is provided with the approximately conical shape projection. As shown in FIG. 3B, a communication hole 48*a* and a vertical groove 48*b* are formed in the seal opening part 27 in order to communicate between the inside of the housing 24 and the inside of the inner container 34 after opening. The communication hole 48*a* and the vertical groove 48*b* may be formed at one place, but multiple of these may be provided. At the lower end 27*a* of the seal opening part 27, an end surface which is positioned closely to or abuts to the upper surface of the openable seal part 44 is formed. As shown in FIG. 3A, the position of the end surface is a position which abuts to the openable seal part 44 when the cap 20 is screwed approximately one or two times to the male screw of the outer container 33. Accordingly, at the time of shipping, the discharge member 35 and the double pressurized container 31 can be connected in a state that the cap 20 is loosely screwed and the openable seal part 44 is not broken with remaining sealing state.

When the user uses, opening can be done by only rotating the cap 20 a few times. When the cap 20 is rotated, the whole cap 20 and the valve 21 are lowered. Then, the end surface 27*a* of the seal opening part 27 presses and breaks the openable seal part 44, as shown in FIG. 3B. For example, the weakened line 43 is not formed or the V-groove is made shallow at one section in advance, so that the openable seal part 44 does not drop off when opening, and it remains as a hanging state from the bottom part 42. Therefore, there is an advantage that the communication hole 48*a* is not blocked by the openable seal part 44 which becomes free. When a plurality of communication holes 48*a* are provided, if one is blocked, other communication holes 48*a* can communicate.

The double container 50 shown in FIG. 4A is provided with the outer container 33 and the inner container 34 stored inside the outer container. The plug is not provided yet. In this embodiment, the bottom part 33*a* of the outer container 33 is provided with an annular flat surface 51 and a dome-shaped project part 52 which is provided at the center of the flat surface and projects upwardly. The inner container 34 also has a bottom part 34*a* which is similar to the outer container 33. It may be a petaloid type. This can be stably placed on a flat surface of a table, etc. Further, an annular support part 53 is provided at the outer periphery of the neck part 36 of the outer container 33. The support part 53 is held by a claw or a holder, etc. at the time of the transport of the double container 50 or the manufacturing steps of charging the concentrate, charging the pressurizing agent, welding the plug, etc. Other points are practically the same as the double container of FIG. 1A.

The discharge product 31*a* of FIG. 4B is the double container 50 of FIG. 4A in which the concentrate C is charged in the inside (concentrate chamber) of the inner container 34, and the pressurizing agent (propellant) P is charged between the inner container 34 and the outer container 33 (pressurizing agent chamber), and the upper end opening of the inner container 34 and the outer container 33 is sealed by the plug 35. The plug 35 is similar to the plug 35 of FIG. 3A, and the bottom part 42 of the plug 35 is provided with the openable seal part 44. The flange 40 of the plug 35 is welded to the upper end of the neck part 36 of the outer container 33 and the upper end of the neck part 38 of the inner container 34 by the ultrasonic wave welding. Instead of the ultrasonic wave welding, it may be bonded by adhesive agents.

In this discharge product 31*a*, it is sealed by the plug 35, and a valve for opening is not provided, and the openable seal part 44 is provided inside, so as to have high safety at the time of transportation. Particularly, since the outer container 33 and the inner container 34 are made of synthetic resin, and the inner container 34 is surrounded by the pressurizing agent P, and further, it is surrounded by the outer container 33, the elasticity of the discharge product 31*a* is high, and even dropped, it is hardly broken. Further, since the openable seal part 44 is provided inside, it reduces the risk that the openable seal part 44 is erroneously broken. Therefore, the safety is further enhanced.

The discharge device 30 of FIG. 4C is a device in which the discharge member 32 is mounted to the discharge product 31*a* of FIG. 4B, and it is shown in the opening state. The discharge member 32 is provided with a cap 20, a valve 21 held to the cap 20, and an operation button (actuator) 23 attached to the stem 22 of the valve 21. The cap 20 and the valve 21 are practically the same as the cap 20 and the valve 21 of the discharge member 32 of FIG. 3A. The operation button 23 is practically the same as the operation button 23 of FIG. 1A.

As described above, in the discharge device of the present invention, after the concentrate chamber is empty, the discharge member can be removed and replaced to a new discharge product. However, when the discharge member used for, for example, spraying insecticide is attached to a discharge product for hair care product, there is a risk that will harm the user's health. Further, when different types of concentrates are mixed, there is a risk that an unexpected chemical reaction may occur. The dispenser system of the present invention can avoid the aforementioned problems by not be able to mount the discharge member of the particular group to the discharge product of another group.

The reuse between the different types of concentrations each other is prevented by, for example, changing a dimension or a shape of the part fitting the seal part of the plug and the housing in each type of the concentrates or by changing an inner diameter of the cap or a pitch of the screw. Further, it may be considered that a combination in a case in which a risk is high is surely prevented, and if the risk is low, it is accepted.

In the double pressurized container 11 of FIG. 1A, the height of the upper end surface 13*f* of the neck part 13*d* of the outer container 13 and the height of the upper end surface 14*e* of the neck part 14*d* of the inner container 14 are the same. Therefore, when the flange 15*b* of the plug 15 abuts to both of the upper end surfaces 13*f*, 14*e* of the neck parts 13*d*, 14*d*, and the horn (reference numeral H of FIG. 5A) abuts to the upper surface of the flange 15*b*, and the ultrasonic wave welding is performed, the vibration is transmitted via the part which is the same thickness as the flange 15*b*. Accordingly, the vibration is approximately equally transmitted, and both can be welded nearly equal. The problem such that only one side is welded, and the other is insufficiently welded does not occur.

The double pressurized container 55 of FIG. 5A is similar to the double pressurized container 11 of FIGS. 1A and 1*s* provided with the outer container 13, the inner container 14, and the plug (lid) 15. The inside of the inner container 14 is the concentrate chamber Sc, and the space between the outer container 13 and the inner container 14 is the pressurizing agent chamber Sp. The outer container 13 is almost the same as the outer container 33 of FIG. 4, and is provided with the bottom part, the body part, the shoulder part 13*c*, and the neck part 13*d*. However, in the double pressurized container 55, at the inner periphery side of the upper end surface 13*f* of the neck part 13*d* of the outer container 13, an annular step part 13*h* is formed. Note that it can be seen that a protruding wall 13*i* is provided at the outer periphery side of the upper end surface.

On the other hand, the inner container 14 is practically the same as the inner container 34 of FIG. 4A, and is provided with the bottom part, the body part, the shoulder part 14, and the neck part 14*d*. In this inner container 14, a flange 14*f* is provided at the outer periphery of the upper end of the neck part 14*d*. The thickness of the flange 14*f* in the vertical direction is the same as the depth of the annular step part 13*h*, and the outer diameter of the flange 14*f* is smaller than the internal diameter of the annular step part 13*h*. Accordingly, the flange 14*f* can be engaged with the annular step part 13*h*. In the engagement state, the heights of the upper end surface 13*f* of the neck part 13*d* of the outer container 13 and the upper end surface 14*e* of the neck part 14*d* of the inner container 14, that is, the upper end surface of the flange 14*f*, are the same.

At the upper end surface 13*f* of the neck part 13*d* of the outer container 13, an annular projection 13*g* is formed in order to provide a seal point by increasing the contact pressure with the plug 15 when performing the ultrasonic wave welding. Further, at the upper end surface 14*e* of the neck part 14*d* of the inner container 14, an annular projection 14*g* is formed in order to provide a seal point by increasing the contact pressure with the plug 15 when performing the ultrasonic wave welding.

The plug 15 is provided with a bottomed cylindrical shaped seal part 15*a* which is inserted into the inside of the neck part 14*d* of the inner container 14, and a disk-shaped flange 15*b* expanding outward from the upper end of the seal part. The seal part 15*a* is provided with an inner cylindrical part 15*a*1 of the upper side, a narrow tubular-shaped fitting cylindrical part (valve housing part) 15*a*2 of the lower side, and a bottom part 15*c*. The inner periphery surface of the fitting cylindrical part 15*a*2 is a cylindrical surface, and after fitting the discharge member, this is the part where the seal member (reference numeral 28 of FIG. 1A, reference numeral 45 of FIG. 3A) is tightly contacted. At the bottom part 15*c*, the thickened openable seal part 15*d* is provided. In order to being easily opened by the seal opening part (reference numeral 27 of FIGS. 1A and 3B), the openable seal part 15*d* is surrounded by the weakened line 15*f* such as an annular thin part, an annular groove, etc. Further, a reinforcement part (reinforcing rib) 15*g* is provided at the bottom part 15*c*, and at the part, the weakened lines is not provided, so that when it is broken by the seal opening part, it is hanged down with the connection of the bottom part 15*c* at the reinforcement part 15*g*. However, it may be possible that the reinforcement part 15*g* is not provided and the openable seal part 15*d* is dropped off.

Further, at the double pressurized container of FIG. 5A, the openable seal part 15*d* is made thicker than the bottom part 15*c* and is projected upwardly. Accordingly, when a pressure receiving part 15*d*1 of the upper surface of the openable seal part 15*d* is pressed by the seal opening part (reference numeral 27 of FIG. 3) of the discharge member, the openable seal part 15*d* is hardly deformed, so that the weakened line 15*f* is easily broken.

As described above, since the heights of the upper end surface 13*f* of the outer container 13 and the upper end surface 14*e* of the inner container are the same, the thickness of the flange 15*b* of the plug 15 (dimension of the vertical direction) can be uniformed. Accordingly, when the horn H is contacted to the upper surface of the plug 15 and the ultrasonic wave welding is performed, the contact pressure between the flange 15*b* and the upper end surface 13*f* of the outer container 13 and the contact pressure between the flange 15*b* and the upper end surface 14*e* of the inner container 14 can be almost the same, and as shown in FIG. 5B, the welding of both of the welding parts Y1, Y2 can be almost the same. That is, the problem such that when one is welded, the other is insufficiently welded does not occur. Note that since the flange 14*f* of the inner container 14 is supported by the annular step part 13*h* of the outer container, the force pressing the horn H does not escape.

In the double pressurized container 55 of FIG. 5A, at the lower surface of the flange 14*f* of the inner container 14, a horizontal groove 14*h* for charging pressurizing agent extending in a radial direction is formed. Further, at the outer periphery surface of the neck part 14*d* of the inner container 14, a vertical groove 14*i* continuing to the horizontal groove 14*h* is formed. The upper part of the neck part 14*d* of the inner container 14 fits tightly to the inner periphery surface of the neck part 13*d* of the outer container 13 except the vertical groove 14*i*. Further, within the outer periphery surface of the flange 14*f* of the inner container 14, at the part corresponding to the horizontal groove 14*h*, a notch groove 14*f*1 for charging pressurizing agent which extends in the vertical direction is formed.

Figure 5:
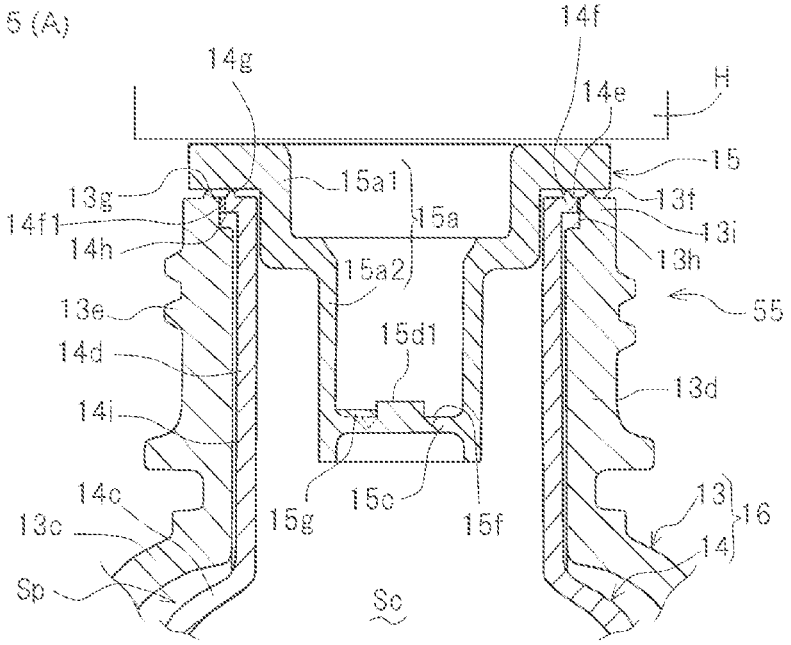
FIG. 5A is a main part cross-sectional view showing another embodiment of the double pressurized container of the present invention before the plug is welded.
FIG. 5B is a main part cross-sectional view showing another embodiment of the double pressurized container of the present invention after the plug is welded.
Figure 5:
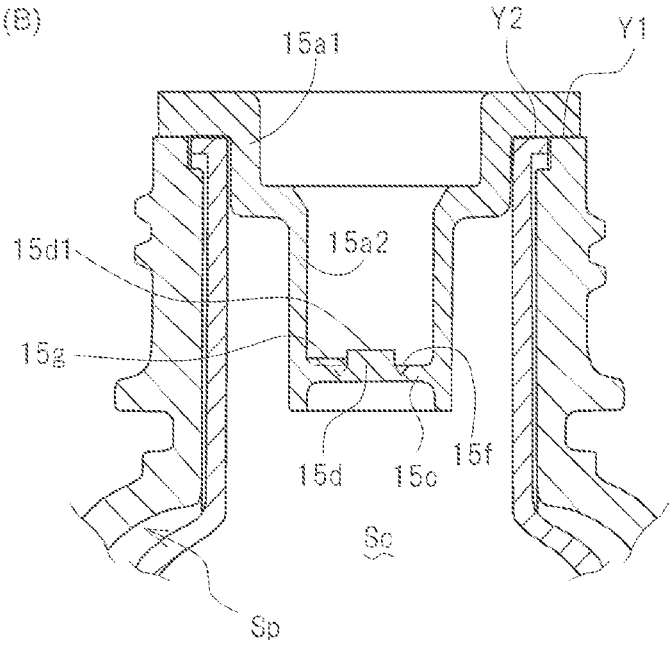
Figure 6:
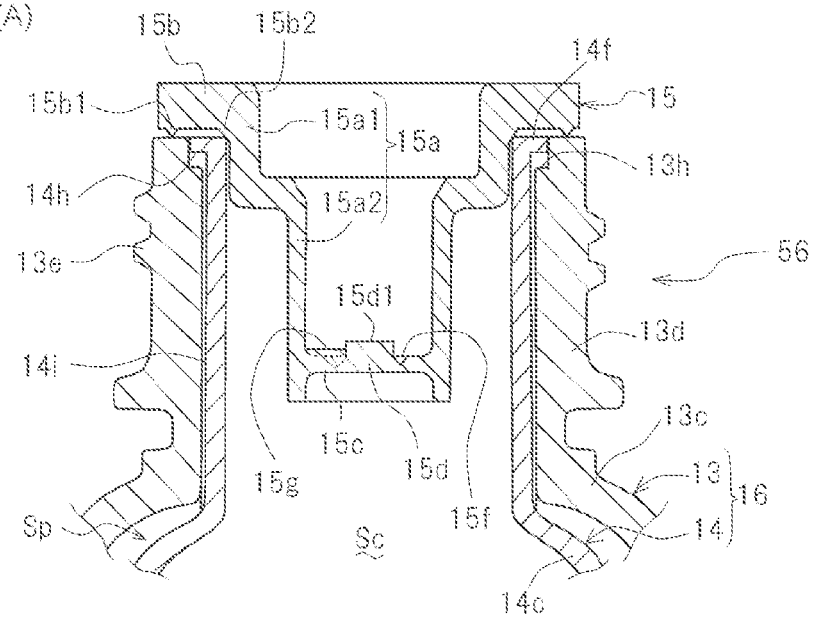
FIG. 6A is a main part cross-sectional view showing yet another embodiment of the double pressurized container of the present invention before the plug is welded.
FIG. 6B is a main part cross-sectional view showing yet another embodiment of the double pressurized container of the present invention after the plug is welded.
Figure 6:
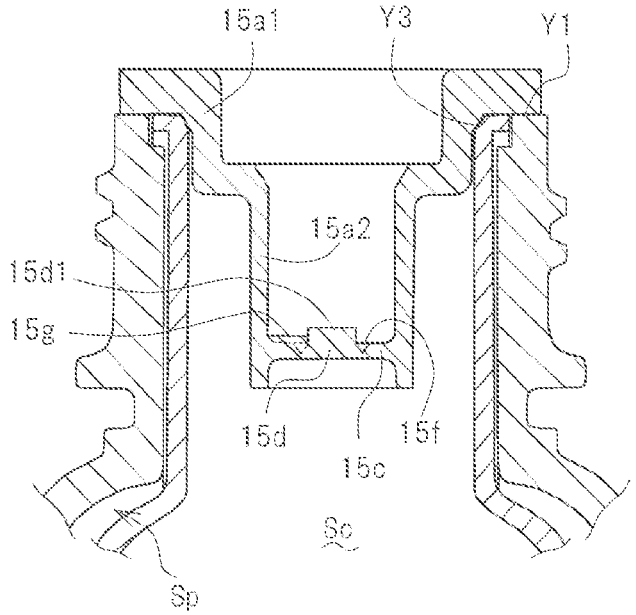

In a double pressurized container 56 shown in FIG. 6A, the annular projection in order to provide a seal point by increasing the contact pressure with the plug 15 when performing the ultrasonic wave welding is not provided in the outer container 13 and the inner container 14, and it is provided in the plug 15 side. That is, the upper end surface 13*f* of the neck part 13*d* of the outer container 13 and the upper end surface 14*e* of the flange 14*f* of the inner container are formed flat, and an annular projection 15*b*1 in order to provide a seal point at the lower surface of the flange 15*b* of the plug 15 in between with the upper end surface 13*f* of the outer container 13 is provided. Further, at the lower surface of the flange 15*b* of the plug 15 and the root (base part) of the outer periphery surface of the seal part 15*a*, an inclined part (fillet part) 15*b*2 in order to provide a seal point in between with the corner of the upper end inner periphery of the neck part 14*d* of the inner container 14 is formed. Other points are similar to the double pressurized container 55 of FIG. 5A.

In the double pressurized container 56 with such structure, as shown in FIG. 6B, after the ultrasonic wave welding, a welding part Y1 is formed between the upper end surface 13*f* of the outer container 13 and the flange 15*b* of the plug 15, and a welding part Y3 is formed between the inclined part 15*b*2 of the plug 15 and the corner of the upper end inner periphery of the inner container 14. Since the welding part Y3 by the inclined part 15*b*2 is welded at two surfaces of the horizontal surface (upper end surface 14*e*) and the vertical surface (inner periphery surface) with respect to the inner container 14, the welding strength and the sealability are high.

Figure 7:
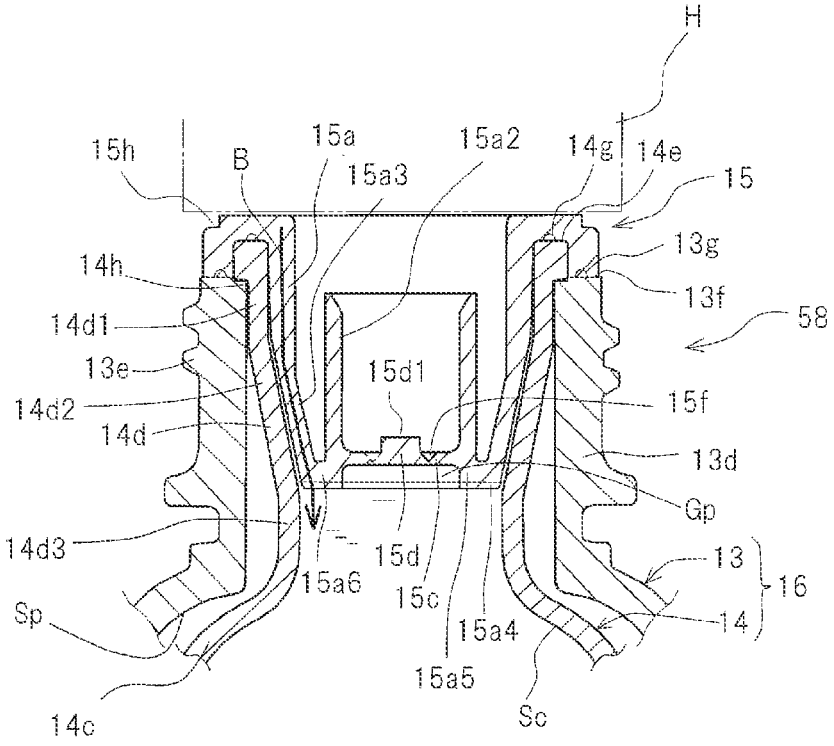
FIG. 7 is a main part cross-sectional view showing yet another embodiment of the double pressurized container of the present invention.

In the double pressurized container 58 shown in FIG. 7, an approximately cylindrical seal part 15*a* extends to the lower side, and a fitting cylindrical part 15*a*2 is concentrically provided at the inner side of the seal part 15*a*. The fitting cylindrical part 15*a*2 raises upward from the central area of the bottom part 15*c* of the seal part 15*a*, and the upper end opens. The upper part of the seal part 15*a* is approximately cylindrical shape, and the lower part 15*a*3 is a tapered shape which becomes narrow downwardly. However, it may be a cylindrical shape from the upper part to the lower part. An annular step part or a rib may be provided at the outer side of the lower part 15*a*3, and in this case, the annular step part or the rib form a line seal with a tapered part 14*d*2 of an inner container 14 which will be described later when mounting the plug 15 to the container body 16. And when the pressurizing agent P is charged in the pressurizing agent chamber Sp, the line seal can prevent the pressurizing agent from entering the inside of the inner container 14.

On the other hand, the neck part 14*d* of the inner container 14 has a shape almost closed contact with the outer periphery surface of the seal part 15*a*, and is provided with a cylindrical upper part 14*d*1, a tapered part 14*d*2 which becomes narrow downwardly below the cylindrical upper part, and a cylindrical part 14*d*3 extending downward from the lower end of the tapered part. The lower end of the cylindrical part 14*d*3 continues to the shoulder part 14*c*. That is, the tapered part 14*d*2 of the neck part 14*d* of the inner container 14, the cylindrical part 14*d*3 and the upper part of the shoulder part 14*c* form a narrowed portion.

The point in which the openable seal part 15*d* surrounded by the weakened line 15*f* is provided at the bottom part 15*c* of the fitting cylindrical part 15*a*2 is similar to the double pressurized container 11 of FIGS. 1A and 3A. However, in the double pressurized container 58 of FIG. 7, a pressure receiving part 15*d*1 is provided on the upper surface of the openable seal part 15*d*. Therefore, the openable seal part 15*d* is hardly deformed, and the breaking of the openable seal part 15*d* by the seal opening part (reference numeral 27 of FIG. 1A) of the discharge member is facilitated. Further, a notch 15*h* is provided at the outer periphery of the upper surface of the plug 15. By this notch 15*h*, when performing the ultrasonic wave welding by pressing the horn to the upper surface of the plug 15, the vibration of the horn is concentrated to the annular projection 13*g* on the upper end of the neck part of the outer container 13.

In the plug 15 of FIG. 7, a fitting cylindrical part 15*a*2 is provided inside the seal part 15*a*, and the lower end 15*a*4 of the aforementioned tapered lower part 15*a*3 is connected to the lower end of the lower cylindrical part 15*a*5 extending downward from the fitting cylindrical part 15*a*2 via a connection part 15*a*6. Further, the openable seal part 15*d* is provided to the bottom part 15*c* which closes the position slightly upper than the lower end of the lower part cylindrical part 15*a*5. Accordingly, when performing the ultrasonic wave welding by pressing the horn to the upper surface of the plug 15, the vibration of the horn is easily transmitted to the concentrate C side from the lower end 15*a*4 of the seal part via the seal part 15*a* (see arrow B). Further, since the openable seal part 15*d* is provided higher than the connection part 15*a*6, the vibration is hardly transmitted to the openable seal part 15*d*. Therefore, the melting or the penetrating, etc. of the weakened line 15*f* is prevented.

In the double pressurized container 58 of FIG. 7, a narrowed part configured with the tapered part 14*d*2 and the cylindrical part 14*d*3 is formed at the neck part 14*d* of the inner container 14, and since the narrowed part is tightly contacted with the seal part 15*a* of the plug 15, when the concentrate C is charged into the inner container 14, the gas-phase Gp (head space Hs) becomes small. Accordingly, it reduces a risk of occurring such problems that the concentrate C is discharged vigorously by the gas pressurized due to the gas-phase Gp and splashes when the user starts using, and further, the gas is mixed with the concentrate C and the concentrate C is not continuously discharged at the time of discharging. Therefore, the discharging becomes smooth. Particularly, even if the concentrate includes a post-foaming gel composition or a post-forming cream composition containing a foaming agent such as isopentane, 1-chloro-3,3,3-trifluoropropene, etc., in which the boiling point is 10 to 35° C., the gas-phase Gp is small, so that the concentrate is prevented from foaming right after the charging, and it can be discharged in the gel state or the cream state.

In the above, the preferable embodiments of the present invention were described. However, the present invention is not limited to the aforementioned embodiments, and various modifications may be made within the scope of the present invention. In the aforementioned embodiments, the plug is welded to both of the inner container and the outer container, but it may be fixed to any one of these, and the other one may be simply sealed by O-ring, etc. Further, in the aforementioned embodiments, the inner container and the outer container are manufactured by the blow molding at the same time, but it may be manufactured separately, and after that, the inner container may be stored inside the outer container, or the inner container may be manufactured by the blow molding in the molded outer container. The annular projections 38*c*, 36*b* which can make sure the seal point of FIG. 3A, etc. can be also provided at the outer container 13, the inner container 14, or the plug 15 of FIG. 1A.

In the double pressurized container 58 of FIG. 7, the neck part 14*d* of the inner container 14 and the lower part 15*a*3 of the seal part 15*a* of the plug 15 may be a straight cylindrical shape. However, it is preferable that the narrowed portion is provided in the neck part 14*d* of the inner container 14, and the lower part 15*a*3 of the seal part 15*a* of the plug 15 is formed in a tapered shape, since the diameter and the volume of the gas-phase Gp can be smaller.

Figure 8:
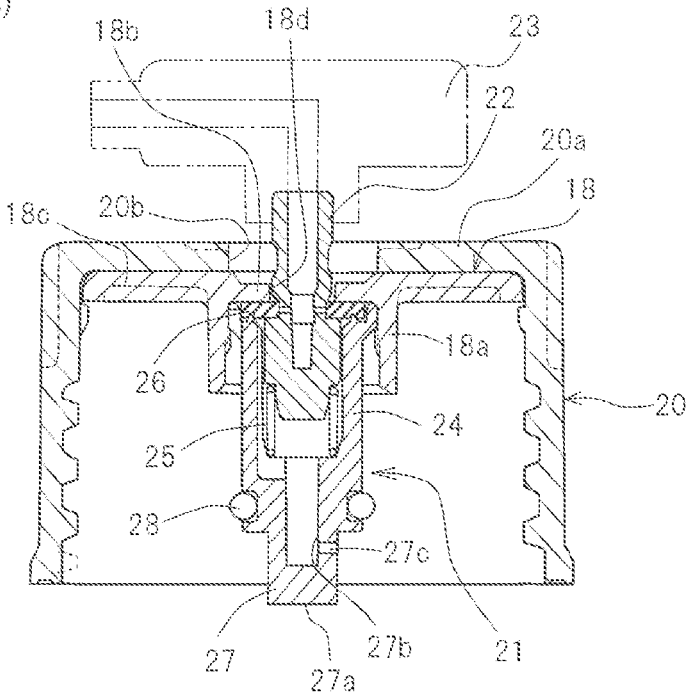
FIG. 8A is a main part cross-sectional view showing another embodiment of the discharge member.
FIG. 8B is a main part cross-sectional view showing another embodiment of the pressurized container.
Figure 8:
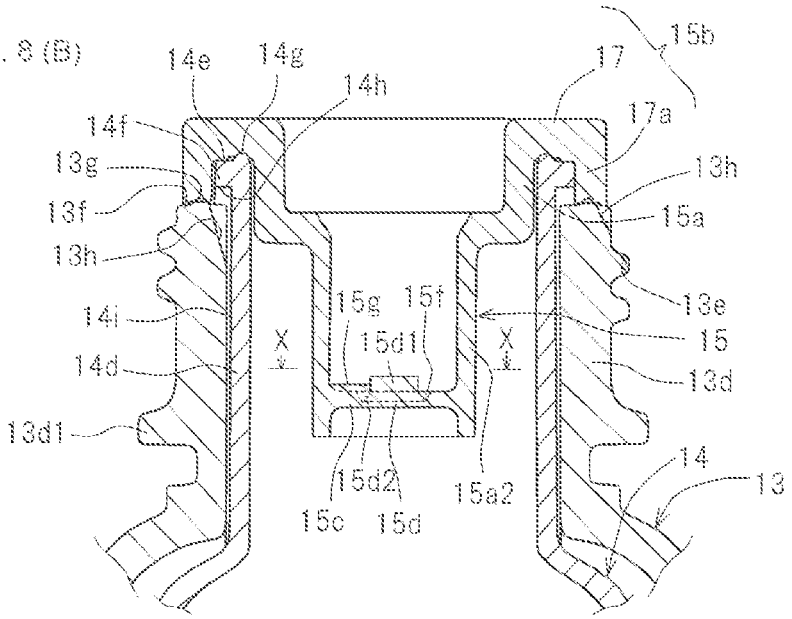

As shown in FIG. 8B, the plug 15 is provided with the bottomed cylindrical shaped seal part 15*a* to be inserted into the inside of the neck part 14*d* of the inner container 14 and the annular flange 15*b* continuing to the upper end of the seal part. The lower part of the seal part 15*a* is the fitting cylindrical part 15*a*2 which has a smaller diameter than the upper part. An openable seal part 15*d* provided with the pressure receiving part 15*d*1 which is made thicker as compared with that of the periphery, is provided at the bottom part of the seal part 15*a*, that is, the bottom part 15*c* of the fitting cylindrical part 15*a*2. Normally, the openable seal part 15*d* is a circular shape in plane view. However, other shapes such as rectangle shape, etc. can be employed. Further, in the embodiment of FIG. 8B, the upper surface of the openable seal part 15*d* is projected, but it may be convex shape in a cross-section by denting the bottom part.

Figure 10:
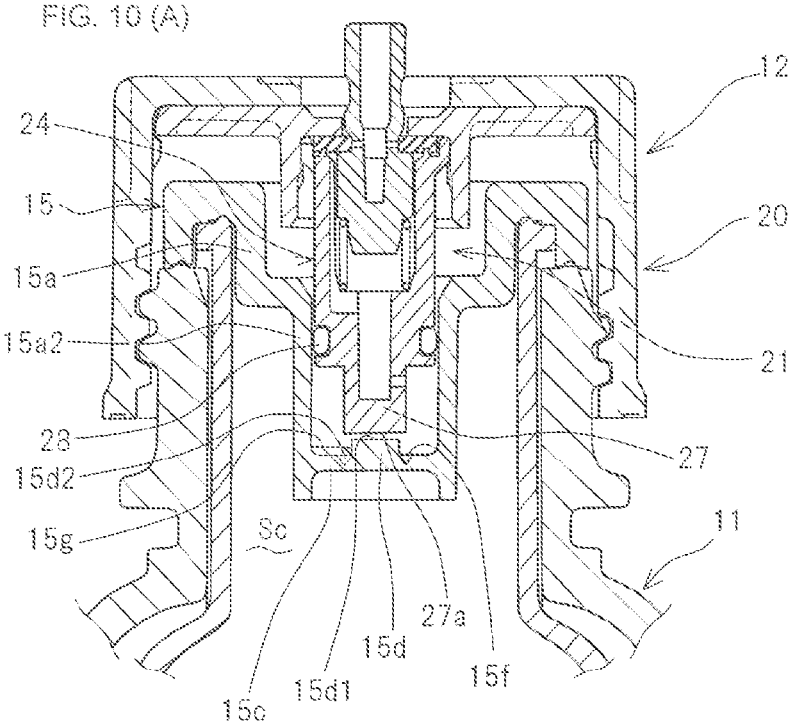
FIG. 10A is a main part cross-sectional view showing another embodiment of the discharge device of the present invention before opening.
FIG. 10B is a main part cross-sectional view showing another embodiment of the discharge device of the present invention after opening.
Figure 10:
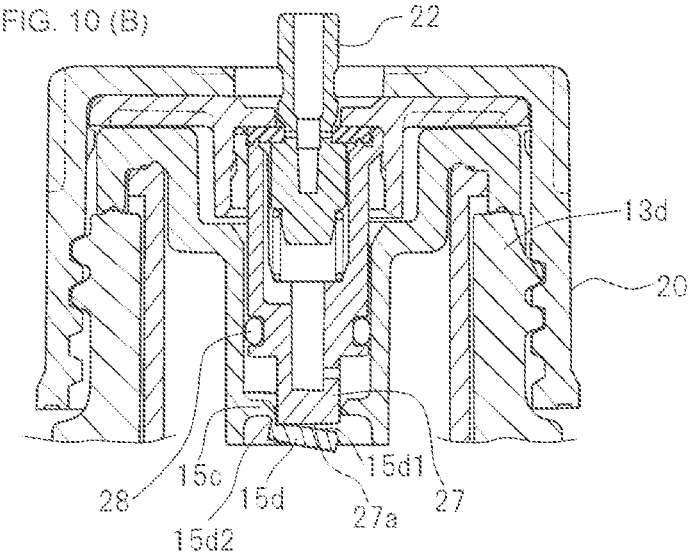

The periphery of the openable seal part 15*d* is surrounded by the weakened line 15*f* such as an annular groove, etc. except a part (continuous part) 15*d*2. The aforementioned pressure receiving part 15*d*1 is provided at the entire upper surface of the openable seal part 15*d*, and the weakened line 15*f* is formed at the upper surface of the bottom part 15*c* in a manner of surrounding the periphery of the pressure receiving part 15*d*1. The weakened line 15*f* is formed in, for example, a V-groove. At the continuous part 15*d*2 of the openable seal part 15*d*, the reinforcement part (reinforcing rib) 15*g* is provided in a manner of extending in the radial outward direction. The reinforcement part 15*g* is a member to maintain the connection of the openable seal part 15*d* with the bottom part 15*c* to prevent the openable seal part 15*d* from dropping off inside the container (see FIG. 10B) when the openable seal part 15*d* is broken along the weakened line 15*f*. The height of reinforcement part 15*g* is equal to or lower than the pressure receiving part 15*d*1 so as not to disturb the contact between the seal opening part 27 of the discharge member 12 and the pressure receiving part 15*d*1 of the openable seal part 15*d*. The seal part 15*a* or the openable seal part 15*d* may be partially hardened by cooling condition, etc. at the time of molding, so that stretching at the time of opening is suppressed, and it can be easily broken.

Figure 9:
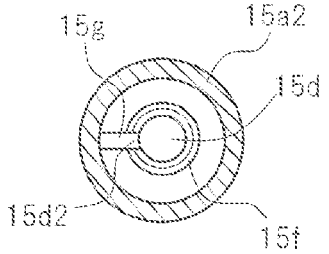
FIG. 9A is a X-X line cross-sectional view of FIG. 8B.
FIG. 9B is a plan cross-sectional view showing another embodiment of the same part of FIG. 9A.
FIG. 9C is a plan cross-sectional view showing another embodiment of the same part of FIG. 9A.
FIG. 9D is a plan cross-sectional view showing another embodiment of the same part of FIG. 9A.
Figure 9:
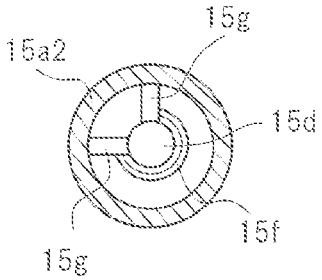
Figure 9:
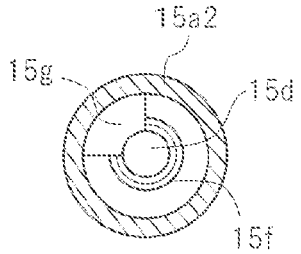
Figure 9:
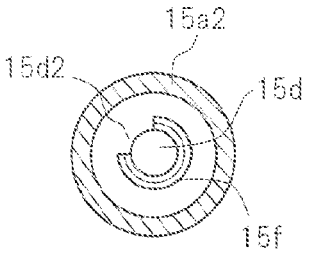

Though the reinforcement part 15*g* is one rib as shown in FIG. 9A, it can be two ribs spaced in a predetermined angle as shown in FIG. 9B. In this case, the weakened line 15*f* is not provided between the reinforcement parts 15*g*. By providing reinforcement part 15*g* at two sections, the connection of the openable seal part 15*d* can be surely maintained while assuring the wide space of the fluid channel at the time of opening. Further, as shown in FIG. 9C, by forming a fan-shaped reinforcement part 15*g*, the fluid channel can be assured at the time of opening, and the dropping off prevention of the openable seal part 15*d* can be further enhanced. Note that the reinforcement part may not be provided as shown in FIG. 9D, and simply, the weakened line 15*f* may not be formed in a predetermined angular range (90 degrees in FIG. 9D). The range where the weakened line 15*f* is not provided is the continuous part 15*d*2.

The discharge member 12 shown in FIG. 8A is provided with a cap (mounting part) 20 screwing with the male screw 13*e* of the neck part 13*d* of the outer container 13, a valve 21 held by the cap 20, and an operation button (operation part, actuator) 23 mounted to the stem 22 of the valve 21. The cap 20 is a bottomed cylindrical shape, and a female screw is formed at inner peripheral surface. At the lower side of the upper bottom 20*a*, a valve holder 18 which has a cylindrical valve holding part 18*a* for holding the upper part of the housing 24 of the valve 21 is assembled.

As shown in FIG. 8A, the valve holder 18 is provided with an annular rubber retainer 18*b* extending to the inside from the upper end of the valve holding part 18*a*, and a flange 18*c* expanding outward. And a hole 18*d* in which a stem 22 passes through is formed in the center of the rubber retainer 18*b*. An opening 20*b* in which the stem 22 passes through and the base part of the operation button 23 passes through is formed at the center of the upper bottom 20*a* of the cap 20.

The valve 21 has a known basic structure which is provided with the bottomed cylindrical shaped housing 24, the aforementioned stem 22 vertically movably stored inside the housing, a spring 25 energizing the stem 22 upward, and a stem rubber 26 provided between the upper end of the housing 24 and the rubber retainer 18*b* of the valve holder 18. Further, in this embodiment, the housing 24 is provided with an approximately columnar shaped seal opening part 27 projecting downward at the lower end of the housing, and a seal member 28 such as an O-ring, etc. is mounted at the lower part outer periphery of the housing 24. The bottom face (lower surface) 27*a* of the seal opening part 27 is set as the size with which the whole pressure receiving part 15*d*1 of the plug 15 can be abutted, and it is made flat in an abutting manner with the upper surface of the pressure receiving part 15*d*1. In the embodiment, the diameter of the seal opening part 27 is equal to or slightly larger than the pressure receiving part 15*d*1. Further, it is slightly smaller than the diameter of the range surrounded by the weakened line 15*f*. With this, at the time of breaking, the bottom face 27*a* of the seal opening part does not abut to the outer periphery part more outside than the weakened line of the bottom part 15*c*, so as not to disturb the pressing of the pressure receiving part 15*d*1. And after breaking, the bottom face 27*a* of the seal opening part 27 can be projected lower than the opening which is formed by unsealing, so that the passage of the concentrate C is easily secured.

The seal member 28 is a member to seal between the inner periphery surface of the fitting cylindrical part 15*a*2 of the plug 15 and the housing 24 at the time of unsealing and after unsealing. A deep hole 27*b* communicating with the inside of the housing 24 is formed in the center of the seal opening part 27, and a horizontal hole 27*c* communicating with the inside and the outside of the deep hole 27*b* is formed in the seal opening part 27. After opening, the horizontal hole 27*c* communicates between the inside of the housing 24 and the inside of the concentrate chamber Sc in the inner container 14, to serve as a passage for concentrate to be discharged. Since the horizontal hole 27*c* is not blocked by the broken openable seal part 15*d*, the stable discharging state is maintained. Instead of the horizontal hole 27*c*, a vertical hole reaching to the bottom face 27*a* at the center of the seal opening part 27 can be formed. Further, both the horizontal hole and the vertical hole may be formed.

As shown in FIG. 10A, the position in the height direction of the bottom face 27*a* of the seal opening part 27 is a position abutting to the pressure receiving part 15*d*1 when the cap 20 is screwed one to two times to the male screw of the outer container 13. Accordingly, at the time of shipping, the openable seal part 15*d* is not broken by loosely screwing the cap 20, and the discharge member 12 can be connected with the double pressurized container 11 with remaining in the sealing state.

At the time of distribution and sale, as shown in FIG. 10A, the cap 20 is mounted to the outer container 13, and the double pressurized container 11 and the discharge member 12 are loosely screwed and temporarily connected. In this state, the seal member 28 closely contacts with the inner surface of the fitting cylindrical part 15*a*2. With this, the user who purchased it can easily open by only turning and screwing the cap 20 few times.

When the user uses the purchased discharge device 10, first, the cap 20 is screwed onto the male screw 13*e* of the outer container. With this, whole cap 20 and the valve 21 are lowered, and the bottom face 27*a* of the seal opening part 27 pushes down the openable seal part 15*d*. Accordingly, the openable seal part 15*d* is broken along the weakened line 15*f*, the bottom part 15*c* of the fitting cylindrical part 15*a*2 is broken through, and the inside of the housing 24 is communicated with the concentrate chamber Sc which is the inside of the inner container 14 (see FIG. 10B).

Note that since the cap 20 is screwed to the outer container 13, the lowering amount of the valve 21 is small as compared to the operation amount of the cap. Accordingly, the bottom face 27*a* of the seal opening part 27 gradually presses the pressure receiving part 15*d*1 of the openable seal part 15*d*. Since the plug 15 is made of synthetic resin, when gradually pressing, the openable seal part 15*d* is easily extended and hardly broken by its extensibility. However, in this embodiment, since the openable seal part 15*d* is surrounded by the annular weakened line 15*f*, and the pressure receiving part 15*d*1 is projected, the stress concentration to the weakened line 15*f* is increased, and it can be smoothly broken. Further, since the bottom face 27*a* of the seal opening part 27 is formed flat, it is hardly deformed by the opening operation, and the discharge member can be repeatedly used.

The openable seal part 15*a* is provided with the thickened and approximately circular shaped pressure receiving part 15*d*1 at the upper part thereof on the central axis of the plug 15. And the openable seal part abuts to the circular shaped bottom face 27*a* of the seal opening part 27. Therefore, when it is pressed by the bottom face 27*a*, the openable seal part 15*d* is pushed straight, and the break progresses along the weakened line 15*f*. When beginning the break, the openable seal part 15*d* begins to lean while maintaining the connection at the reinforcement part 15*g*. Since the broken openable seal part 15*d* continues to the periphery (outer periphery part more outside than the weakened line 15*f*) at the continuous section 15*d*2, it is not dropped off and remains in the hanging state from the bottom part 15*c*. Note that since the continuous section extends due to the extensibility of the aforementioned synthetic resin, the tearing-off of the openable seal part 15*d* can be suppressed. Accordingly, the dropped-off openable seal part 15*d* does not disturb the discharge of the concentrate.

Figure 11:
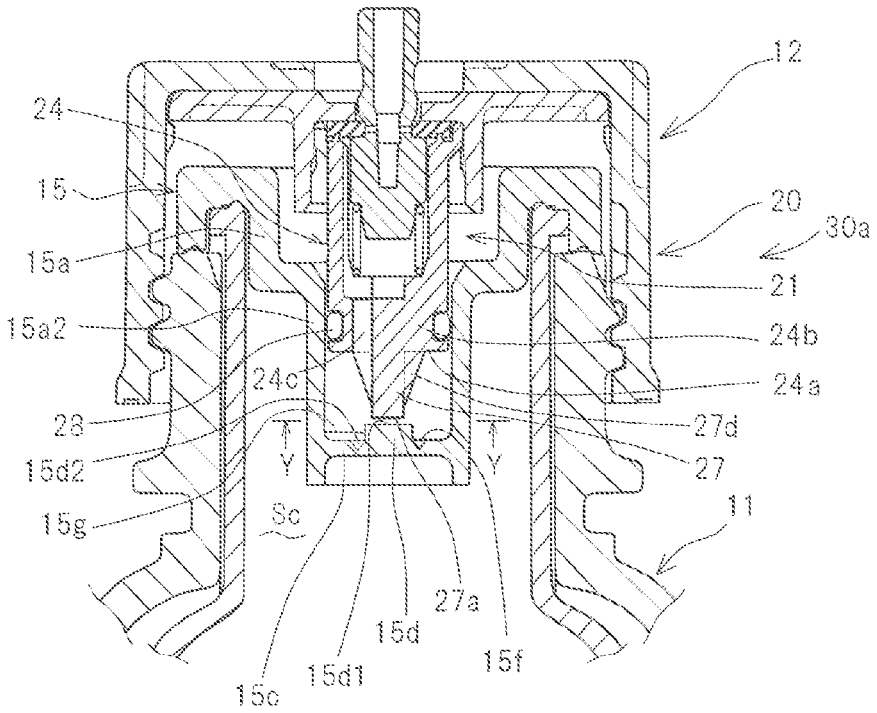
FIG. 11A is a cross-sectional view showing another embodiment of the discharge device of the present invention.
FIG. 11B is a main part cross-sectional view showing the discharge device after opening.
FIG. 11C is a Y-Y line cross-sectional view of FIG. 11A.
Figure 11:
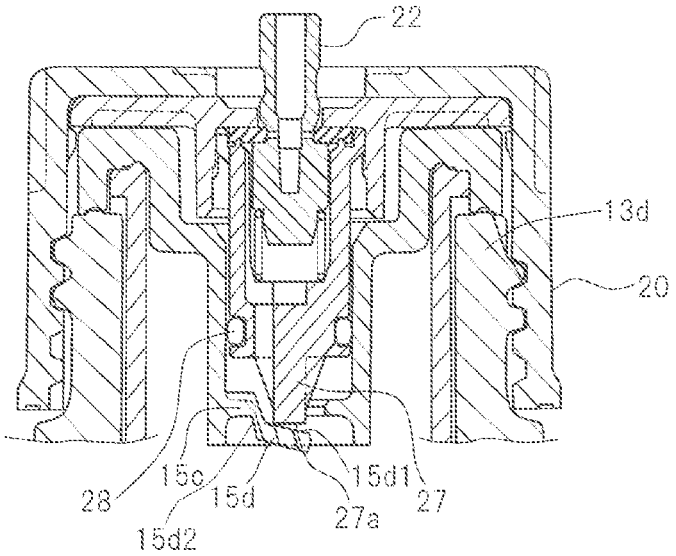
Figure 11:
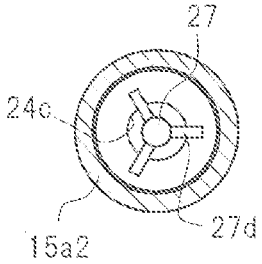

The discharge device 30*a* shown in FIG. 11A is practically the same as the discharge device 10 shown in FIGS. 8 to 10B other than the shape difference around the seal opening part 27 of the discharge member 12. Therefore, the same reference numerals are used for the same parts, and the descriptions thereof will be omitted. In the discharge device 30*a*, the seal opening part 27 provided at the lower part of the housing 24 has smaller diameter than the openable seal part 15*d* of the plug 15. A plurality of reinforcing plates 27*d* are radially provided between the columnar shaped seal opening part 27 and the lower surface 24*a* of the housing 24 (see FIG. 11C). The number of the reinforcing plates 27*d* is preferably three to five.

The reinforcing plates 27*d* do not reach the lower end of the seal opening part 27, and the vicinity of the lower end of the seal opening part 27 is to remain in the columnar shape, and the bottom face 27*a* is flat. The passage communicating between the inside of the housing 24 and the concentrate chamber Sc inside the inner container 14 is formed as a vertical hole 24*c* which vertically penetrates the bottom plate 24*b* of the housing 24. The vertical hole 24*c* is formed at a space between the reinforcing plates 27*d* which are adjacent to each other, and the number of vertical holes is equal to the number of the reinforcing plates 27*d* (see FIG. 11C). However, it may be fewer than that such as one to two, etc. The shape of the vertical hole 24*c* in a plane view can be an approximately fan shape.

In this discharge device 30*a*, when the cap 20 is screwed to the neck part 13*d* of the outer container 13, the bottom face 27*a* of the seal opening part 27 presses the pressure receiving part 15*d*1 downwardly as shown in FIG. 11B, and it breaks the openable seal part 15*d* along the weakened line 15*f*. The broken openable seal part 15*d* is hanged down from the bottom part 15*c* in the connecting state with the continuous section 15*d*2. At this time, the lower part of the seal opening part 27 is inserted into the through-hole after the openable seal part 15*d* is opened. But the diameter of the seal opening part 27 is smaller than the diameter of the openable seal part 15*d*, so that there is a space between the seal opening part 27 and the through-hole, and the concentrate C can pass through it. Further, even when the seal opening part 27 is inserted into the hole in which the broken openable seal part 15*d* is opened, the multiple reinforcing plates 27*d* prevent blockage of the concentrate C passage.

Figure 12:
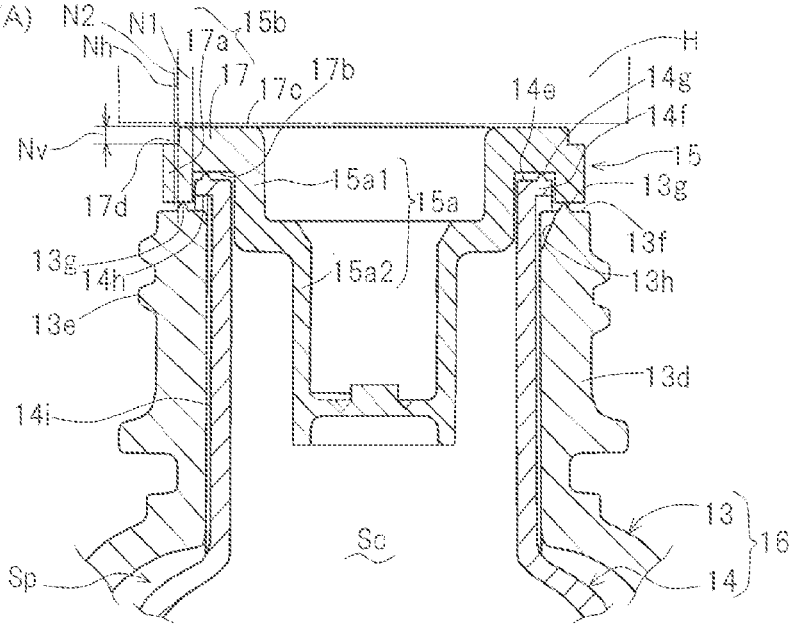
FIG. 12A is a cross-sectional view showing the state in which another embodiment of a plug covers the container body of FIG. 1B.
FIG. 12B is a cross-sectional view showing the state after the plug is welded to the container body.
Figure 12:
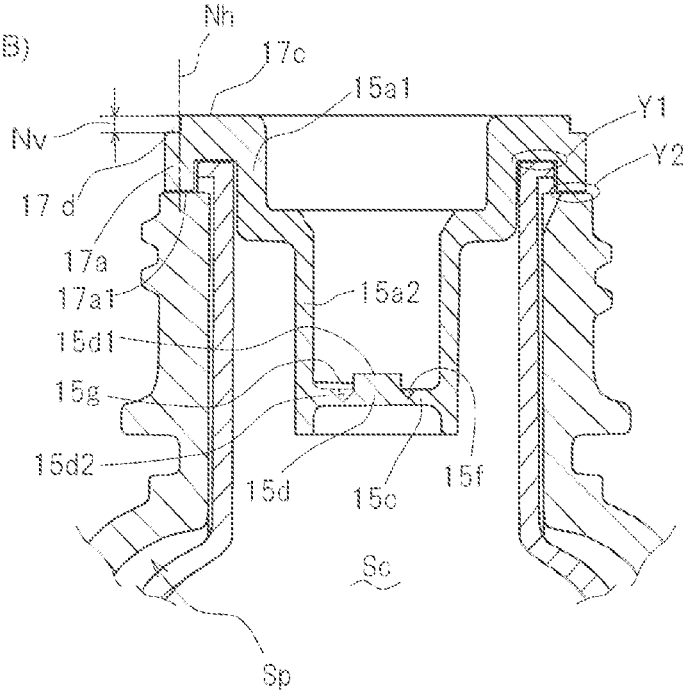

FIG. 12A shows the state in which the plug 15 is mounted on the container body 16. The welding of the plug 15 is not done yet. At this time, the concentrate C is charged in the concentrate chamber Sc, but the pressurizing agent P is not charged in the pressurizing agent chamber Sp. As shown in FIG. 12A, at the upper end surface 13*f* of the neck part 13*d* of the outer container 13, an annular projection 13*g* is formed, so that the contact pressure with the plug 15 is increased to facilitate the dissolving and a welding part to integrate with the plug 15 is formed, at the time of the ultrasonic wave welding. The annular projection 13*g* is an approximately triangular shape in cross section, and particularly, it is an isosceles triangle or an equilateral triangle. In this embodiment, the annular projection 13*g* is provided at approximately center in the thickness range of the neck part 13*d*. The annular projection can be provided at the plug 15 side so that the upper end surface 13*f* of the neck part 13*d* is flat. A plurality of the inclined parts 13*h* is provided at the inner side of the upper end surface 13*f*, and it is used as a space to store the resin piece (welding waste), which is made by cooling the melted resin at the time of the ultrasonic wave welding, so that it is not projected.

As shown in FIG. 12A, the upper part of the neck part 14*d* of the inner container 14 is projected from the upper end surface 13*f* of the outer container 13, and at the projected part, a flange 14*f* engaging with the upper end surface 13*f* of the outer container 13 is formed. The thickness of the flange 14*f* (dimension of the radial direction) is approximately ⅓ to ½ of the thickness of the neck part 13*d* of the outer container 13. Accordingly, when the flange 14*f* is engaged on the upper end surface 13*f* of the neck part 13*d* of the outer container 13, the upper end surface 13*f* of the neck part 13*d* of the outer container 13 is left uncovered at the outside part. The annular projection 13*g* of the upper end of the outer container 13 is provided at the outside part. Also, at the upper end surface 14*e* of the neck part 14*d* of the inner container 14, an annular projection 14*g* is formed to provide a welding part with the plug 15 by increasing the contact pressure with the plug 15 at the time of the ultrasonic wave welding. In this embodiment, this annular projection 14*g* is also an approximately triangular shape in cross section, and particularly, it is an isosceles triangle or an equilateral triangle.

At the lower surface of the flange 14*f* of the inner container 14, a horizontal groove 14*h* for charging pressurizing agent which extends in the radial direction is formed at four sections at an equal interval. Further, at the outer periphery surface of the neck part 14*d* of the inner container 14, a vertical groove 14*i* communicating with the horizontal groove 14*h* is formed. The vertical groove 14*i* is extended to the upper end of the shoulder part 14*c* from the horizontal groove 14*h*, and with this, the pressurizing agent P is easily charged inside the pressurizing agent chamber Sp.

Both the outer container 13 and the inner container 14 are made of synthetic resins, and particularly, made of thermoplastic resin such as polyethylene terephthalate, polyethylene naphthalate, polyethylene, polypropylene, etc. With these materials, for example, it can be manufactured by inserting a preform for the inner container into a preform for the outer container, and blow-molding the parts lower than the lower ends of the neck parts 13*d*, 14*d* at the same time. Specifically, it is preferable to use an injection blow molding method in which a predetermined shaped preform is provided by injection molding and blow molding.

The plug 15 is provided with the bottomed cylindrical shaped seal part 15*a* inserted inside the neck part 14*d* of the inner container 14, and the annular flange 15*b* which continues to the upper end of the seal part. The upper part of the seal part 15*a* is the inner cylindrical part 15*a*1 fitting to the inner surface of the neck part 14*d* of the inner container 14 with remaining a gap, and the lower part is the valve housing part (fitting cylindrical part) 15*a*2 to store the valve 12 of the discharge member detachably in the fitting state via a seal material (reference numeral 28 of FIG. 13). The valve housing part 15*a*2 has a smaller diameter than the inner cylindrical part 15*al*.

The flange 15*b* of the plug 15 is provided with the flat part 17 expanding radially outward from the upper end of the seal part 15*a*, and the outer cylindrical part 17*a* extending downward from the outer edge of the flat part 17. The lower surface 17*b* of the flat part 17 is a part which forms a welding part (reference numeral Y1 of FIG. 12B) and seals by abutting to the upper end surface 14*e* of the neck part 14*d* of the inner container 14, particularly, to the annular projection 14*g*. The lower surface 17*a*1 of the outer cylindrical part 17*a* is a part which forms a welding part (reference numeral Y2 of FIG. 12B) and seals by abutting to the upper end surface 13*f* of the neck part 13*d* of the outer container 13, particularly, to the annular projection 13*g*. The top surface 17*c* (top surface of the flange 15*b*) of the flat part 17 is an abutting surface with the horn oscillating the ultrasonic vibration of the ultrasonic wave welding machine. Accordingly, it is [the outer diameter of the abutting surface (top surface 17*c* of the flat part) with the horn<the outer diameter of the outer cylindrical part 17*a*1.

The characteristic of the pressurized container 11 is a point in which the annular outer periphery cut portion 17*d* is formed at the outer periphery edge of the flat part 17. In this embodiment, the outer periphery cut portion 17*d* is an annular step part in the rectangular cross-section. The dimension Nv in the height direction of the outer periphery cut portion 17*d* is approximately 0.1 to 0.4 times of the thickness of the outer cylindrical part 17*a*. It is preferable that the position Nh in the horizontal direction is positioned more outward than the position N1 of the inner surface of the outer cylindrical part 17*a*, and is positioned more inward than the position N2 which is more slightly outward than the annular projection 13*g* of the outer container 13, and particularly, almost the same as the annular projection 13*g* of the outer container 13 (width of the base part of the approximately triangular shaped annular projection 13*g*). Accordingly, it is [the inner diameter of the outer cylindrical part 17*a*<the outer diameter of the top surface 17*c* of the flat part≈the annular projection 13*g* of the outer container). Note that the outer diameter of the outer cylindrical part 17*a* may be almost the same as the diameter of the outer container 13 (except the male screw 13*e*) or may be slightly smaller.

The ultrasonic wave welding is performed in the state in which the concentrate chamber Sc inside the inner container 14 is filled with the concentrate C, the opening of the container body 16 is covered with the plug 15, the pressurizing agent chamber Sp between the outer container 13 and the inner container 14 is filled with the pressurizing agent P, and the pressurized state is maintained. Since the outer periphery cut portion 17*d* is provided at the plug 15, when the horn H abuts to and presses down the top surface 17*c* of the flat part 17, and the vibration energy is applied downward from the top surface 17*c*, the vibration energy is hardly expanded outwardly, and the vibration energy flowing to the outer periphery side of the outer cylindrical part 17*a* is reduced. Therefore, the annular projection 13*g* of the outer container is easily melted and welded, and the projection of the resin melted in the welding part Y2 between the outer container 13 and the plug 15 is reduced, and it can be welded without interfered by the solidified welding waste (see FIG. 12B).

After welding, as shown in FIG. 12B, the lower surface of the outer cylindrical part 17*a* is welded to the upper end surface 15*f* of the outer container 13, and it becomes the pressurized product 11*a*. And, as described above, the melted resin is not projected outside from the gap between the outer container and the plug. Further, since the welding is continuously and sufficiently performed, it prevents the pressurizing agent P from leaking from the pressurizing agent chamber Sp for a long period of time. The resin which is projected inside at the time of welding is stored in the inclined part (inclined groove) 13*h*, and it does not flow into the pressurizing agent chamber Sp. On the other hand, the lower surface 17*b* of the flat part 17 is welded to the upper end surface 14*e* of the neck part 14*d* of the inner container 14.

Note that at the bottom part of the seal part 15*a*, that is, at the bottom part 15*c* of the inner cylindrical part 15*al*, the openable seal part 15*d* having the pressure receiving part 15*d*1 made thicker as compare with that of the periphery is formed. The periphery of the openable seal part 15*d* is surrounded by the weakened line 15*f* such as an annular groove, etc. except a part (continuous section) 15*d*2. The pressure receiving part 15*d*1 is provided on the whole upper surface of the openable seal part 15*d*, and the weakened line 15*f* is formed on the upper surface of the bottom part 15*c* in the manner of surrounding the periphery of the pressure receiving part 15*d*1. The weakened line 15 is formed in, for example, a V-groove. At the continuous section 15*d*2 of the openable seal part 15*d*, the reinforcement part (reinforcing rib) 15*g* is provided in a manner of extending in the radial outward direction.

Figure 13:
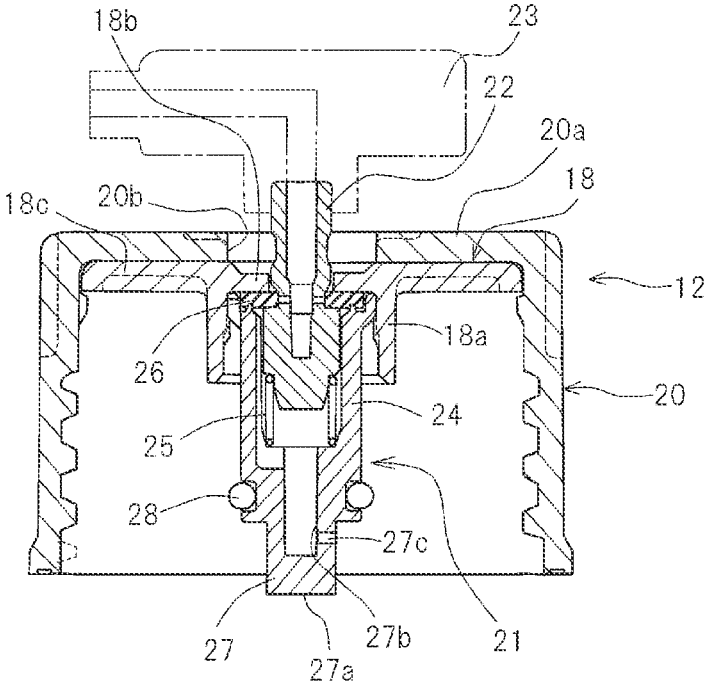
FIG. 13 is a cross-sectional view showing another embodiment of the discharge member of the present invention.

The discharge member 12 shown in FIG. 13 is provided with the cap (mounting part) 20 screwed to the male screw 13*e* of the neck part 13*d* of the outer container 13, the valve held by the cap 20, and the operation button (operation part, actuator) 23 mounted to the stem 22 of the valve 21. The discharge member 12 is mounted to the discharge product 11*a* of FIG. 2B or the discharge product 31*a* of FIG. 4B and is used for discharging the contents. The cap 20 of FIG. 13 is a bottomed cylindrical shape, and a female screw is formed at the inner periphery surface. At the lower side of the upper bottom 20*a*, the valve holder 18 provided with the cylindrical valve holding part 18*a* which holds the upper part of the housing 24 of the valve 21 is attached.

The valve 21 has a known basic structure which is provided with the bottomed cylindrical shaped housing 24, the aforementioned stem 22 vertically movably stored inside the housing, the spring 25 energizing the stem 22 upwardly, and the stem rubber 26 provided between the upper end of the housing 24 and the rubber retainer 18*b* of the valve holder 18. Further, in this embodiment, the approximately columnar shaped seal opening part 27 projecting downwardly at the lower end of the housing 24 is provided, and a seal member 28 such as an O-ring, etc. is attached at the lower part outer periphery of the housing 24.

The seal member 28 is used for sealing between the inner periphery surface of the valve housing part (fitting cylindrical part) 15*a*2 of the plug 15 and the housing 24 at the time of opening and after the opening. At the center of the seal opening part 27, a deep hole 27*b* communicating with the inside of the housing 24 is formed, and a horizontal hole 27*c* communicating between the inside and the outside of the deep hole 27*b* is formed in the seal opening part 27. After opening, the horizontal hole 27*c* communicates between the inside of the housing 24 and the concentrate chamber Sc inside the inner container 14, and it serves as a passage of the concentrate which is discharged. Since the horizontal hole 27*c* is not blocked by the broken openable seal part, a stable discharging state can be maintained. Instead of the horizontal hole 27*c*, a vertical hole reaching to the bottom face 27*a* can be formed at the center of the seal opening part 27. Further, both the horizontal hole and the vertical hole may be formed.

The position in the height direction of the bottom face 27*a* of the seal opening part 27 is a position which abuts to the pressure receiving part 15*d*1 (see FIG. 12B) when the cap 20 is screwed approximately one to two times to the male screw of the outer container 13. Accordingly, at the time of shipping and distribution, the openable seal part 15*d* is not broken by loosely screwing the cap 20, and while maintaining the sealing state, the discharge member 12 and the pressurized container 11 can be temporality connected. Therefore, the user who purchases it can easily open by screwing the cap 20 few times.

When the user uses the discharge device (reference numeral 10 of FIG. 1 or reference numeral 30 of FIG. 4C) purchased by the user, first, the cap 20 is screwed into the male screw 13*e* of the outer container. With this, the whole cap 20 and the valve 21 are lowered, and the bottom face 27*a* of the seal opening part 27 pushes down the openable seal part 15*d*. Accordingly, the openable seal part 15*d* is broken along the weakened line 15*f*, the bottom part 15*c* of the valve housing part 15*a*2 is broken through, and the concentrate chamber Sc communicates with the inside of the housing 24. After that, by pushing down the operation button 23, the concentrate C can be discharged.

Figure 14:
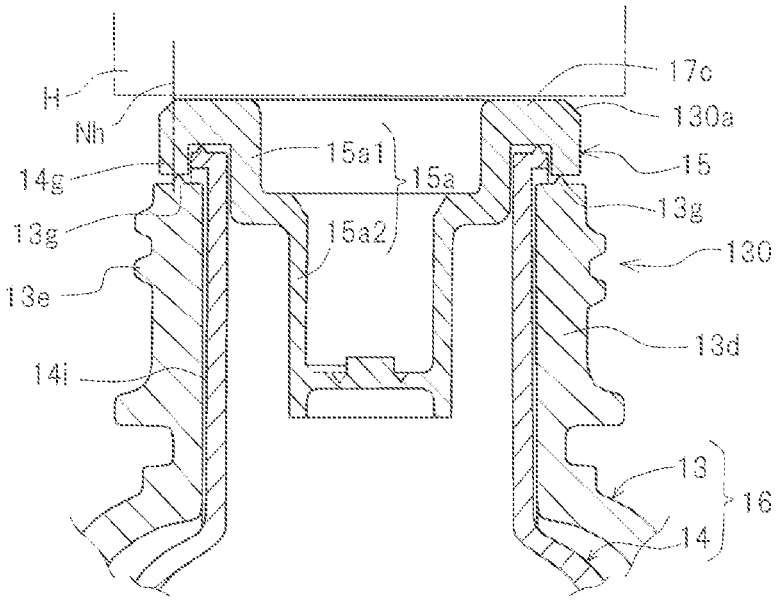
FIG. 14A is a cross-sectional view showing the state in which the plug related to another embodiment of the pressurized container covers the container body.
FIG. 14B is a cross-sectional view after the plug is welded to the container body.
Figure 14:
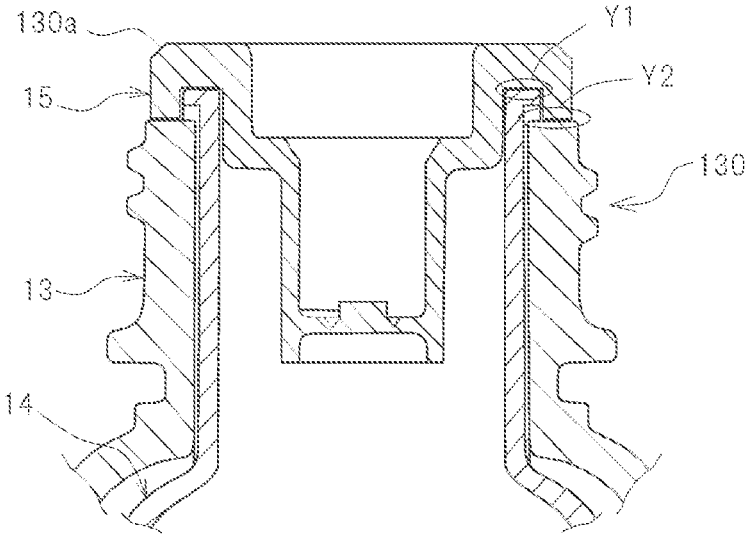

FIG. 14A shows another embodiment of the pressurized container. In this pressurized container 130, the annular outer periphery cut portion 130*a* which is formed around the top surface 17*c* of the plug 15 is not a rectangular in cross-section, but it is an inclined surface (approximately conical surface). The upper end of the inclined surface is positioned at the approximately same position as the outside of the annular projection 13*g* of the upper end surface of the outer container 13 in a plane view. In another points, they are the same as the pressurized container 11 of FIG. 12A, and therefore, the same reference numerals are used and the descriptions thereof will be omitted.

In this pressurized container 30, when abutting the horn H to the top surface of the plug 15 and applying the vibration energy while being pressurized, the vibration energy hardly expands outwardly. Therefore, as shown in FIG. 14B, projection of the melted resin projected outside at the welding part Y2 between the outer container 13 and the plug 15 is reduced, so that it can be welded without interruption by the solidified welding waste. Further, the appearance becomes excellent.

Figure 15:
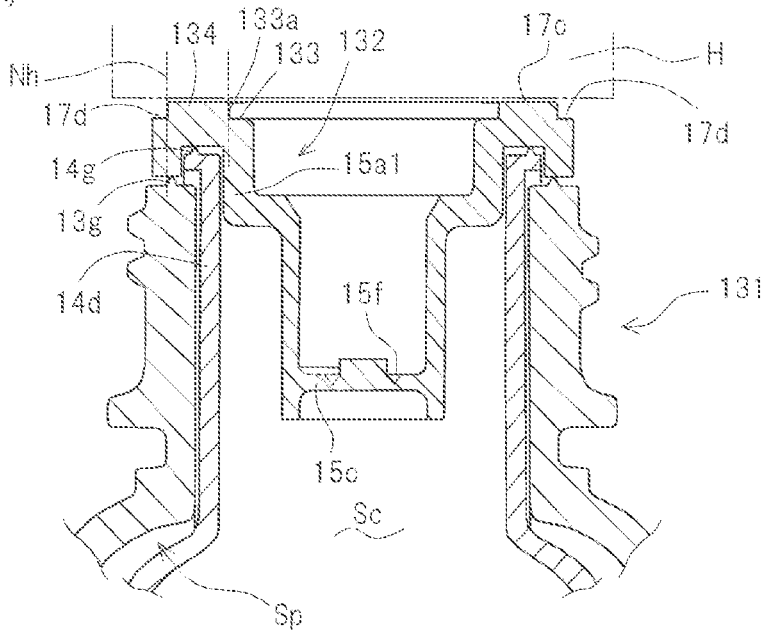
FIG. 15A is a whole cross-sectional view showing the state in which the plug related to yet another embodiment of the pressurized container covers the container body.
FIG. 15B is a main cross-sectional view showing the state after the plug is welded to the container body.
Figure 15:
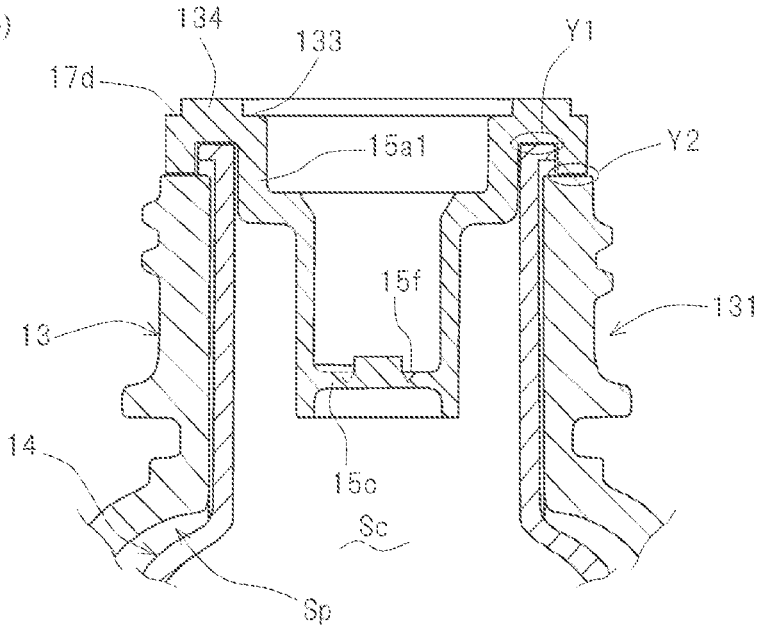

FIG. 15A shows still another embodiment of the pressurized container. In the pressurized container 131, other than the outer periphery edge of the top surface 17*c* of the plug 15, at the corner of the inside of the recess 132, an annular inner periphery cut portion 133 which is a rectangular shape in cross-section is also formed. Note that it can be seen that the annular projection part 134 which is a rectangular shape in cross-section is formed at the top surface of the plug 15. The position of the standing wall 133*a* of the inner periphery cut portion 133 is positioned at the approximately same position as the inner surface of the neck part 14*d* of the inner container 14 in a plane view. Other points are the same as the pressurized container 11 of FIG. 2B or the double container 50 of FIG. 4A, so that the same reference numerals are used and the descriptions will be omitted. The outer periphery cut portion 17*d*, the inner periphery cut portion 133, or the both may be the annular inclined surface such as FIG. 14A.

In this pressurized container 131, when abutting the horn H to the top surface 17*c* of the plug 15 and applying the vibration energy, the vibration energy does not expand to the outside or the inside and is transmitted almost straight downward. Therefore, as shown in FIG. 15B, the projection of the melted resin projected outside and inside at the welding part Y between the outer container 13 and the plug 15 is reduced, and it can be welded without the interruption by the solidified welding waste. Further, the appearance becomes excellent. Further, the vibration energy hardly flows to the bottom part 15*c* from the inner cylindrical part 15*a*1 by the inner periphery cut portion 133, and it can prevent the weakened line 15*f*, which is provided for opening the openable seal part 15*d* by the user, from melting.

Figure 16:
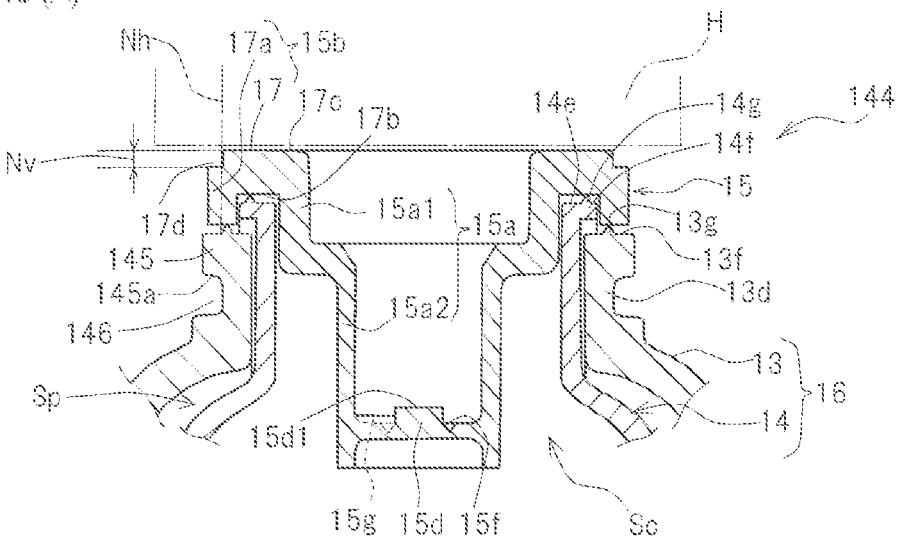
FIG. 16A is a cross-sectional view showing another embodiment of the pressurized container of the present invention before the plug is welded.
FIG. 16B is a cross-sectional view showing the pressurized container, after the plug is welded, together with the discharge member.
Figure 16:
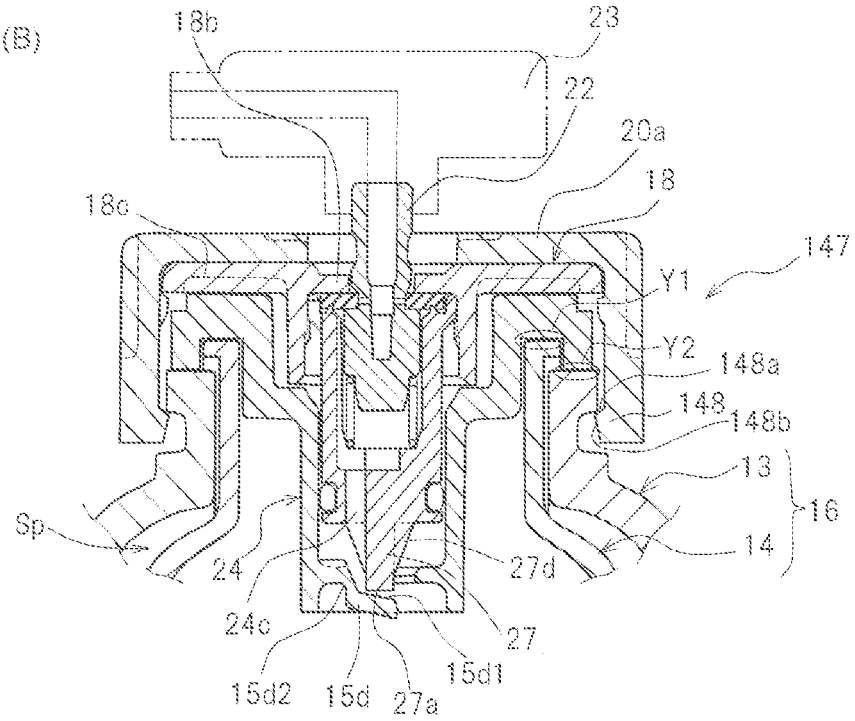

In the pressurized container 144 shown in FIG. 16A, the neck part 13*d* of the outer container 13 is shortened and an annular locking protrusion 145 is provided instead of a male screw. Note that it can be seen that the annular locking groove 146 is provided. The lower surface 145*a* of the locking protrusion 145 is inclined slightly upward toward outside. Other points are the same as the pressurized container of FIG. 12A.

With respect to the pressurized container 144 of FIG. 16A, the discharge member 147 shown in FIG. 16B is mounted. The discharge member 147 shown in FIG. 16B is not provided with female screw on the inner surface of the cap 20, and is provided with an annular locking crow 148 which performs a snap engagement to a locking protrusion 145 at the outer periphery of the neck part 13*d* of the outer container 13. The upper surface 148*a* of the locking crow 148 is inclined slightly downward toward the inside so as to correspond to the lower surface 145*a* of the locking protrusion 145. Further, the inner surface 148*b* of the locking crow 148 is formed as a tapered surface which expands downwardly so as to be pressurized inwardly when it is lowered and abuts to the upper end of the locking protrusion 145 of the outer container 13. Accordingly, when the discharge member 147 is mounted on the pressurized container 144 and is pressed downwardly, the locking crow 148 is elastically slightly expanded and returned so as to be engaged with the locking protrusion 145. At the position of the locking crow 148 and slightly higher than that, a plurality of slits may be formed, and therefore, the deformation of the locking crow 148 is facilitated.

Note that in this embodiment, a small diameter columnar shaped seal opening part 27 is provided at the lower end of the housing 24 of the discharge member 147, and a plurality of the reinforcing plates 27*d* is radially provided at a space between the seal opening part 27 and the housing 24. The number of the reinforcing plates 27*d* is preferably three to five. The reinforcing plates 27*d* are not reached to the lower end of the seal opening part 27, and the vicinity of the lower end of the seal opening part 27 is still the columnar shape, and the bottom face 27*a* is flat. The passage communicating between the inside of the housing 24 and the concentrate chamber Sc inside the inner container 14 is formed as a vertical hole 24*c* which vertically penetrates the bottom plate 24*b* of the housing 24. The vertical hole 24*c* is formed at a space between the reinforcing plates 27*d* which are adjacent to each other. Other points are practically the same as the discharge member 12 of FIG. 13, and the same reference numerals are used to the corresponding parts and the descriptions are omitted.

When the discharge member 147 is mounted to the pressurized container 144 as described above, the bottom face 27*a* of the seal opening part 27 presses down the pressure receiving part 15*d*1 as shown in FIG. 16B, and breaks the openable seal part 15*d* along the weakened line 15*f*. The broken openable seal part 15*d* hangs down from the bottom part 15*c* in the connecting state with the continuous section 15*d*2. At this time, the lower part of the seal opening part 27 is inserted into the through-hole after the openable seal part 15*d* is opened, but the diameter of the seal opening part 27 is smaller than that of the openable seal part 15*d*, so that there is a space between the seal opening part 27 and the through-hole, and the concentrate C can pass through it. Further, although the seal opening part 27 is inserted into the through-hole of the broken openable seal part 15*d*, by the plurality of reinforcing plates 27*d*, it prevents the passage of the concentrate from closing.

Figure 17:
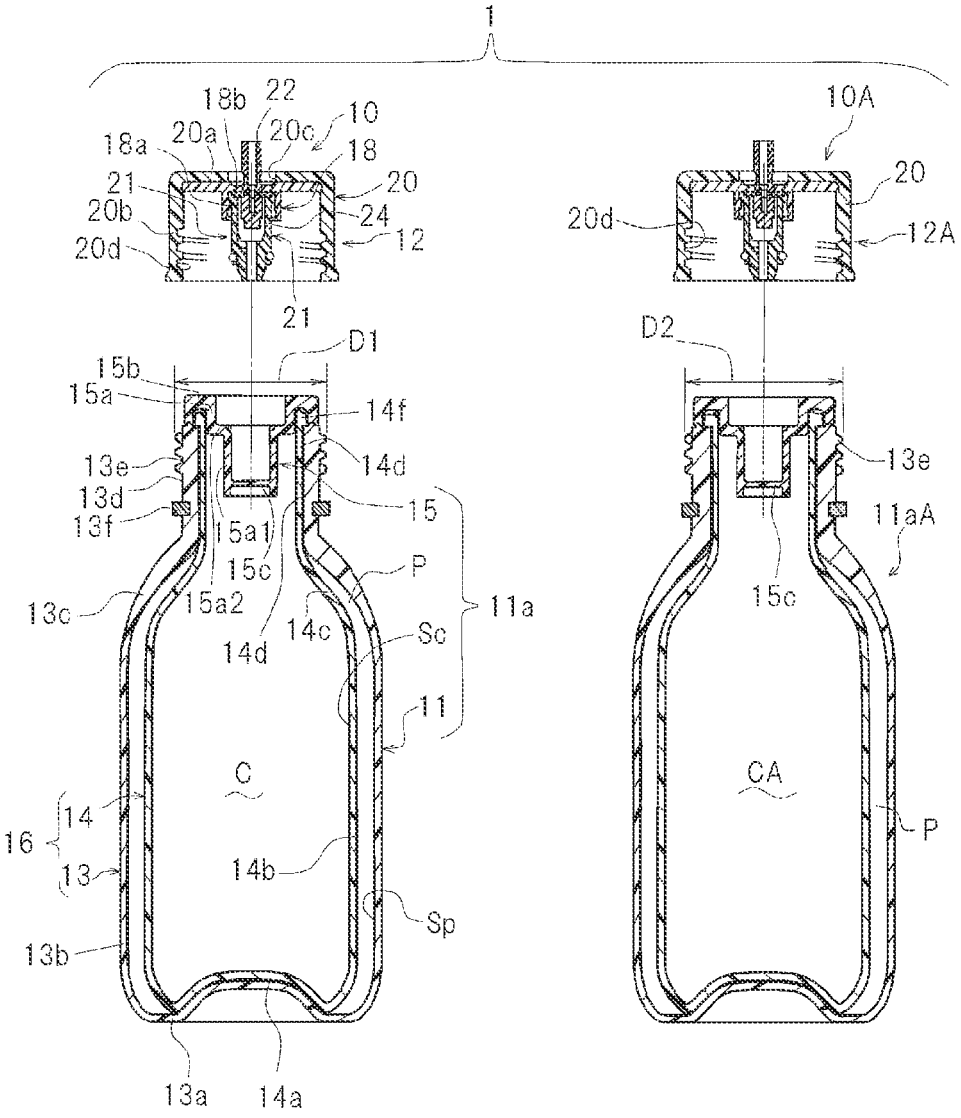
FIG. 17 is a cross-sectional view showing one embodiment of a discharge device system of the present invention, in which the uses are different in the right side and the left side discharge devices.

The discharge device 10 shown in the left side of FIG. 17 is provided with the double pressurized container 11, the discharge member 12, and the concentrate (contents) C and the pressurizing agent P charged in the double pressurized container 11. A double pressurized container 11 filled with concentrate C and the pressurizing agent P is a discharge product 11*a*. The pressurized product 11*a* and the discharge member 12 are sold as a set of products before assembled (see FIG. 16), or in the unopened state with half assembled (see FIG. 19). The pressurized product 11*a* is soled with the discharge member 12, and also, it is sold individually as a refill. Also, the discharge member 12 may be sold individually.

The double pressurized container 11 is provided with the outer container 13, the inner container 14 having flexibility and stored inside the outer container, and the plug (lid) 15 sealing the outer container 13 and the inner container 14. The valve or the pump is not provided. The assembled outer container 13 and inner container 14 is a container body 16 (see FIG. 6A). The inside of the inner container 14 is a concentrate chamber Sc for charging the concentrate C, and a space between the outer container 13 and the inner container 14 is a pressurizing agent chamber Sp for charging the pressurizing agent P. They are sealed by the plug 15.

That is, in this embodiment, the concentrate C and the pressurizing agent P are separately stored in the double pressurized container 11, and only the concentrate C is discharged. With this, it can prevent the pressurizing agent P such as compressed gas from leaking. However, the mixture of the pressurizing agent P and the concentrate C may be charged in the container body 16 without using the inner container 14. In this case, the mixture becomes the contents.

In the discharge device 10A shown in the right side of FIG. 17, the concentrate CA charged in the inner container 14 is different from the concentrate C of the discharge device 10 of the left side. For example, the inner container 14 of the discharge device 10 of the left side is filled with the concentrate C for a human body such as hair care products, and the inner container 14 of the discharge device 10A of the right side is filled with the concentrate CA for a non-human body such as insecticide. And, in the discharge device 10A of the right side, the neck part 13*d* of the outer container 13 is made thicker than the discharge device 10 of the left side, and the diameter D2 of the male screw 13*e* is larger than the diameter D1 of the male screw 13*e* of the discharge device 10 of the left side. Further, the diameter of the female screw 20*d* of the cap 20 of the discharge device 10A of the right side is also larger than the diameter of the female screw 20*d* of the cap 20 of the discharge device 10 of the left side. And, the discharge device system 1 is configured by the whole combining the group of the discharge device 10 of the left side and the group of the discharge device 10A of the right side. Note that the right and left discharge devices 10, 10A are practically the same except the aforementioned differences, and hereinafter, the discharge device 10 of the left side will be basically described.

The outer container 13 is provided with the bottom part 13*a*, the cylindrical body part 13*b*, the shoulder part 13*c*, and the cylindrical neck part 13*d*. At the outer periphery of the neck part 13*d*, the male screw 13*e* is formed. Further, at the lower part of the neck part 13*d*, an identification ring 13*d*2 presenting a predetermined color for identifying a type of the concentrate C is mounted. The identification ring 13*d*2 is arranged to be used as a support part in order to hang the container in the charging step, etc. The identification ring 13*d*2 and the cap 20 are presented in the same color, and in a different group, it is presented in a different color so as to be easily identified. For example, when the discharge device 10 of the left side is presented in blue color, and the discharge device 10A of the right side is presented in yellow color, the user can be urged so as to assemble with the discharge member which is used for discharging the same concentrate, and therefore, the erroneous use can be prevented.

The inner container 14 is similar to the outer container 13 and is provided with a bottom part 14*a*, a body part 14*b*, a shoulder part 14*c*, and a neck part 14*d*. The outer surface of the neck part 14*d* of the inner container 14 has a small gap between it and the inner surface of the neck part 13*d* of the outer container 13. The inner surface of the neck part 14*d* of the inner container 14 is smooth cylindrical surface. The flange 14*f* is provided at the upper end of the inner container 14, and the flange 14*f* is engaged with the upper end of the neck part 13*d* of the outer container 13 (see FIG. 18C).

Both the outer container 13 and the inner container 14 are made of synthetic resins, and specifically, made of thermoplastic resin such as polyethylene terephthalate, polyethylene naphthalate, polyethylene, polypropylene, etc. With those containers, it is preferable to perform an injection blow molding method in which, for example, a preform for the inner container is inserted into a preform for the outer container which are respectively made by an injection molding, and those parts lower than the lower ends of the neck parts 13*d*, 14*d* are blow-molded at the same time.

Figure 18:
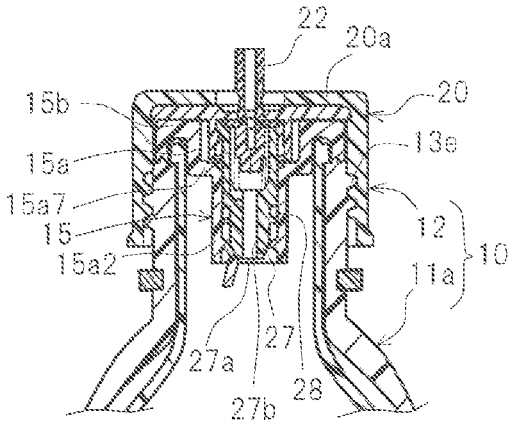
FIG. 18A is a main part cross-sectional view showing the state in which the pressurized product and the discharge member are correctly assembled.
FIG. 18B is a main part cross-sectional view showing the state in which the pressurized product and the discharge member are correctly assembled.
FIG. 18C is a main part cross-sectional view showing the state in which the pressurized product and the discharge member are incorrectly assembled.
FIG. 18D is a main part cross-sectional view showing the state in which the pressurized product and the discharge member are incorrectly assembled.
Figure 18:
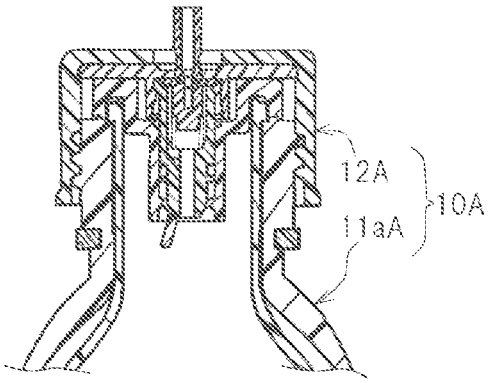
Figure 18:
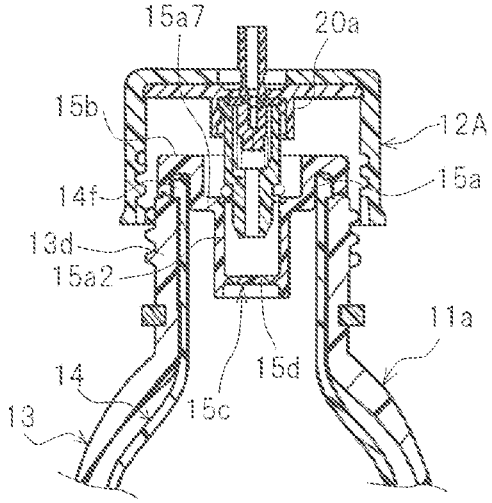
Figure 18:
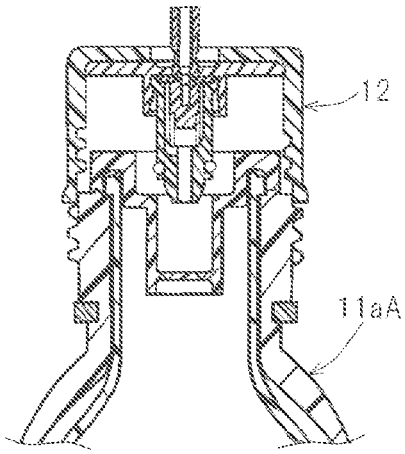

The plug 15 is provided with a bottomed cylindrical shaped seal part 15*a* inserted to the inside of the neck part 14*d* of the inner container 14, and an annular flange 15*b* continuing to the upper end of the seal part (see FIG. 18C). The lower part of the seal part 15*a* is formed as the fitting cylindrical part 15*a*2 in which the diameter is smaller than the upper part. The upper part is connected with the lower part through an approximately horizontal step part 15*a*7. The inner diameter and the depth to the step part (connection part) 15*a*7 are set as a dimension in which the valve holding part 18*a* can be stored when the discharge member 12 is mounted to the pressurized product 11*a*. At the center of the bottom part 15*c* of the fitting cylindrical part 15*a*2, the openable seal part 15*d* which is made thinner as compare with that of the periphery, or which is surrounded by the weakened line (see reference numeral 15*f* of FIG. 3) is provided.

The discharge member 12 is provided with a cap (mounting part) 20 screwed with the male screw 13*e* of the neck part 13*d* of the outer container 13, a valve holder 18 mounted to the lower surface of the upper bottom 20*a* of the cap 20, and a valve 21 held by the valve holder 18. As the discharge member 12, any member to operate a valve such as a push button (reference numeral 23 of FIG. 25) mounted to the stem 22 of the valve 21, a lever type operation member 240 of FIG. 27, etc. At the inner periphery surface of the outer cylindrical part 20*b* of the cap 20, a female screw 20*d* screwing with the male screw 13*e* of the outer container 13 is formed. At the center of the upper bottom 20*a*, a hole 20*c* in which the stem 22 passes through and the base part of the operation member passes through is formed. The valve holder 18 has a disk-shape so as to be mounted in the lower surface side of the cap 20, and is provided with the cylindrical valve holding part 18*a* which holds the upper part of the housing 24 of the valve 21, and an annular rubber retainer 18*b* which expands to the inner side of the valve holding part.

Figure 21:
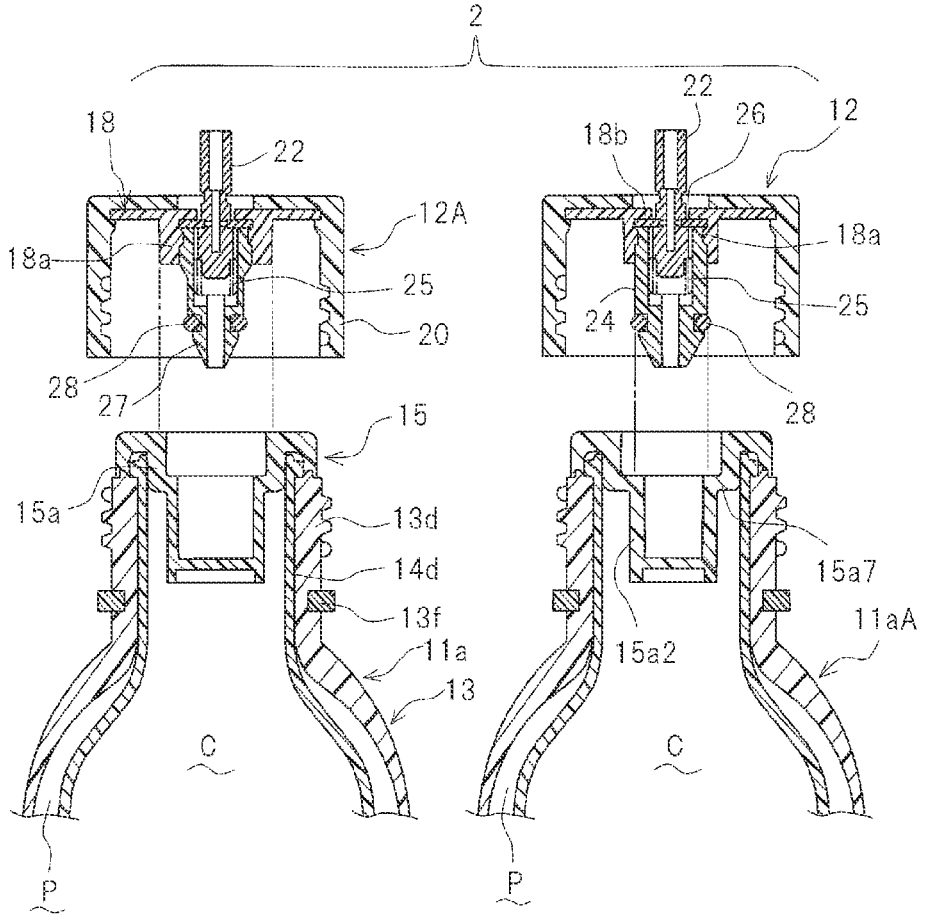
FIG. 21 is a main part cross-sectional view showing another embodiment of the discharge device system of the present invention.

For example, as shown in the right side of FIG. 21, the valve 21 has a known basic structure which is provided with the bottomed cylindrical shaped housing 24, the aforementioned stem 22 vertically movably stored inside the housing, the spring 25 energizing the stem 22 upwardly, and the stem rubber 26 provided between the upper end of the housing 24 and the rubber retainer 18*b* of the valve holder 18. Further, in this embodiment, the approximately columnar shaped seal opening part 27 projecting downward is provided at the lower end of the housing 24, and a seal member 28 such as an O-ring, etc. is mounted at the lower part outer periphery of the housing 24.

The lower end 27*a* of the seal opening part 27 is formed in a truncated conical shape in order to break the openable seal part 15*d* of the plug 15. The length to the lower end of the seal opening part 27 is approximately the length to break the openable seal part 15*d* when the cap 20 is screwed into the male screw 13*e* of the outer container 13. The seal member 28 seals between the inner periphery surface of the fitting cylindrical part 15*a*2 of the plug 15 and the housing 24 at the time of unsealing and after the unsealing. At the center of the seal opening part 27, a communication hole 27*b* communicating with the inside of the housing 24 is formed.

Figure 19:
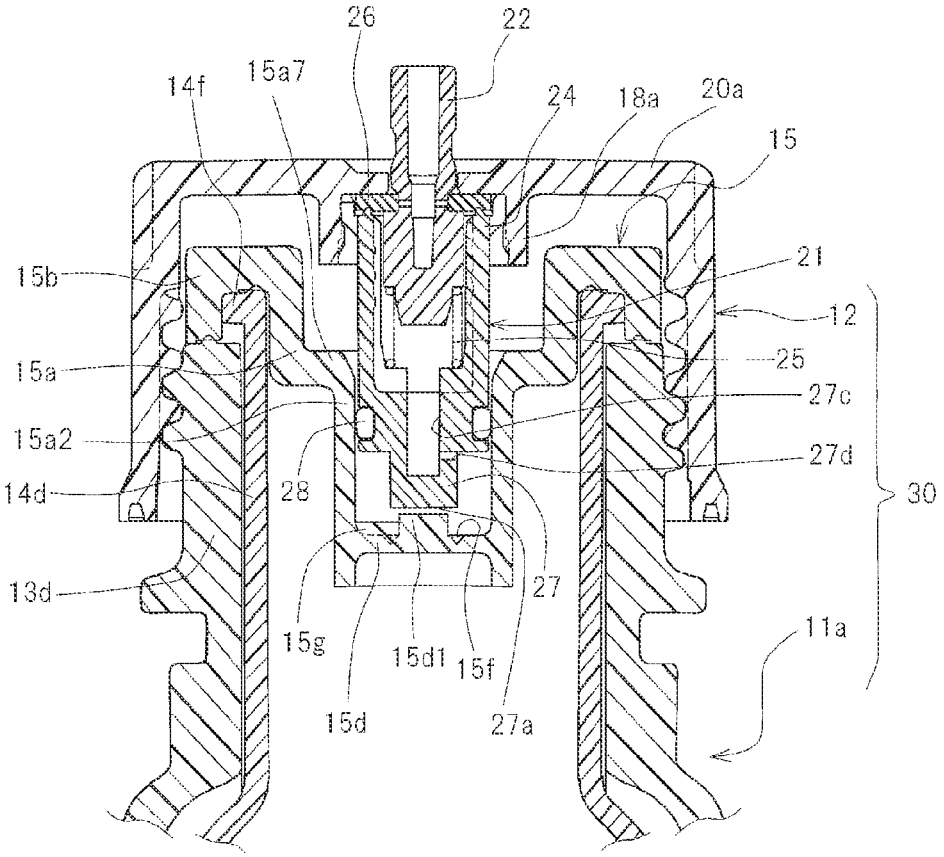
FIG. 19 is a main part cross-sectional view showing another embodiment of the discharge device related to the present invention.

The position in the height direction of the bottom face 27*a* of the seal opening part 27 is preferably a position abutting to the openable seal part 15*d* when the cap 20 is screwed approximately one to two times to the male screw of the outer container 13 (see FIG. 19). In this case, at the time of shipping, the discharge member 12 and the double pressurized container 11 can be connected in such state that the openable seal part 15*d* is not broken by loosely screwing the cap 20, and while maintaining the sealing state.

At the time of distribution and sale, the cap 20 is mounted to the outer container 13, and the double pressurized container 11 and the discharge member 12 are loosely and temporarily connected. In this state, the seal member 28 is tightly contacted with the inner surface of the fitting cylindrical part 15*a*2. The user who purchases it can easily open by only turning the cap 20 several times and screwing in.

When the user uses the purchased discharge device 10, first, the user turns the cap 20 to screw on the male screw 13*e* of the outer container. With this, the cap 20 and the valve 21 are lowered, and the lower end 27*a* of the seal opening part 27 breaks through the openable seal part 15*d*, and the inside of the housing 24 is communicated with the concentrate chamber Sc inside the inner container 14 (see FIG. 18A). At this time, since a force increasing function is realized by the screw mechanism, the user can easily open it.

When the openable seal part 15*d* is broken, the concentrate C may leak from the gap between the inner periphery of the openable seal part 15*d* and the outer periphery of the seal opening part 27. However, since the gap between the fitting cylindrical part 15*a*2 and the housing 24 is sealed by the seal member 28, the concentrate C remains inside the fitting cylindrical part 15*a*2 and it does not leak outside. After the discharge member 12 is mounted, when the user mounts the operation button to the stem 22 and presses it, the stem 22 is lowered, the stem rubber 26 is deformed, and the stem hole opens to discharge the concentrate C inside the concentrate chamber Sc.

When the concentrate C inside the inner container 14 runs out, the user removes the discharge member 12 from the outer container 13 by rotating the cap 20 in the loosening direction, and mounts it to a new pressurized production 11*a*. At this time, since the female screw 20*d* of the cap 20 of the discharge member 12 matches to the male screw 13*e* of the outer container 13, it can be screwed until the end tightly. And the discharge member 12 can be mounted to pressurized product 11*a* while opening the openable seal part 15*d* (see FIG. 18A). The discharge device 10A of the right side of FIG. 17 is also the same (see FIG. 18B).

In the aforementioned discharge device 10, after the concentrate chamber Sc is empty, the discharge member 12 is removed and it can be attached to a new pressurized product 11*a*. The discharge product 10A of the other one is also the same. However, for example, when the discharge member 12A which has been used for spraying the insecticide is mounted to the pressurized product 11*a* for hair care products, there is a risk that will harm the user's health. Further, when different types of concentrates are mixed, there is a risk that an unexpected chemical reaction may occur. The aforementioned problem can be avoided by preventing the discharge member 12 of the particular group to the discharge product 11*a* of another group from being used.

As a means for preventing such erroneous use described above, the colors of the identification ring 13*d*2 and the cap 20 are corresponded each other. Accordingly, the user can make sure and mount the discharge members 12, 12A corresponding to the pressurized products 11*a*, 11*a*A. However, there is a case in which the user tries to erroneously mount the discharge member 12A of the discharge device 10A (for a non-human body) of the right side to the pressurized product 11*a* of the discharge device 10 (e.g., for a human body) of the left side. In this case, since the inner diameter of the female screw 20*d* is larger than the outer diameter of the male screw 13*e*, the cap 20A idles and cannot be screwed (see FIG. 18C). Accordingly, the opening of the plug 15 and the discharge of the erroneous concentrate CA are prevented. When the user realizes that the cap 20A cannot be screwed, the user realizes his/her mistake.

Note that since the diameter of the male screw 13*e* is smaller than the female screw 20*d*, the user may presses the cap 20A straight to the mouth of the pressurized product. However, in this case, since there is no force increasing function by the screw, it is hardly opened, and the actual opening is prevented. Therefore, it can prevent the discharge member 12A used for discharging the concentrate for a non-human body from erroneously mounting to the pressurized product 11*a* filled with the concentrate C for a human body.

On the other hand, when the user tries to mount the discharge member 12 of the discharge device 10 of FIG. 17A to the pressurized product 11*a*A of the discharge device 10A for a non-human body, the inner diameter (inner diameter of the thread groove) of the female screw 20*d* of the cap 20 is smaller than the outer diameter of the male screw 13*e*, so that the cap 20 cannot even be mounted around the male screw 13*e* (see FIG. 18D). Accordingly, it can prevent the discharge member 12 for a human body from being erroneously used to the pressurized product 11*a*A filled with the concentrate for a non-human body.

In the pressurized products 10, 10A of FIG. 17, the correctness of combination is recognized by the diameters of the female screw 20*d* of the caps 20, 20A and the male screw 13*e* of the container body 13, and the mounting is allowed only when correct combination is made. The parts that do not include thread, for example, such as the inner container 14, the plug 15, the valve 21, etc. can be shared, and the mass production effect is expected. Note that when the male screw part is manufactured as a separate part, and mounted to an original male screw, the outer container 13 can be also shared.

In the aforementioned embodiment, the discharge devices 10, 10A are distinguished by the diameters of the male screw 15*e* and the female screw 20*d*, but it can be identified by a screw pitch, a shape of crest and trough of a screw, number of threads (single thread screw, 2-thread screw, etc.), whether right-hand thread or left-hand thread, etc. In the discharge device system 1 of FIG. 17, two types of the discharge devices 10, 10A are employed, but by combining the plurality of misuse prevention means, three types or more can be employed.

Next, with reference to FIG. 19 and FIGS. 20A to 20D, another embodiment will be described. In the aforementioned discharge device system 1, it performs the prevention of the erroneous mounting of the discharge members 12, 12A to the pressurized product 11*a*. But in the discharge device 30 of FIG. 19, the erroneous mounting can be prevented by blocking the movement of the axial direction of the discharge member 12. The discharge device 30 of FIG. 19 is almost the same as the discharge device 10 of FIG. 17. But the cap 20 doubles as the valve holder (see reference numeral 18 of FIG. 17), and the shapes of the seal opening part 27 of the discharge member 12 and the openable seal part 15*d* of the plug 15, etc. are different. That is, in the discharge device 30 of FIG. 19, the upper bottom 20*a* of the cap 20 and the valve holding part 18*a* are integrally formed, and at the lower surface of the upper bottom 20*a*, the stem rubber 26 pushes to the upper end of the housing 24, and the valve holder is omitted.

Further, the seal opening part 27 is a columnar shape, and the lower end 27*a* is flat, and a deep hole 27*c* is formed at the inside of the seal opening part 27. The deep hole 27*c* communicates with the inside of the housing 24, and does not penetrate to the lower end. The deep hole 27*c* communicates with the inside of the fitting cylindrical part 15*a*2 by the horizontal hole 27*a* which opens at the side surface of the seal opening part 27. In the openable seal part 15*d*, a columnar shaped pressure receiving part 15*d*1 surrounded by the weakened line 15*f* such as a V-groove, etc. is provided. In a space between the pressure receiving part 15*d*1 and the inner surface of the fitting cylindrical part 15*a*2, the reinforcement part (reinforcing rib) 15*g* is formed so as to extend in the radial direction. In the range of the reinforcement part 15*g*, the weakened line 15*f* is interrupted. With this, when the discharge member 12 is mounted to the pressurized product, the lower end of the seal opening part 27 presses the pressure receiving part 15*d*1 downwardly, and the openable seal part 15*d* is broken along the weakened line 15*f*. However, the reinforcement part 15*g* is not broken, and the openable seal part 15*d* hangs down in the connecting state at the reinforcement part 15*g* (see FIG. 20A).

Figure 20:
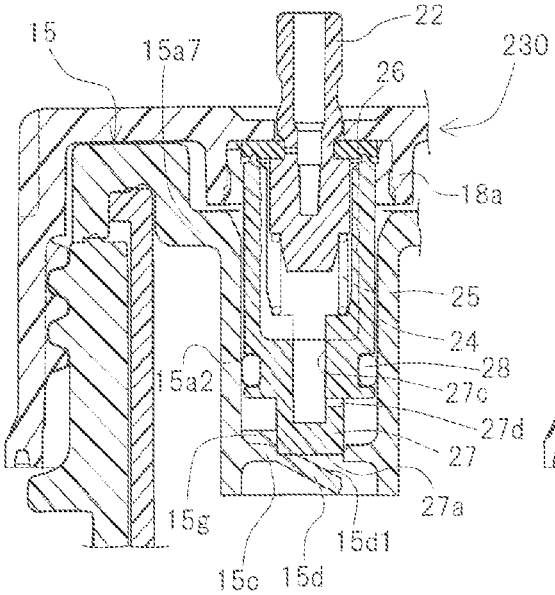
FIG. 20A is a main part cross-sectional view showing the state in which the pressurized product and the discharge member are correctly assembled.
FIG. 20B is a main part cross-sectional view showing the state in which the pressurized product and the discharge member are correctly assembled.
FIG. 20C is a main part cross-sectional view showing the state in which the pressurized product and the discharge member are incorrectly assembled.
FIG. 20D is a main part cross-sectional view showing the state in which the pressurized product and the discharge member are incorrectly assembled.
Figure 20:
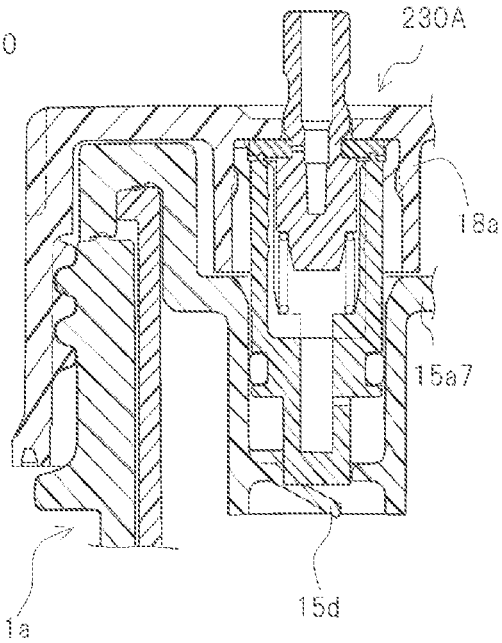
Figure 20:
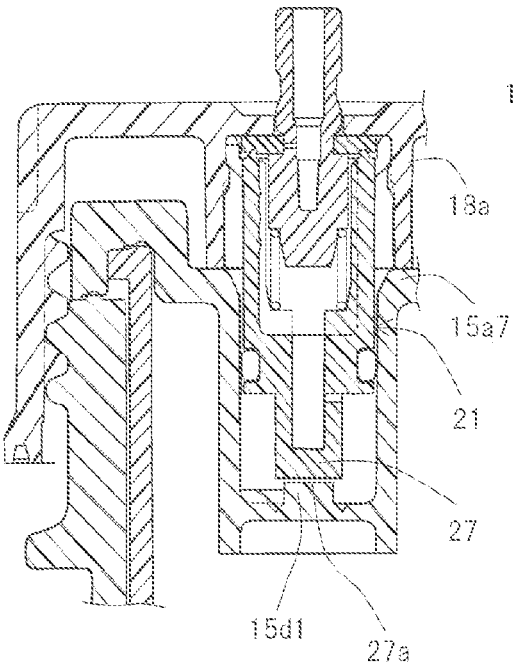
Figure 20:
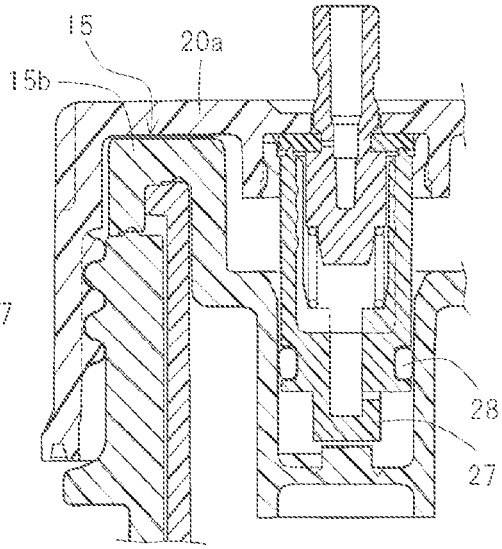

On the other hand, in another discharge device 30A shown in FIG. 20B, the length of the valve holding part 18*a* of the cap 20 is longer than the length of corresponding part in the discharge device 30 of FIG. 20A. And, at the pressurized product 11*a* side, in order to store the valve holding part 18*a*, the depth to the step part 15*a*2 of the seal part 15*a* of the plug 15 is made deeper than the depth in the discharge device 30 of FIG. 20A. Further, the length of the seal opening part 27 is longer than the seal opening part 27 of the discharge device 30 of FIG. 20A. The female screw 20*d* of the cap 20 and the male screw 13*e* of the container body 16 are made in the same screw standard.

In this embodiment, since the screw standard is the same, the discharge member 12A of the discharge device 30A of FIG. 20B can be mounted to the pressurized product 11*a* of the discharge device 30 of FIG. 20A. However, even when the cap 20 is screwed, the valve holding part 18*a* abuts to the step part 15*a*2 as shown in FIG. 20C, and it cannot be lowered more than that. With this, the lower end 27*a* of the seal opening part 27 does not reach to the pressure receiving part 15*d*1, so that it cannot be opened. Therefore, the erroneous use is prevented.

On the other hand, in a case in which the discharge member 12 of FIG. 21A is mounted to the pressurized product 11*a*A of FIG. 20B, as shown in FIG. 20D, the upper bottom 20*a* of the cap 20 abuts to the flange 15*b* of the plug 15, and it prevents the discharge member from lowering more than. Accordingly, the lower end 27*a* of the seal opening part 27 does not reach to the pressure receiving part 15*d*1. With this, the erroneous use is prevented.

The discharge device system 2 of FIG. 21 identifies whether or not the combination of the inner diameter of the seal part 15*a* of the plug 15 of the pressurized product 11*a* and the outer diameter of the valve holding part 18*a* of the cap 20 is correct, and if it is incorrect, it prevents the discharge member 12 from engaging. Further, it identifies whether or not the combination is correct by the inner diameter of the fitting cylindrical part 15*a*2 of the plug 15 and the outer diameter of the part upper side than the seal member 28 in the housing 24 of the valve 21, and if it is incorrect, it prevents the discharge member 12 from engaging in the axial direction.

The discharge member 12A of the left side of FIG. 21 is an original member to be combined with the pressurized product 11*a*A of the right side, and it is an erroneous combination in which the outer diameter of the valve holding part 18*a* of the valve holder 18 is larger than the inner diameter of the seal part 15*a* of the plug 15 of the pressurized product 11*a*. Accordingly, the cap 20 cannot be mounted to the pressurized product 11*a*. On the other hand, in the discharge member 12 of the right side which should be originally combined with the pressurized product 11*a* of the left side, the outer diameter of the valve holding part 18*a* is smaller than the inner diameter of the seal part 15*a* of the plug 15 of the pressurized product 11*a*A. Accordingly, the valve holding part 18*a* can be inserted into the seal part 15*a*. However, within the housing 24, the outer diameter of the part upper side than the seal member 28 is larger than the inner diameter of the fitting cylindrical part 15*a*2 of the plug 15. Therefore, in the combination of the right side, the discharge member 12 cannot be mounted to the pressurized product 11*a*A.

Note that it is possible to check an error in only one side, and allow the other side. For the one which is high risk, for example, when there is a risk to use the insecticide to a human body, it prevents the discharge member 12 from being inserted, and on the other hand, if the risk is low, it allows to be inserted. With this, the identification mechanism can be simplified.

Figure 22:
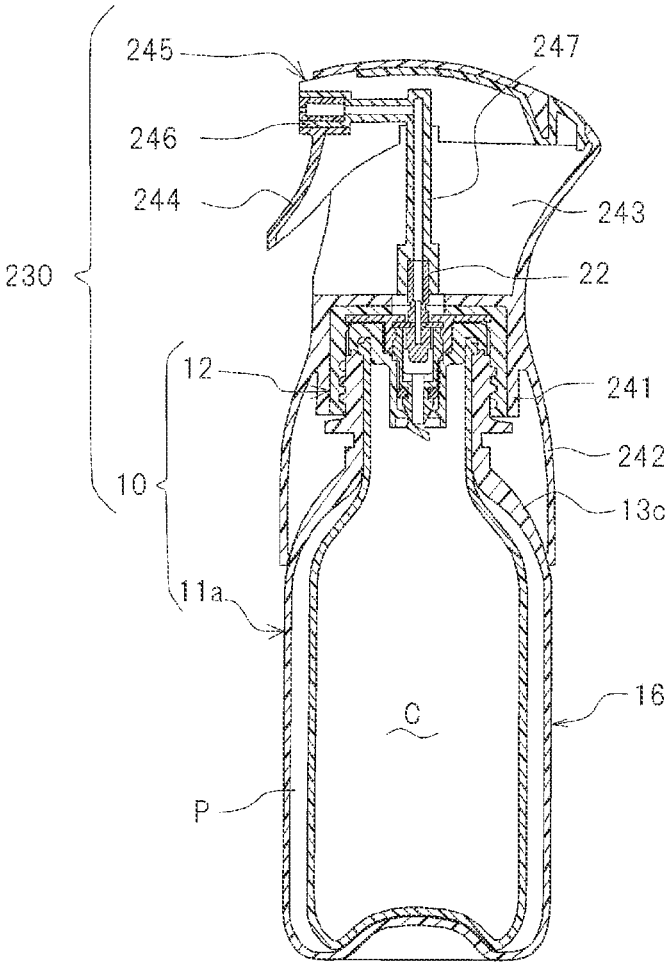
FIG. 22 is a cross-sectional view showing another embodiment of the discharge device related to the present invention.

In the discharge device 230 shown in FIG. 22, the operation member 245 provided with the lever type operation part 244 is mounted to the discharge device 10 of FIG. 17. The operation member 245 is provided with a cup-shaped cap holding part 241 which is used for supporting the operation part 244 and fits to the periphery of the cap 20, a cover part 242 which extends downward from the surrounding wall of the cap holding part 241, and is put on the shoulder part of the container body 16, and a supporting wall 243 which extends upward from the cap holding part 241.

The rear end of the operation part (operation lever) 244 is rotatably connected to the upper part rear end of the supporting wall 243 via a hinge or a pin.

A spray nozzle 246 is mounted to the upper part of the operation part 244. The spray nozzle 246 is mounted to the front end of the L-shaped passage member 247, and the lower end of the passage member 247 is fitted to the stem 22. The user holds the cover part 242 and the container body 16, and pulls the operation part 244, so that the operation part 244 is rotated downward around the rear end, and the discharge device 230 can discharge through the passage member 247 by opening the valve 21. When stop operating, it stops discharging. Such lever operation type discharge device 230 is used for a space spray such as, mainly, insecticides, deodorant aromatic air fresheners, etc. Accordingly, it is used and distinguished from the one used for a human body. However, since the upper part of the pressurized product is covered by the cover part 242, once, when the cover part 242 is mounted, the user hardly realizes the erroneous mounting. Therefore, the discharge device system of the present invention has great effect in which the erroneous mounting at the time of mounting is prevented, and the user easily realize an error.

In the aforementioned embodiment, as the mounting prevention means, mainly, the means based on the radial direction control such as a mismatch between the outer diameter of the outer container 13 and the inner diameter of the cap 20, a mismatch between the colors of the cap 20 and the identification ring 13*d*2, a screw part standard difference between the male screw 13*e* and the female screw 20*d*, etc., a fitting size difference between the outer diameter of the valve holding part 18*a* or the housing 24 and the inner diameter of the seal part 15, etc. are employed. Further, in the aforementioned embodiment, as the opening prevention means, the means based on the axial direction control such as the size relationship of the depth of the step part 15*a*7 and the length of the valve holding part 18*a*, the length of the seal opening part 27, etc. are employed. However, other means such as the length of the cap 20, the existence or non-existence of the support ring 13*d*1 or the identification ring 13*d*2 may be employed.

Figure 23:
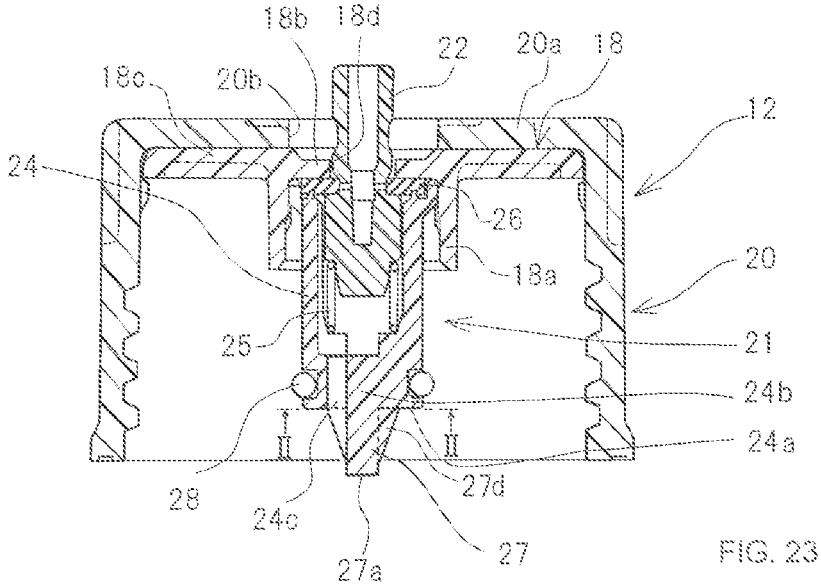
FIG. 23A is a main part cross-sectional view showing the discharge member.
FIG. 23B is a main part cross-sectional view showing another embodiment of the double pressurized container.
FIG. 23C is a II-II line cross-sectional view of FIG. 23A.
Figure 23:
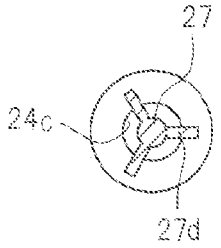
Figure 23:
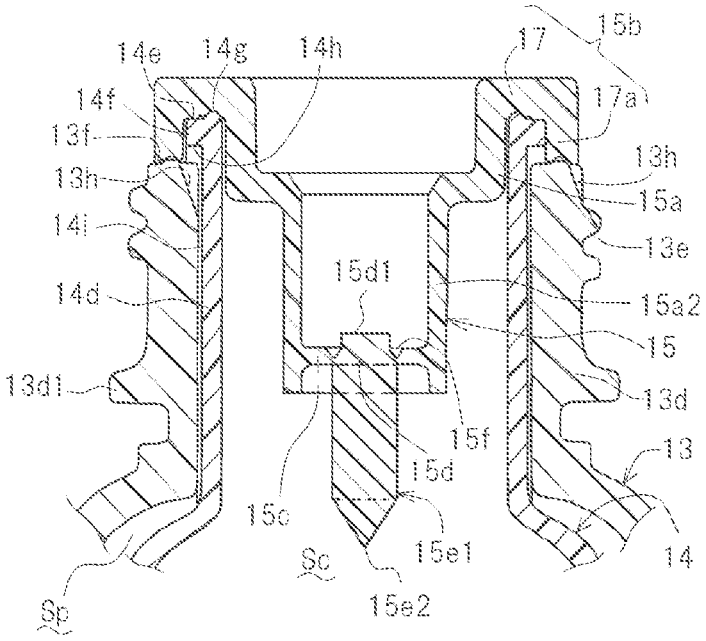
Figure 24:
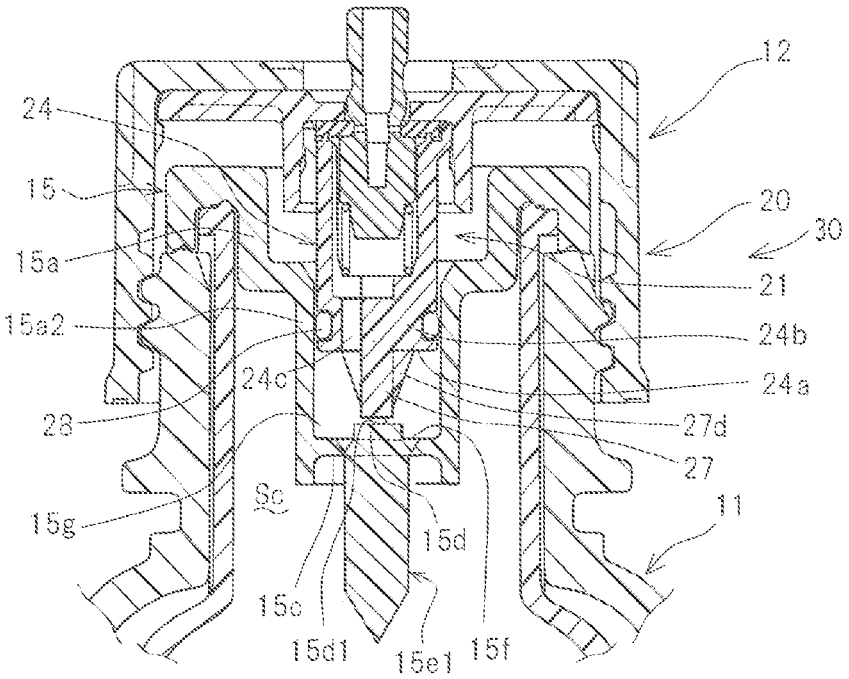
FIG. 24A is a main part cross-sectional view showing the discharge device before opening.
FIG. 24B is a main part cross-sectional view showing the discharge device after opening.
Figure 24:
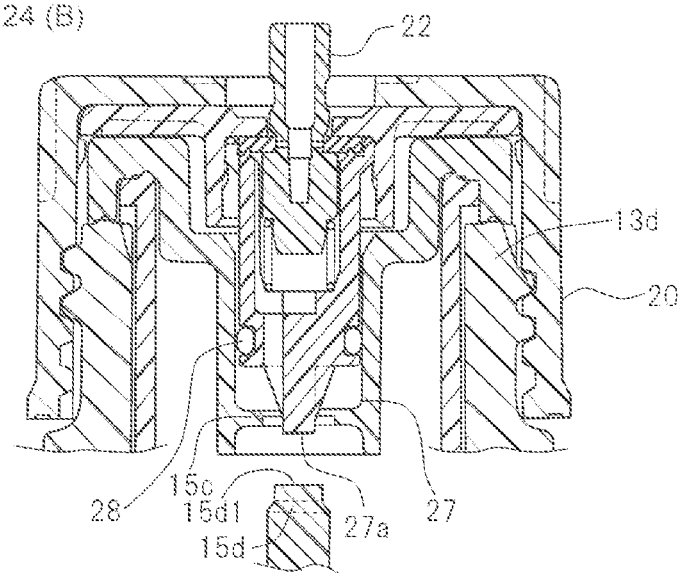

Next, with reference to FIGS. 23A to 29, the structure discharging the pressurizing agent from the discharging container after use will be described. Similar to the above description, the plug 15 shown in FIG. 23B is provided with the bottomed cylindrical shaped seal part 15*a* inserted into the neck part 14*d* of the inner container 14 which is the same as described above, and the annular flange 15*b* continuing to the upper end of the seal part. The lower part of the seal part 15*a* is formed as the fitting cylindrical part 15*a*2 which is smaller diameter than the upper part. The bottom part of the seal part 15*a*, that is, the bottom part 15*c* of the fitting cylindrical part 15*a*2 is provided with a closing part (openable seal part) 15*d* in which the pressure receiving part 15*d*1 made thicker as compare with that of the periphery is provided. Normally, the closing part 15*d* is formed in a circular shape in the plan view. However, other shapes such as a rectangular shape, etc. may be employed. In the plug 15, there is a characteristic in which a projection part 15*e*1 is provided at the lower surface side of the closing part 15*d*.

The periphery of the closing part 15*d* is surrounded by a breakable thin part (breaking part, weakening line) 15*f* such as an annular groove, etc. The pressure receiving part 15*d*1 is provided on almost the whole of the upper surface of the closing part 15*d*, and the thin part 15*f* is formed on the upper surface of the bottom part 15*c*. Note that the thin part 15*f* may be formed on the lower surface. The thin part 15*f* is formed by, for example, a V-groove. The thin part 15*f* is continued, but if it is breakable, it may not be continued. The project part 15*e*1 provided on the lower surface of the closing part 15*d* is a rod-shape in this embodiment, specifically, a columnar shape, and the sharp point 15*e*2 for perforating the inner container 14 is provided at the lower end of the project part. The project part 15*e*1 and whole of the sharp point 15*e*2 can be seen as the sharp point.

Figure 25:
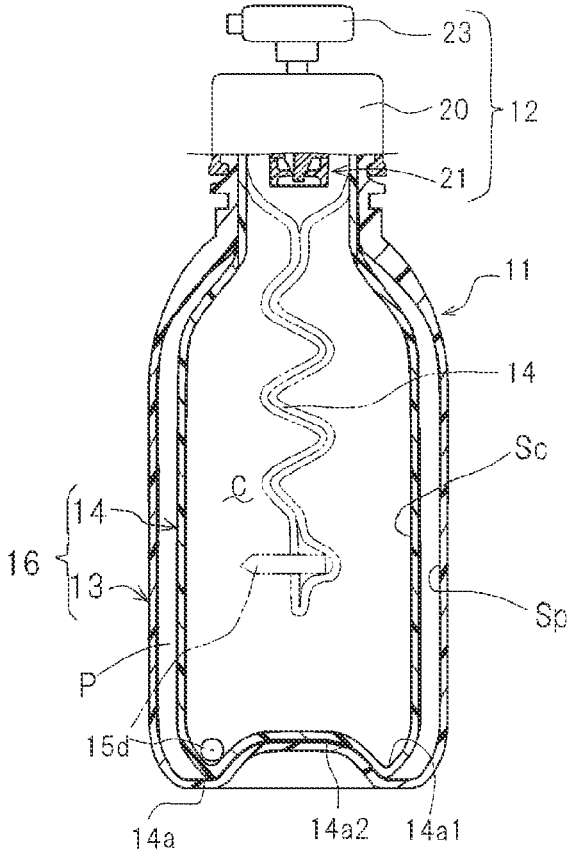
FIG. 25 is a whole cross-sectional view showing the discharge device of FIG. 24A after opening.
Figure 26:
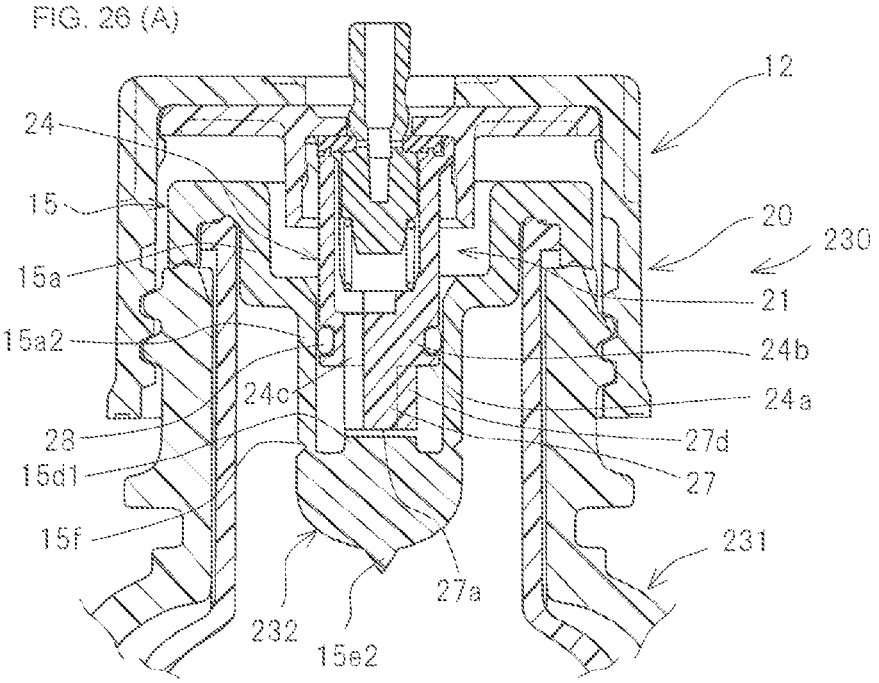
FIG. 26A is a cross-sectional view showing yet another embodiment of the discharge device of the present invention before opening.
FIG. 26B is a cross-sectional view showing yet another embodiment of the discharge device of the present invention after opening.
Figure 26:
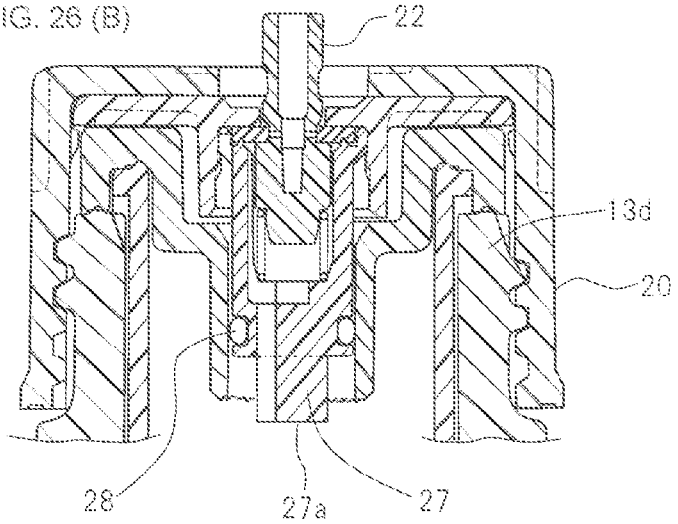

After breaking the closing part 15*d* along the thin part 15*f* and dropping off the bottom of the inner container 14, the sharp point 15*e*2 perforates the inner container 14 when the inner container 14 is largely contracted by discharging the concentrate, so that it is possible to discharge the pressurizing agent (see FIG. 25). As the sharp point 15*e*2, a conical shape, etc. is employed. The diameter of the project part 15*e*1 is almost the same as the diameter of the lower end of the thin part 15*f*, and it is, for example, 1 to 10 mm, and the length is approximately 2 to 10 mm. The height of the sharp point 15*e*2 is preferably approximately 1 to 5 mm. Other than the circular shape, the cross-sectional shape of the project part 15*e*1 may be an angular shape, a cross shape, a star shape, etc. for the material saving. The seal part 15*a* and the closing part 15*d* are partially hardened in a temperature condition, etc. at the time of molding, and the elongation at the time of opening is suppressed and it may be easily broken.

When the user who purchases it uses the discharge device 10, first, the cap 20 is screwed onto the male screw 13*e* of the outer container. With this, whole cap 20 and the valve 21 are lowered, and the bottom face 27*a* of the seal opening part 27 pushes down the closing part 15*d*. Accordingly, the thin part 15*f* is broken, and the closing part 15*d* is teared off from the fitting cylindrical part 15*a*2 of the housing 24, and is separated and dropped off from the housing 24. And, the seal opening part 27 breaks through the bottom part 15*c* of the fitting cylindrical part 15*a*2, and the inside of the housing 24 and the concentrate chamber Sc inside the inner container 14 are connected (see FIG. 24B). The dropped closing part 15*d* is fallen into the bottom of the inner container 14 (see FIG. 25).

Note that since the cap 20 is screwed onto the outer container 13, the lowering amount of the valve 21 is small as compared with the operation amount of the cap 20. Accordingly, the bottom face 27*a* of the seal opening part 27 gradually presses the pressure receiving part 15*d*1 of the closing part 15*d*. Since the plug 15 is made of synthetic resin, when gradually pressing, by its extensibility, the closing part 15*d* is easily elongated and hardly broken. However, in this embodiment, since the closing part 15*d* is surrounded by the annular thin part 15*f*, and the pressure receiving part 15*d*1 is projected, the stress concentration to the thin part 15*f* is increased, and it can be smoothly broken. In addition, since the outline of the project part 15*e*1 is also almost the same as the thin part 15*f*, the closing part 15*d* is hardly bent, and the breaking is further smoothly performed. Further, since the bottom face 27*a* of the seal opening part 27 is flat, it is hardly deformed by the opening operation, and the discharge member can be repeatedly used.

Since the closing part 15*a* is provided with the approximately circular shaped pressure receiving part 15*d*1, which is provided on the central axis of the plug 15 and is thickened to the upper part, and abuts to the circular shaped bottom face 27*a* of the seal opening part 27, when it is pressurized by the bottom face 27*a*, the closing part 15*a* is pushed straight and is broken along the thin part 15*f*, and the broken closing part 15*d* is dropped off and fallen down onto the bottom of the inner container 14. However, the pressure receiving part 15*d*1 or the bottom face 27*a* of the seal opening part 27 may be inclined, so that the thin part 15*f* is broken in the order from one side to another side.

When the closing part 15*d* is broken, there is a case in which the concentrate C leaks from the gap between the inner periphery of the bottom part 15*c* and the outer periphery of the seal opening member 27. However, since the gap between the fitting cylindrical part 15*a*2 and the housing 24 is sealed by the seal member 28, the concentrate C remains inside the fitting cylindrical part 15*a*2 and it does not leak outside. Further, the reaction force at the time of breaking and the internal pressure after the breaking function as to push the housing 24 upwardly. However, the cap 20 and the outer container 13 are screwed, and the upper bottom 20*a* of the cap 20 and the valve holder 18 form a double support, so that jumping out of the discharge member 12 is suppressed. Further, the deformation of the upper bottom 20*a* of the cap 20 is suppressed.

After the discharge member 12 is mounted, when the user presses the operation button 23 mounted on the stem 22, the stem rubber 26 is bent by lowering the stem 22, and the stem hole opens. Since the concentrate C inside the concentrate chamber Sc is pressurized by the pressurizing agent P via the inner container 14, it is discharged to the outside via the seal opening part 27, the housing 24, the stem 22, and the operation button 23. When a finger releases from the operation button 23, the stem 22 is raised so as to stop the discharge. The pressurizing agent chamber Sp in which the pressurizing agent P is charged is closed by the plug 15, and it does not communicate with the outside or the concentrate chamber Sc, so that the pressurizing agent P does not leak to the outside by the discharging operation.

When the concentrate C inside the inner container 14 becomes low, the inner container 14 is contracted. And, after discharging all, as shown in an imaginary line in FIG. 25, the walls of the inner container 14 tightly contact to each other, and become flat. Since the aforementioned closing part 15*d* is fallen down onto the bottom of the inner container 14, specifically, the annular recessed portion 14*a*1 projected downwardly, and the rod-shaped project part 15*e*1 is laid, the sharp point 15*e*2 of the closing part 15*d* breaks through the bottom part 14*a* or the body part 14*b* of the inner container 14, and the pressurizing agent P enters the inside of the inner container 14. Therefore, by only pressing the operation button 23, the pressurizing agent P can be discharged via the valve 21.

Note that the inner container 14 formed by the blow molding forms a dome part 14*a*2, so that the thickness of the recessed portion 14*a*1 around the dome part is thin. Therefore, the recessed portion 14*a*1 is easily penetrated by the sharp point 15*e*2. In the state in which the pressurizing agent P is discharged from the container body 16 as described above, the discharge member 12 is removed by rotating the cap 20. The removed discharge member 12 is mounted to a new double pressurized product 11*a*. The empty double pressurized container 11 can be safely recycled as a synthetic resin.

Next, with reference to FIGS. 26A and 26B, another embodiment of the double pressurized container will be described. The discharge device 30 of FIG. 26A is provided with a double pressurized container 31 which is almost the same as the double pressurized container 11 of FIG. 24A, and a valve 21 which is practically the same as the valve 21 of FIG. 24A other than the reinforcing plate 27*d*. In the double pressurized container 31, the whole bottom part 15*c* of the fitting cylindrical part 15*a*2 of the seal part 15*a* is formed as a hemispherical project part 232 which is projected downwardly, and a root section of this project part 232 functions as the closing part (openable seal part). And, at the boundary between the fitting cylindrical part 15*a*2 and the outer periphery surface of the closing part, an annular thin part 15*f* is formed. Further, at the lower center of the project part 232, the sharp point 15*e*2 to penetrate the inner container 14 is projected. Also in this embodiment, the thin part 15*f* is a weakening line shaped in a V-shape in the cross section.

Further, at the discharge member 12 of FIG. 26A, the reinforcing plate 27*d* of the seal opening part 27 which is provided at the lower part of the housing 24 is a rectangular shape, and it is not formed in a triangular shape which becomes narrower toward the lower side as shown in FIG. 24A. After broken at the thin part 15*f*, it is largely opened downwardly, so that it does not have to form a narrow shape, and it is preferable that the lower end of the reinforcing plate 27*d* is made bigger because it surely pushes the pressure receiving part 15*d*1. In other points, it is similar to the discharge member 12 of FIG. 23A.

Figure 27:
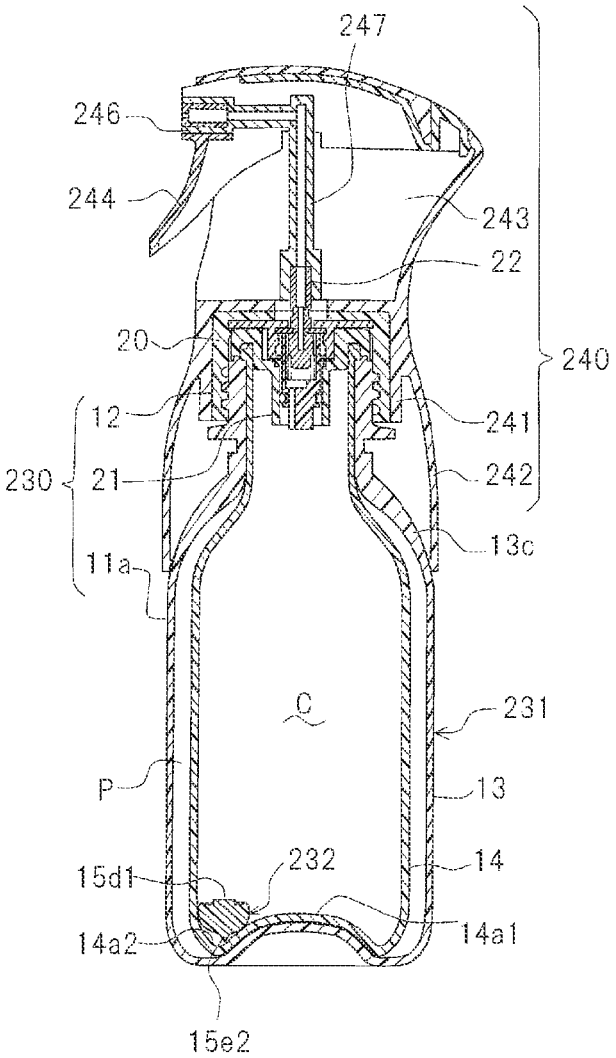
FIG. 27 is a whole cross-sectional view showing the discharge device of FIG. 26A after opening.

In this discharge device 30, when the cap 20 is screwed to the neck part 13*d* of the outer container 13, the bottom face 27*a* of the seal opening part 27 presses the pressure receiving part 15*d*1 downwardly as shown in FIG. 26B and the closing part 232 is teared off along the thin part 15*f* The teared-off closing part 232 is fallen down into the bottom of the inner container 14 as shown in FIG. 27. Specifically, when there is the annular recessed portion 14*a*1 at the bottom part 14*a* of the inner container 14, the closing part 232 rolls along the inner surface of the recessed portion 14*a*1, and the sharp point 15*e*2 hits to the bottom part 14*a* or the wall surface of the body part 14*b* at right angle. Further, the thickness of the recessed portion 14*a*1 is thin as described above. Therefore, when the concentrate C is discharged and the inner container 14 is largely contracted, the sharp point 15*e*2 of the closing part 232 easily penetrates the wall of the inner container 14.

Note that as shown in FIG. 27, instead of the operation button, it may be a discharge device 230 in which a lever type operation member 240 operating the stem 22 is mounted. The operation member 240 is provided with a cup-shaped cap holding part 241 fitting with the periphery of the cap 20, a cover part 242 extending downward from the surrounding wall of the cap holding part 241 and covering the shoulder part of the container body 16, and a supporting wall 243 extending upward from the cap holding part 241. And, the rear end of the operation lever 244 is rotatably connected to the upper part rear end of the supporting wall 243 via a hinge or a pin.

The spray nozzle 246 is mounted to the upper part of the operation lever 244. The spray nozzle 246 is mounted to the front end of the L-shaped passage member 247, and the lower end of the passage member 247 is fitted to the stem 22. The user holds the cover part 242 and the container body 16, and pulls the operation lever 244, so that by rotating the operation lever 244 downward around the rear end, the discharge device 230 can discharge through the passage member 247 by opening the valve 21. When stop operating, it stops discharging. Such lever operation type operation member 240 is used for a space spray of, mainly, insecticides or deodorant aromatic air fresheners, etc.

Figure 28:
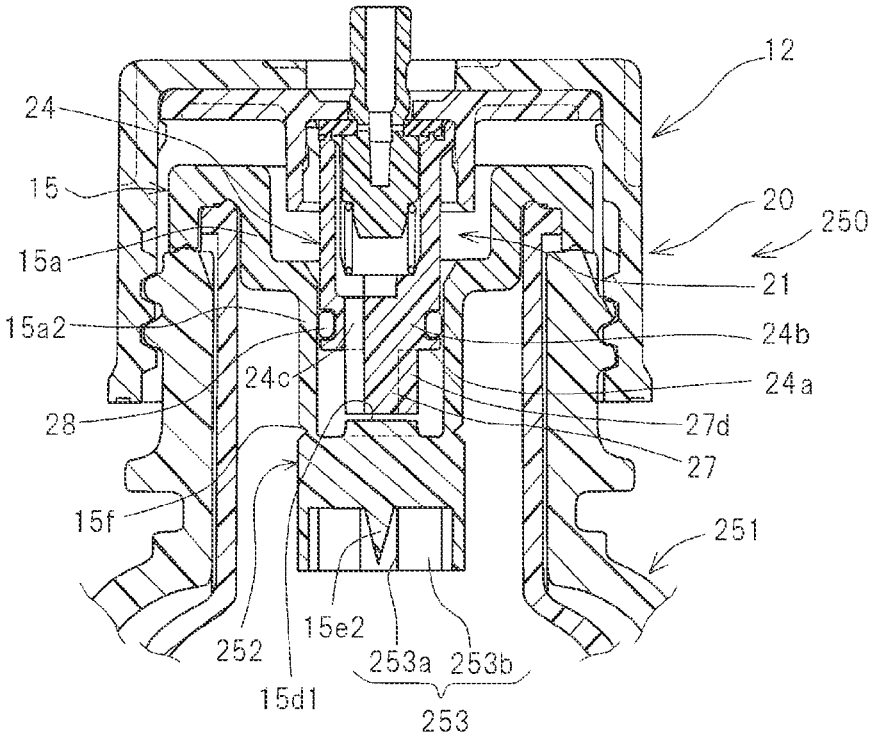
FIG. 28 is a main part cross-sectional view showing yet another embodiment of the discharge device of the present invention before opening.
Figure 29:
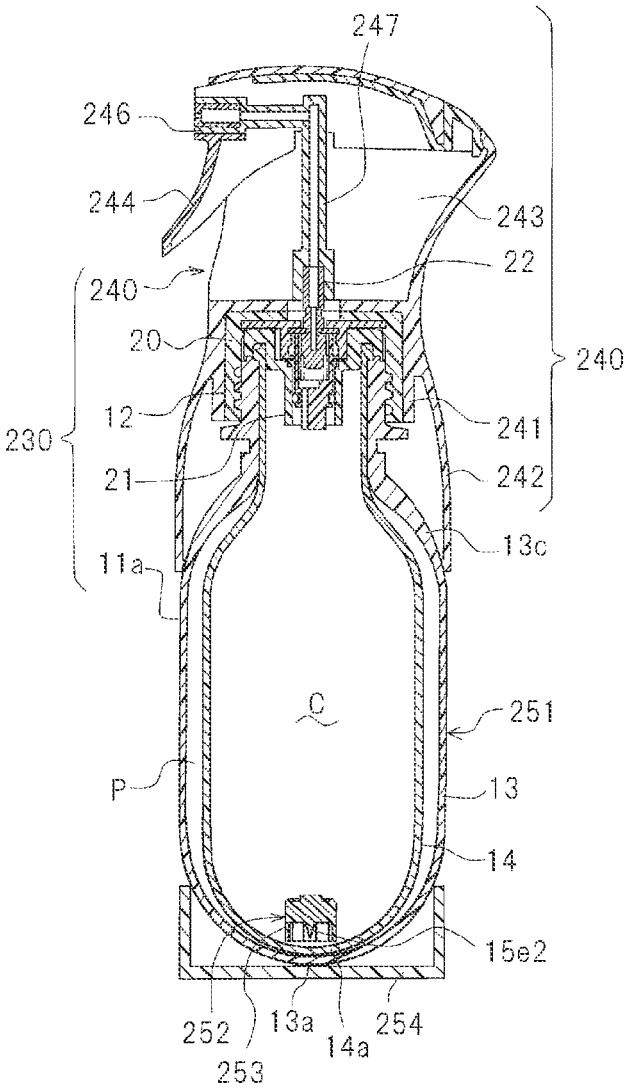
FIG. 29 is a whole cross-sectional view showing the discharge device of FIG. 28 after opening.
Figure 30:
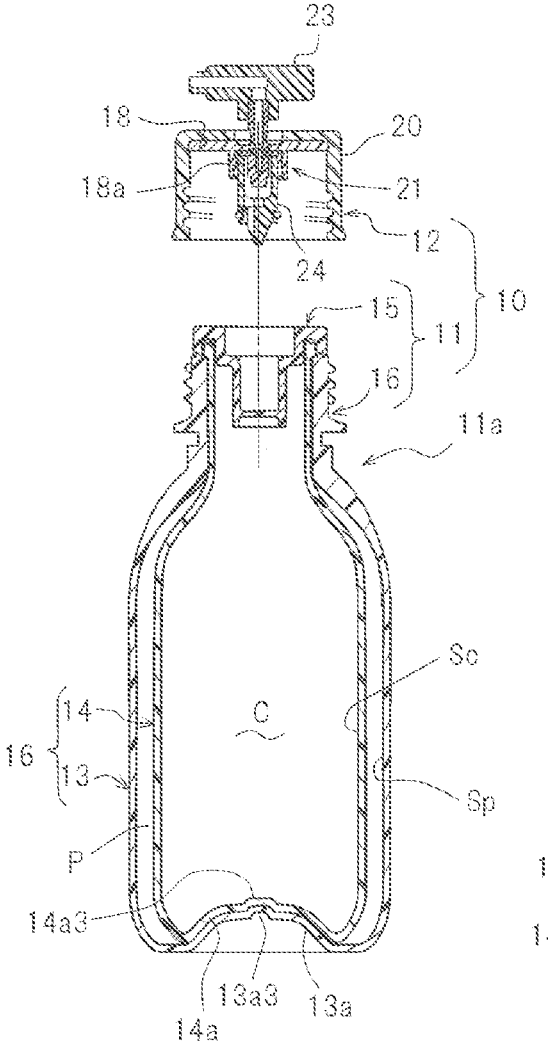
FIG. 30A is a cross-sectional view showing yet another embodiment of the double pressurized container (discharging container) of the present invention together with the discharge member.
FIG. 30B is a cross-sectional view showing the double pressurized container before the plug is mounted.
Figure 30:
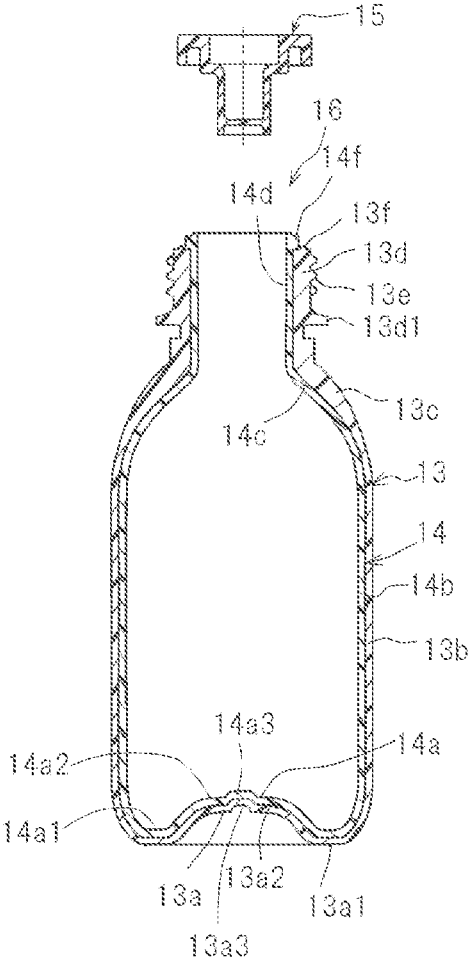

Next, with reference to FIGS. 28 and 29, another embodiment of the double pressurized container will be described. The double pressurized container 251 of the discharge device 250 of FIGS. 28 and 29 is practically the same as the double pressurized container 31 of FIG. 1A except the protection part 253 around the sharp point 15*e*2 is provided at the closing part (openable seal part) 252, and the bottomed cylindrical shaped base cup 254 is mounted at the outer container 13 in order to stand by itself, since the bottom parts 13*a*, 14*a* of the outer container 13 and the inner container 14 are formed in hemispherical shapes projecting downwardly. In the double pressurized container 51, the whole bottom part 15*c* of the fitting cylindrical part 15*a*2 of the seal part 15*a* is a columnar shaped closing part 252, and a thin part (breaking part) 15*f* is formed at the boundary of the fitting cylindrical part 15*a*2 and the outer periphery surface of the closing part 252.

Further, at the lower center of the closing part 252, a conical or an acicular sharp point 15*e*2 is projected. Further, at the periphery of the lower end of the closing part 252, a thin cylindrical protection part 253 is provided around the sharp point 15*e*2. The protection part 253 is separated into a plurality of protective pieces 253*b* by the multiple breaks 253*a* so as to be made easily bendable. Further, since the bottom parts 13*a*, 14*a* of the outer container 13 and the inner container 14 are formed in a hemispherical shape, and a pressure resistance of the container is high, it can be entirely made thin, and it is easily perforated by the sharp point 15*e*2.

In the double pressurized container 251, the broken closing part 252 is arranged at the hemispherical bottom part 14*a* of the inner container 14. Since the sharp point 15*e*2 is surrounded by the protection part 253, even if the closing part 252 is dropped off inside the inner container 14, the sharp point 15*e*2 does not touch the inner container 14. When almost all the concentrate is discharged, the hemispherical bottom part 14*a* of the inner container 14 is contracted so as to be flipped, and the protective piece 253*b* is bent, and then, the sharp point 15*e*2 penetrates the inner container 14 for the first time. Therefore, the pressurizing agent is not discharged in the state of remaining the concentrate. Further, since the sharp point 15*e*2 is surrounded by the protection part 253, the worker injuries at the time of manufacturing are suppressed.

Next, with reference to FIGS. 30A to 33, a discharge device discharging the pressurizing agent to the outside directly by making a hole to the outer container 13 will be described. The discharge device 10 is provided with a double pressurized container 11, the discharge member 12, and the concentrate (contents) C and the pressurizing agent P charged in the double pressurized container 11. The one in which the concentrate C and the pressurizing agent P are charged in the double pressurized container 11 is the pressurized product 11*a*. It is sold as a set of products before the pressurized product 11*a* and the discharge member 12 are assembled (see FIG. 1A), or in the unopened half assembled state (see FIG. 24A). The pressurized product 11*a* is sold with the discharge member 12, and also, it is sold individually as a replacement. Also, the discharge member 12 may be sold individually.

The double pressurized container 11 is provided with the outer container 13, the inner container 14 which is stored inside the outer container and has flexibility, and the lid (plug) 15 sealing the outer container 13 and the inner container 14. The valve or the pump is not provided. However, the valve or the pump may be mounted to the container body 16. The assembly of the outer container 13 and the inner container 14 is the container body 16 (see FIG. 1B). The inside of the inner container 14 is a concentrate chamber Sc to be filled with the concentrate C, and a space between the outer container 13 and the inner container 14 is a pressurizing agent chamber Sp to be filled with the pressurizing agent P. They are sealed by the plug 15. That is, in the double pressurized container 11, the concentrate C and the pressurizing-propellant P are separately stored, and only the concentrate C can be discharged, and accordingly, the leakage of the pressurizing agent P such as compressed gas, etc. can be prevented.

As shown in FIG. 30B, the outer container 13 is provided with a bottom part 13*a*, a cylindrical body part 13*b*, a shoulder part 13*c*, and a cylindrical neck part 13*d*. A male screw 13*e* is formed at the outer periphery of the neck part 13*d*. The upper end surface 13*f* of the neck part 13*d* is approximately flat in order to fix the plug 15. In this embodiment, as shown in FIG. 32A, the bottom part 13*a* of the outer container 13 is provided with an annular contact area 13*a*1 projected downwardly, and a dome part 13*a*2 provided at the center of the contact area and projected upwardly. Accordingly, the pressure resistance is enhanced, and the impact resistance at the time of dropping, etc. is enhanced. Therefore, it is safe at the time of distribution as a single item or at the time of delivery as a home delivery. Further, since it has the contact area 13*a*1, it can be directly placed on the top such as a flat base, etc. in a stable manner. However, it may be a spherical bottom face. At the central part of the dome part 13*a*2, the lower surface (outer surface side) is recessed, and the upper surface (inner surface side) is formed as a projected joint part 13*a*3.

Returning to FIG. 30B, the inner container 14 is provided with the bottom part 14*a*, the body part 14*b*, the should part 14*c*, and the neck part 14*d* similarly to the outer container 13. Also, at the bottom part 14*a* of the inner container 14, the annular recessed portion 14*a*1 which is projected downwardly, and the dome part 14*a*2 which is provided at the center of the recessed portion and projected upwardly are formed. The central part of the dome part 14*a*2 is a joint part 14*a*3 in which the lower surface (outer surface side) is recessed, and the upper surface (inner surface side) is projected. The joint part 14*a*3 of the inner container 14 is thermally welded with the joint part 13*a*3 of the aforementioned outer container 13. The outer surface of the neck part 14*d* of the inner container 14 has a small gap in a space with the inner surface of the neck part 13*d* of the outer container 13. The inner surface of the neck part 14*d* of the inner container 14 is smooth cylindrical surface. The bottom part 14*a* of the inner container 14 abuts to the bottom part 13*a* of the outer container 13, and in the case of charging the pressurizing agent or fixing the plug 15, etc., the inner container 14 is supported to prevent from hanging. The bottom part 13*a* of the outer container 13 and the bottom part 14*a* of the inner container 14 merely abuts to each other but they are not joined except the joint parts 13*a*3, 14*a*3.

Both of the outer container 13 and the inner container 14 are made of thermoplastic resins such as polyethylene terephthalate, polyethylene naphthalate, polyethylene, polypropylene, etc. With these materials, for example, they can be manufactured by inserting a preform for the inner container into a preform for the outer container, and blow-molding the parts lower than the shoulder parts 13*c*, 14*c* at the same time. Specifically, it is preferable to use an injection-blow-molding method in which a predetermined shaped preform is performed by injection-molding and next the blow-molding is performed.

Further, by raising up the bottom part 13*a* of the outer container 13 by a dome-shaped mold 62 provided in a vertically movable state at the center of the lower mold 61 at the time of molding the dome parts 13*a*2, 14*a*2, the annular recessed portion 14*a*1 of the inner container 14 can be stretched and made thin. Accordingly, it is easily crushed and discarded. The dome-shaped mold may be integrated with the lower mold 61.

Figure 33:
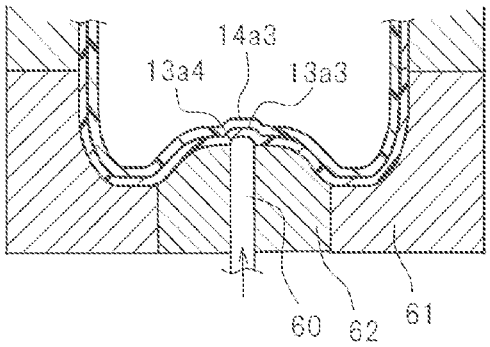
FIG. 33 is a cross-sectional view showing one embodiment of the manufacturing method of the double pressurized container of the present invention.

Further, before hardening the bottom parts 13*a*, 14*a* by cooling the outer container 13 and the inner container 14, by pushing up the central part of the bottom part 13*a* by using a stick (reference numeral 60 in FIG. 33), etc., making a recess in the outer surface side (bottom face side) and a projection in the inner surface side, and by welding a part of the bottom part 14*a* of the inner container 14 and a part of the bottom part 13*a* of the outer container 13, the joint parts 13*a*3, 14*a*3 can be formed (see FIG. 33). Accordingly, the periphery of the joint part 13*a*3 of the outer container 13 (rising part 13*a*4 in FIGS. 32A and 33) becomes thin, and it becomes easily broken. Note that the joint parts 13*a*3, 14*a*3 may be adhered by an adhesive agent.

When the user who purchases it uses the discharge device 10, first, for example, the cap 20 of FIG. 11A screws onto the male screw 13*e* of the outer container. With this, the whole cap 20 and the valve 21 are lowered as shown in FIG. 11B, and the bottom face 27*a* of the seal opening part 27 pushes down the closing part (openable seal part) 15*d*. With this, the thin part 15*f* is broken, and the closing part 15*d* is teared off from the fitting cylindrical part 15*a*2 of the housing 24, and it hangs down from the housing 24 with remaining connection at a part (reinforcement part 15*g*), or it is dropped off by being separated. And, the seal opening part 27 breaks through the bottom part 15*c* of the fitting cylindrical part 15*a*2 to communicate the inside of the housing 24 with the concentrate chamber Sc which is the inside of the inner container 14 (see FIG. 11B). The dropped off closing part 15*d* is fallen down onto the bottom of the inner container 14.

Figure 31:
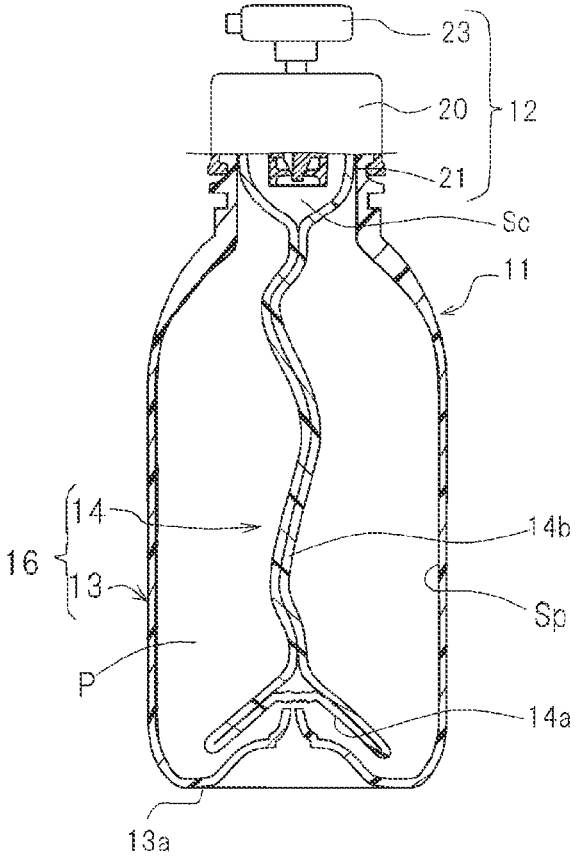
FIG. 31 is a cross-sectional view showing the outer container of the double pressurized container of FIG. 30A after opening.
Figure 32:
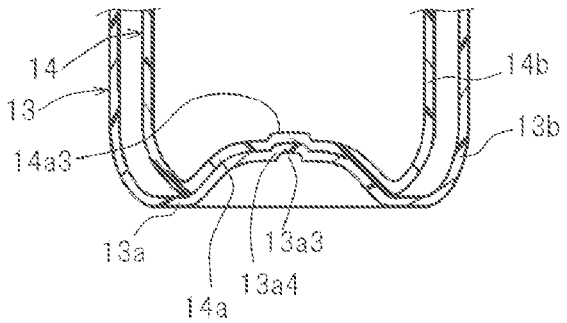
FIG. 32A is a main part enlarged cross-sectional view showing the state before opening the outer container of the double pressurized container of FIG. 31A.
FIG. 32B is a main part enlarged cross-sectional view showing the state after opening the outer container of the double pressurized container of FIG. 31A.
Figure 32:
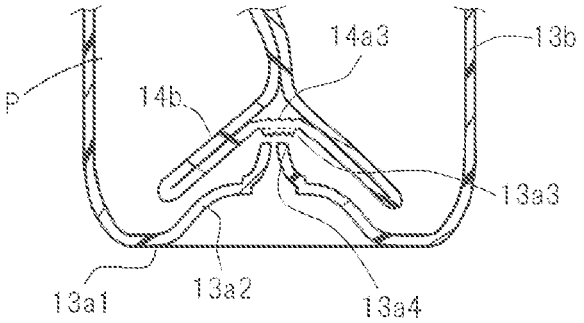

When the discharge member 12 is mounted as shown in FIG. 31, the aforementioned openable seal part 15*d* is opened. Accordingly, when the user pushes the operation button 23 mounted to the stem 22, the stem 22 is lowered and the stem rubber 26 is bent, so that the stem hole opens. Since the concentrate C inside the concentrate chamber Sc is pressurized by the pressurizing agent P via the inner container 14, the concentrate is discharged to the outside via the seal opening part 27 of FIG. 11B, the housing 24, the stem 22, and the operation button 23. When a finger releases from the operation button 23, the stem 22 is raised so as to stop the discharge. The pressurizing agent chamber Sp in which the pressurizing agent P is charged is closed by the plug 15, and it does not communicate with the outside or the concentrate chamber Sc, so that the pressurizing agent P does not leak to the outside by the discharging operation.

When the amount of the concentrate C inside the inner container 14 becomes smaller, the inner container 14 becomes to be contracted radially inward. And, after discharging almost all, as shown in FIG. 31, the walls of the body part 14*b* of the inner container 14 are tightly contacted to each other, and become flat. Further, the bottom part 14*a* of the inner container 14 is pulled up upwardly. Accordingly, the center of the bottom part 13*a* of the outer container 13 which is joined at the joint parts 13*a*3, 14*a*3 is also pulled up upwardly. Finally, the periphery of the joint part 13*a*3 of the outer container 13 is broken, and it is moved upward while jointing with the joint part 14*a*3 of the inner container 14. Therefore, a hole is opened at the bottom part 13*a* of the outer container 13, and the pressurizing agent P inside the pressurizing agent chamber Sp is discharged from the hole (see FIG. 32B).

Note that as to the joint parts 13*a*3, 14*a*3 which are formed by pushing up by the stick 60, etc. at the time of the blow molding, or right after that, the thickness of the rising part 13*a*4 around the joint parts is thin. Accordingly, when the inner container 14 is contracted, the periphery of the joint part 13*a* of the outer container 13 is easily broken. Note that in the case in which the joint part 14*a*3 of the inner container 14 is broken and attached to the outer container 13 side, the pressurizing agent P can be discharged via the valve 21 by pushing the operation button 23. In the state in which the pressurizing agent P is discharged from the container body 16 as described above, the cap 20 is turned, and the discharge member 12 is removed. And, the removed discharge member 12 is mounted to a new pressurized product 11*a*. The empty double pressurized container 11 can be safely recycled as a synthetic resin.

Since the double pressurized container 11 of the present invention as described above breaks the outer container 13 by using the deformation of the inner container 14 as shown in FIGS. 32A and 32B and the pressurizing agent P is discharged, a spike (see reference numeral 15*e* of FIG. 2C) is not required to perforate the inner container. Accordingly, there is no risk that a worker or a user is injured. Further, addition parts are not required, so that a low cost can be realized.

In the above, the preferable embodiments of the present invention were described. However, the present invention is not limited to the aforementioned embodiments, and various modifications may be made within the scope of the present invention. For example, a thin part such as a V-groove, etc. is provided at the periphery of the joint part 13*a*3, so that the periphery of the joint part 13*a*3 is easily broken. Such thin part can be formed by providing an annular edge at the upper end of the stick 60 of FIG. 33. Further, other than that the joint parts 13*a*3, 14*a*3 are thermally bonded to each other, they may be adhered by an adhesive agent. Note that other than the bottom part, the joint part can be formed at the body part, the shoulder part, etc. In the aforementioned embodiments, it is the double pressurized container in which the container body 16 is sealed by the plug 15 and the valve is not provided. However, in the present invention, the double pressurized container (discharge device) in which the container body 16 is sealed by the valve 21 can be applied.

Figure 34:
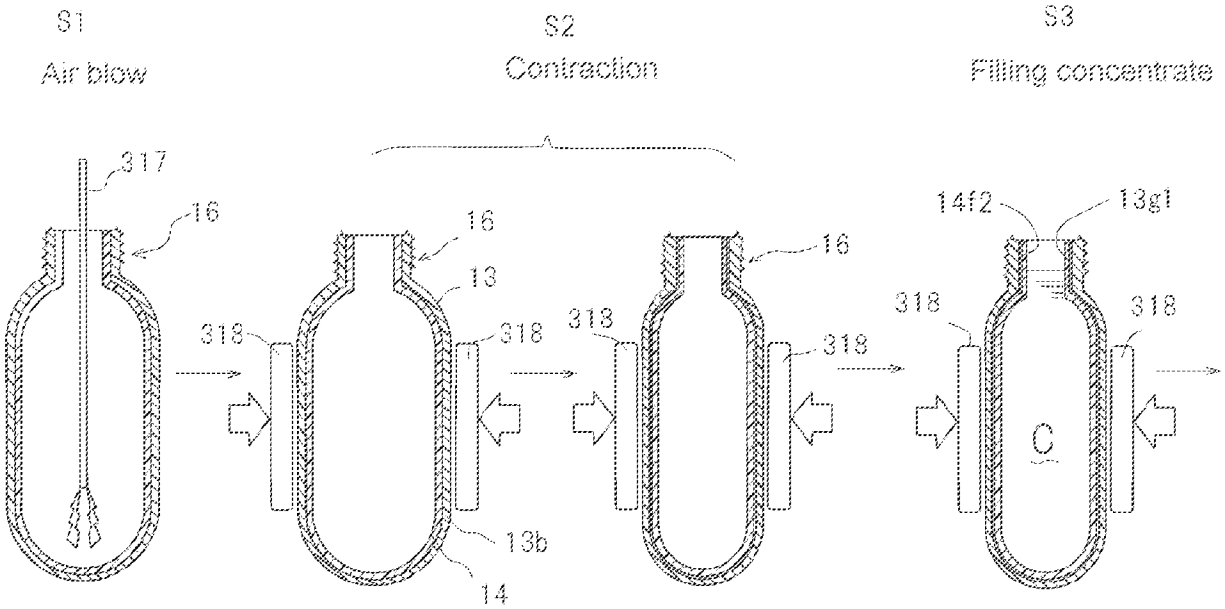
FIG. 34 is a partial process diagram showing one embodiment of the manufacturing method of the present invention.

Next, with reference to FIGS. 34 and 35, the manufacturing method of the double pressurized product 10 will be described. In this method, first, in the inside of the double container body 16 molded by the blow molding from the double preform as described above, the air nozzle 317 is inserted, and the inside is cleaned by the air blow (air blow step S1). Next, the body part 13*b* of the outer container 13 is pinched by the clamp member 318 from the both sides and is compressed, and the external force of compression is transmitted to the inner container 14, and the internal volume of the double container body 16 is contracted (contraction step S2). At this point, it is contracted so that a head space does not occur inside the inner container 14, that is, the volume corresponding to the head space is reduced when charging the concentrate C.

While maintaining the compressed state, the concentrate C is charged in the inner container 14 (concentrate charging step S3). The concentrate C is preferably charged at an amount such that the bottom part of the plug 15 contacts to the concentrate C and no vacant space remains when mounting the plug 15. With this, at the time of welding the plug 15, the openable seal part 15*d* is cooled by the concentrate C so as not to be melted. Further, by not leaving or reducing the vacant space, the discharge becomes smooth.

The concentrate C includes goods for human body such as skin supplies such as face cleansers, detergents, bath agents, moisturizers, cleansing agents, sunscreens, skin lotions, shaving agents, refreshing agents, antiperspirants, sterilizing disinfectants, pest repellents, etc., hair supplies such as treatment agents, styling agents, hair dyeing agents, etc., goods for foods such as whipped cream, olive oil, etc., goods for household such as deodorants, fragrances, insect repellents, insecticides, pollen removers, herbicides, liquid fertilizer, etc. However, it is not limited to these uses.

Figure 35:
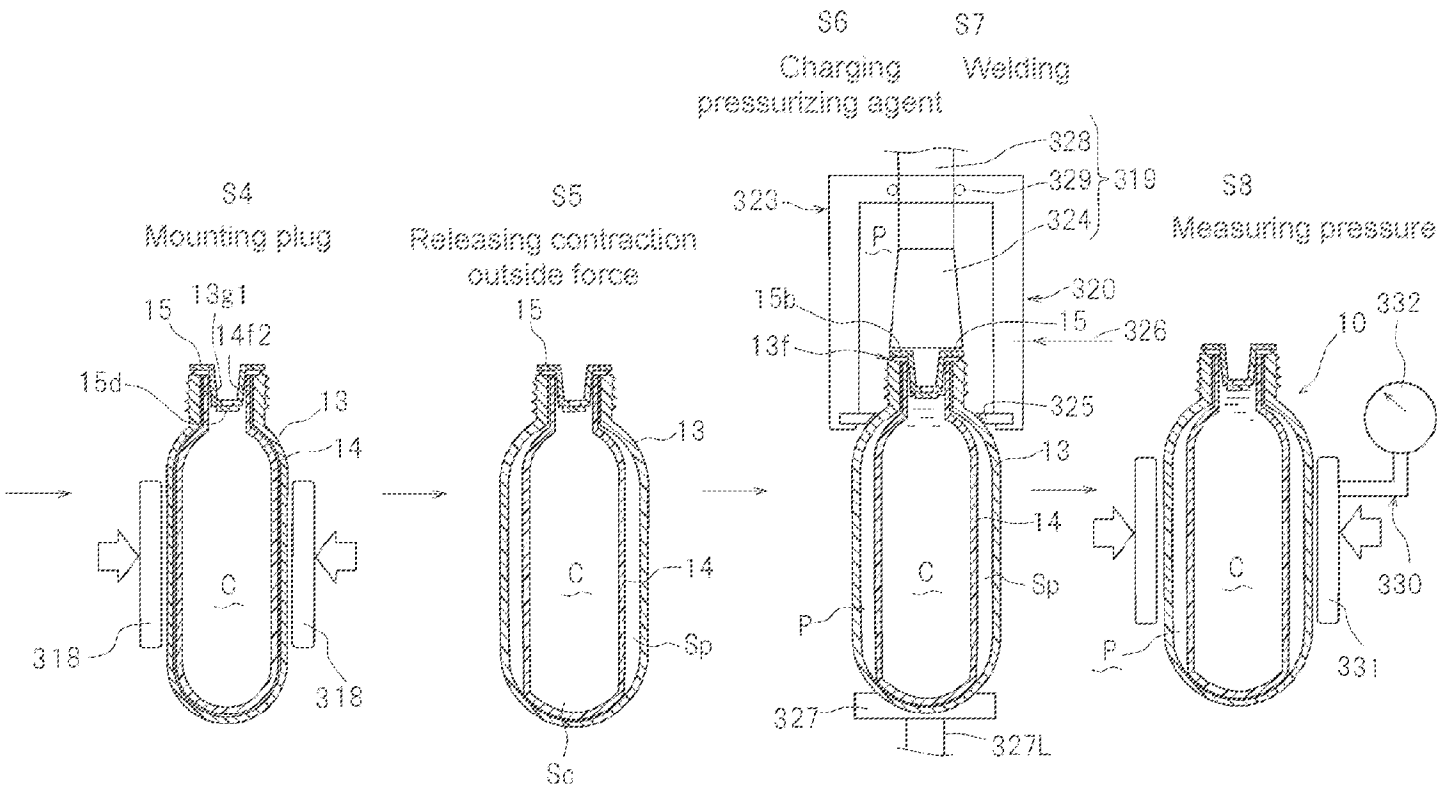
FIG. 35 is a partial process diagram continued from FIG. 34.

Next, as shown in FIG. 35, the plug 15 is mounted airtight to the mouth 14*f*2 of the inner container 14 while maintaining the pressurized state, and the inner container 14 is sealed (plug mounting step S4). Next, the clamp member 318 opens and releases the compression of the outer container 13. With this, the outside air enters between the outer container 13 and the inner container 14, and the outer container 13 is elastically returned to the original shape (external force release step S5). On the other hand, since the concentrate C is charged and the inner container 14 is sealed by the plug 15, even when the compression force (outside force to compress) by the clamp member 318 is released, it does not return to the original shape, and it maintains the contracted state. Therefore, the outer container 13 and the inner container 14 which are blow molded from the double preform are smoothly separated, and the pressurizing agent chamber Sp is formed therebetween.

Next, the outer container 13 and the inner container 14 are set to the pressurizing agent charging device 320 which is provided with an ultrasonic wave welding machine 319, and the pressurizing agent chamber Sp is filled with the pressurizing agent P by an undercup charging (pressurizing agent charging step S6), and next, the plug 15 is fixed to the outer container 13 and the inner container 14 by the ultrasonic wave welding by the ultrasonic wave welding machine 319 (welding step S7). The pressurizing agent charging device 320 is provided with a cylindrical charging tool 323 opening downward, and a horn H for ultrasonic wave welding which closes the upper part opening of the charging tool 323 and which can be raised and lowered inside the charging tool 323.

At the lower end of the charging tool 323, an annular seal material 325 abutting to the shoulder part 13*c* of the outer container 13 is provided. At the charging tool 323, a pressurizing agent supply pipe 326 is connected. In the pressurizing agent charging device 320, the charging tool 323 and the outer container 13 are placed close to each other in an axial direction, and it provides a mechanism to press each other. Such pressing mechanism is constituted with a mechanism for lifting the charging tool 323 or a lifting mechanism 327L for lifting a support tray 327 which supports the outer container 13. The ultrasonic wave welding machine 319 is provided with the lifting mechanism 328 for lifting the aforementioned horn H, and the annular seal material 329 which allows sliding is provided between the lifting mechanism 328 and the charging tool 323.

When charging the pressurizing agent P, first, the charging tool 323 and the outer container 13 are brought close to each other, and the space between the charging tool 323 and the outer container 13 is sealed by the seal material 325 of the lower part of the charging tool 323. Next, the pressurizing agent P is supplied to the charging tool 323 from the pressurizing agent supply pipe 326. With this, the pressurizing agent P is undercup-charged to the pressurizing agent chamber Sp through the space between the upper end of the neck part 13*d* of the outer container 13 and the flange 15*b* of the plug 15, the space between the seal opening member 13*g*1 of the outer container 13 and the seal opening member 14*f*2 of the inner container 14, and further, through a passage between the neck part 13*d* of the outer container 13 and the neck part 14*d* of the inner container 14 (pressurizing agent charging step S6).

As the pressurizing agent P, it is preferable to include compressed gas such as nitrogen gas, compressed air, carbon dioxide, nitrous oxide gas, etc. The pressure inside the double pressurized container by the pressurizing agent is 0.1 to 0.5 MPa (25° C., gauge pressure), and particularly, it is preferably 0.3 to 0.5 MPa (25° C., gauge pressure) which is almost the same pressure as carbonated drink. Further, the capacity of the outer container 13 is preferably 30 to 500 ml. The capacity of the concentrate chamber Sc is preferably approximately 20 to 300 ml. The capacity of the pressurizing agent chamber Sp is preferably approximately 10 to 200 ml.

After charging the pressurizing agent P, while maintaining the sealing by the seal material 325, the horn 324 is lowered, and the ultrasonic vibration is transmitted to the horn 324 in the state in which the plug 15 is pressurized downwardly. With this, the flange 15*b* of the plug 15 is welded to the upper end surface 13*f* of the neck part 13*d* of the outer container 13, and the upper end surface 14*e* of the neck part 14*d* of the inner container 14 by the ultrasonic wave welding (welding step S7). Accordingly, the double pressurized product 10 is obtained.

After welding, the double pressurized product 10 is taken out from the pressurizing agent charging device 320 by lifting the charging tool 323 or lowering the support tray 327. Next, by the pressure measuring device 330 detecting an internal pressure of the double pressurized product 10, it confirms whether the internal pressure is within a predetermined range (pressure measuring step S8). The pressure measuring device 330 is provided with a grip 331 pressurizing the body part 13*b* of the outer container 13, a load cell 332 detecting a pressure force by the grip, and a sensor detecting a deformation amount of the body part 13*b*, and the internal pressure is measured based on the calibration curve of the deformation amount and the pressure force.

In the manufacturing method of the aforementioned double pressurized product, after charging the concentrate C in the inner container 14, the inner container 14 is tightly closed by the plug 15, and it allows the outer container 13 to be elastically returned by releasing the clamping force (external force) of the clamp member 318. Accordingly, the outer container 13 and the inner container 14 can be smoothly separated, and the pressurizing agent chamber Sp can be easily formed.

Next, another embodiment of the manufacturing method of the double pressurized product of the present invention will be described with reference to FIG. 36. First, the inside of the double container body 16 is cleaned by air blow (air blow step S1). Next, the concentrate C is charged to the inner container 14 (concentrate charging step S11). Next, the body part 13*b* of the outer container 13 is sandwiched and pressurized from the both sides by the clamp member 318, and the volume of the inner container 14 is contracted (contraction step S12). At this point, it is contracted so as not to include a head space Hs inside the inner container 14, that is, to reduce the volume corresponding to the head space.

Figure 3:
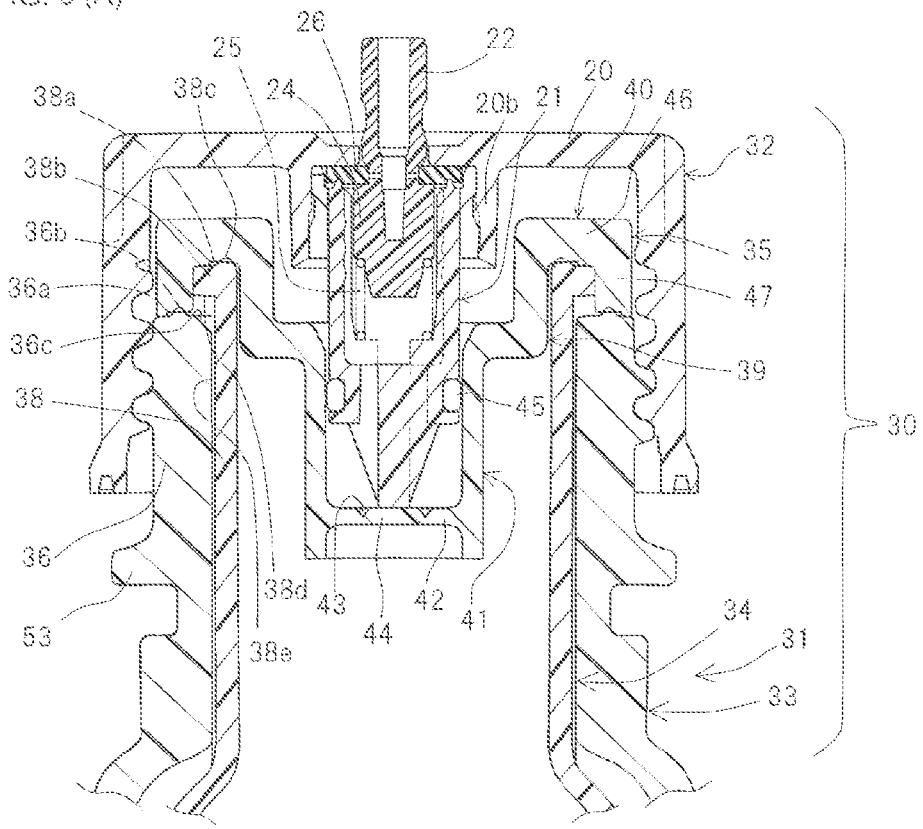
FIG. 3A is a main part cross-sectional view showing another embodiment of the discharge device of the present invention before it is opened.
FIG. 3B is a main part cross-sectional view showing another embodiment of the discharge device of the present invention after it is opened.
Figure 3:
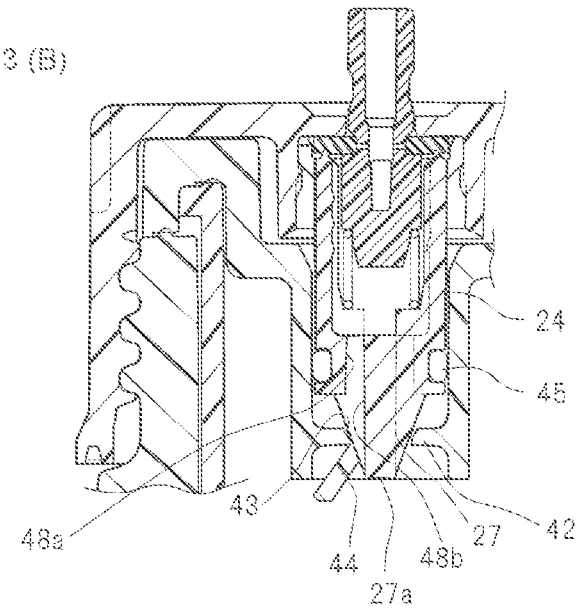

After that, it is similar to the aforementioned embodiments, and it performs the plug mounting step S4 in which the plug 15 is air-tightly mounted to the mouth of the inner container 14 while maintaining the pressurized state as shown in FIG. 3, and seals the inner container 14, and the external force release step S5 in which the clamp member 318 is opened and the compression of the outer container 13 is removed. Further, it performs in the order of the charging pressurizing agent step S6 in which the pressurizing agent P is undercup-charged to the pressurizing agent chamber Sp, the welding step S7 in which the plug 15 is fixed to the outer container 13 and the inner container 14 by the ultrasonic wave welding, and the pressure measuring step S8.

Figure 36:
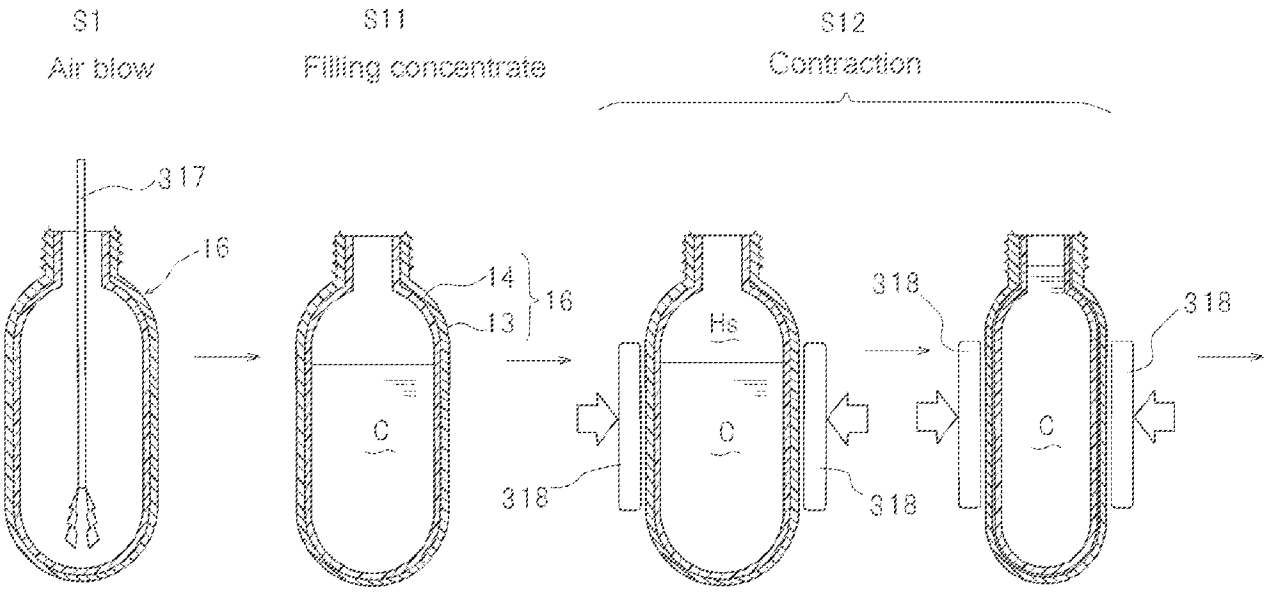
FIG. 36 is a process diagram showing another embodiment of concentrate charging step.

In the manufacturing method of FIG. 36, the concentrate C is charged, and the contracted inner container 14 is tightly closed by the plug, and the clamping force to the outer container 13 is released, so that the outer container 13 and the inner container 14 can be smoothly separated.

Figure 37:
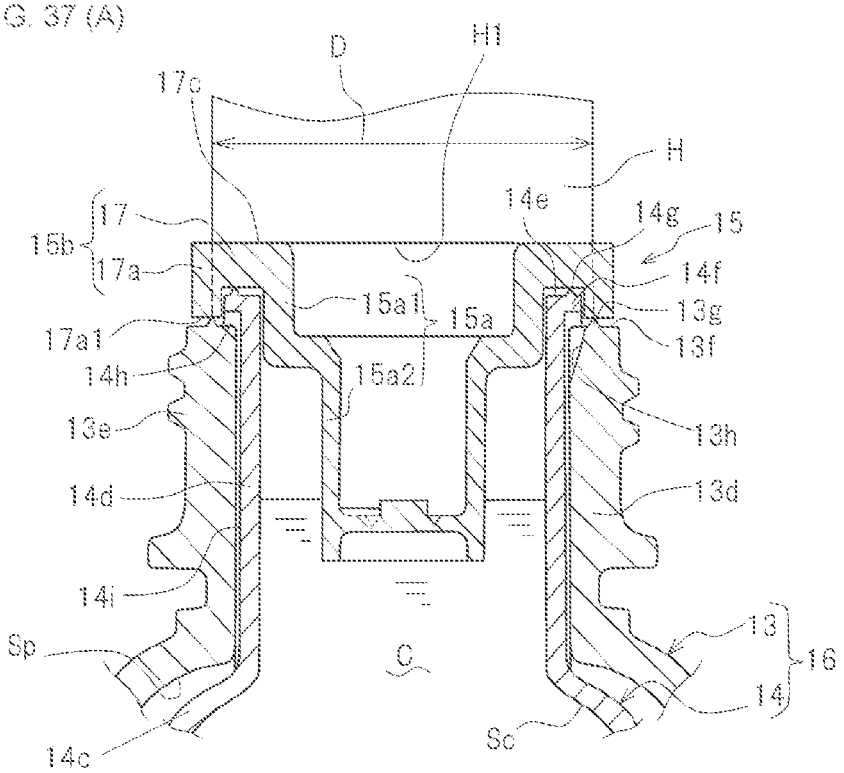
FIG. 37A is a main part cross-sectional view showing one embodiment of a plug welding step related to the present invention.
FIG. 37B is a cross-sectional view showing the state after the welding.
Figure 37:
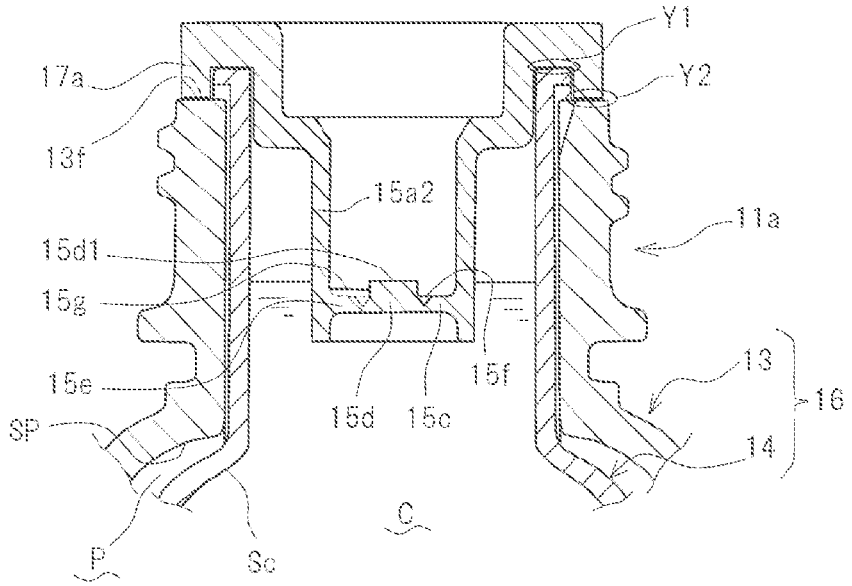

Next, with reference to FIGS. 37A to 39, the technology in which after sealing by the plug 15, a head space is minimized by absorbing the gas at the gas-phase into the concentrate will be described. FIG. 37A shows the state in which the plug 15 is put on the container body 16. At the top surface 17*c* of the plug 15, the horn for ultrasonic wave welding 324 is abutted. The welding of the plug 15 is not done yet. At this time, the concentrate C is charged in the concentrate chamber Sc, but the pressurizing agent P is not charged in the pressurizing agent chamber Sp. At the upper end surface 13*f* of the neck part 13*d* of the outer container 13, the annular projection 13*g* is formed so that the welding is facilitated by increasing the contact pressure with the plug 15 at the time of the ultrasonic wave welding, and to provide a welding part (reference numeral Y2 in FIG. 37B) so as to be integrated with the plug 15. The annular projection 13*g* is an approximately triangular shape in cross section, and particularly, it is an isosceles triangle or an equilateral triangle.

In this embodiment, the annular projection 13*g* is provided approximately at the center in the thickness range of the neck part 13*d*. The annular projection can be provided at the plug 15 side, and the upper end surface 13*f* of the neck part 13*d* can be flat. A plurality of the inclined parts 13*h* is provided at the inner side of the upper end surface 13*f*, and it is used as a space to store the resin piece (welding waste), which is made by cooling the melted resin at the time of the ultrasonic wave welding, so that it is not projected.

As shown in FIG. 37A, the upper part of the neck part 14*d* of the inner container 14 is projected higher than the upper end surface 13*f* of the outer container 13, and the flange 14*f* engaging with the upper end surface 13*f* of the outer container 13 is formed at the projection part. The thickness of the flange 14*f* (dimension of the radial direction) is approximately ⅓ to ½ of the thickness of the neck part 13*d* of the outer container 13. Accordingly, when the flange 14*f* is locked to the upper end surface 13*f* of the neck part 13*d* of the outer container 13, at the upper end surface 13*f* of the neck part 13*d* of the outer container 13, the outside part is not covered and it remains. The annular projection 13*g* of the upper end of the outer container 13 is provided at the outside part. Also, at the upper end surface 14*e* of the neck part 14*d* of the inner container 14, an annular projection 14*g* is formed to provide a welding part (reference numeral Y1 of FIG. 37B) with the plug 15 by increasing the contact pressure with the plug 15 at the time of the ultrasonic wave welding. In this embodiment, this annular projection 14*g* is also an approximately triangular shape in cross section, and particularly, it is an isosceles triangle or an equilateral triangle.

At the lower surface of the flange 14*f* of the inner container 14, a horizontal groove 14*h* for charging pressurizing agent which extends in the radial direction is formed at four sections at an equal interval. Further, at the outer periphery surface of the neck part 14*d* of the inner container 14, a vertical groove 14*i* communicating with the horizontal groove 14*h* is formed. The vertical groove 14*i* is extended to the upper end of the shoulder part 14*c* from the horizontal groove 14*h*, and with this, the pressurizing agent P is easily charged inside the pressurizing agent chamber Sp.

Both the outer container 13 and the inner container 14 are made of synthetic resins, and particularly, made of thermoplastic resin such as polyethylene terephthalate, polyethylene naphthalate, polyethylene, polypropylene, etc. For the inner container 14, it is preferable to have gas permeability permeating the pressurizing agent P or gas G inside the inner container 14. With these materials, for example, they can be manufactured by inserting a preform for the inner container into a preform for the outer container, and by blow-molding the parts lower than the lower ends of the neck parts 13*d*, 14*d* at the same time. Specifically, it is preferable to use an injection blow molding method in which a predetermined shaped preform is provided by performing injection molding and next, performing blow molding.

The plug 15 is provided with the bottomed cylindrical shaped seal part 15*a* inserted inside the neck part 14*d* of the inner container 14, and the annular flange 15*b* which continues to the upper end of the seal part. The upper part of the seal part 15*a* is the inner cylindrical part 15*a*1 fitting to the inner surface of the neck part 14*d* of the inner container 14 with a space, and the lower part is the valve housing part (fitting cylindrical part) 15*a*2 which stores the valve 21 of the discharge member 12 detachably, and fits with the valve 21 via a seal material (reference numeral 28 of FIG. 1). The valve housing part 15*a*2 has a smaller diameter than the inner cylindrical part 15*al*.

The flange 15*b* of the plug 15 is provided with the flat part 17 expanding radially outward from the upper end of the seal part 15*a*, and the outer cylindrical part 17*a* extending downward from the outer edge of the flat part 17. The lower surface 17*b* of the flat part 17 is a part which abuts to the upper end surface 14*e* of the neck part 14*d* of the inner container 14, particularly to the annular projection 14*g*, to form a welding part (reference numeral Y1 of FIG. 37B) and to be sealed. The lower surface 17*a*1 of the outer cylindrical part 17*a* is a part which abuts to the upper end surface 13*f* of the neck part 13*d* of the outer container 13, particularly, the annular projection 13*g*, to form a welding part (reference numeral Y2 of FIG. 37B) abutting to and to be sealed. The welding part Y1 of the inner container 14 seals the space between the concentrate chamber Sc and the pressurizing agent chamber Sp. The welding part Y2 of the outer container 13 seals the space between the pressurizing agent chamber Sp and the outer part. The top surface 17*c* of the flat part 17 (top surface of flange 15*b*) is an abutting surface with the horn H oscillating the ultrasonic vibration of the ultrasonic wave welding machine. The horn H is formed in a cylindrical shape, and the lower surface H1 of the horn is flat.

Figure 38:
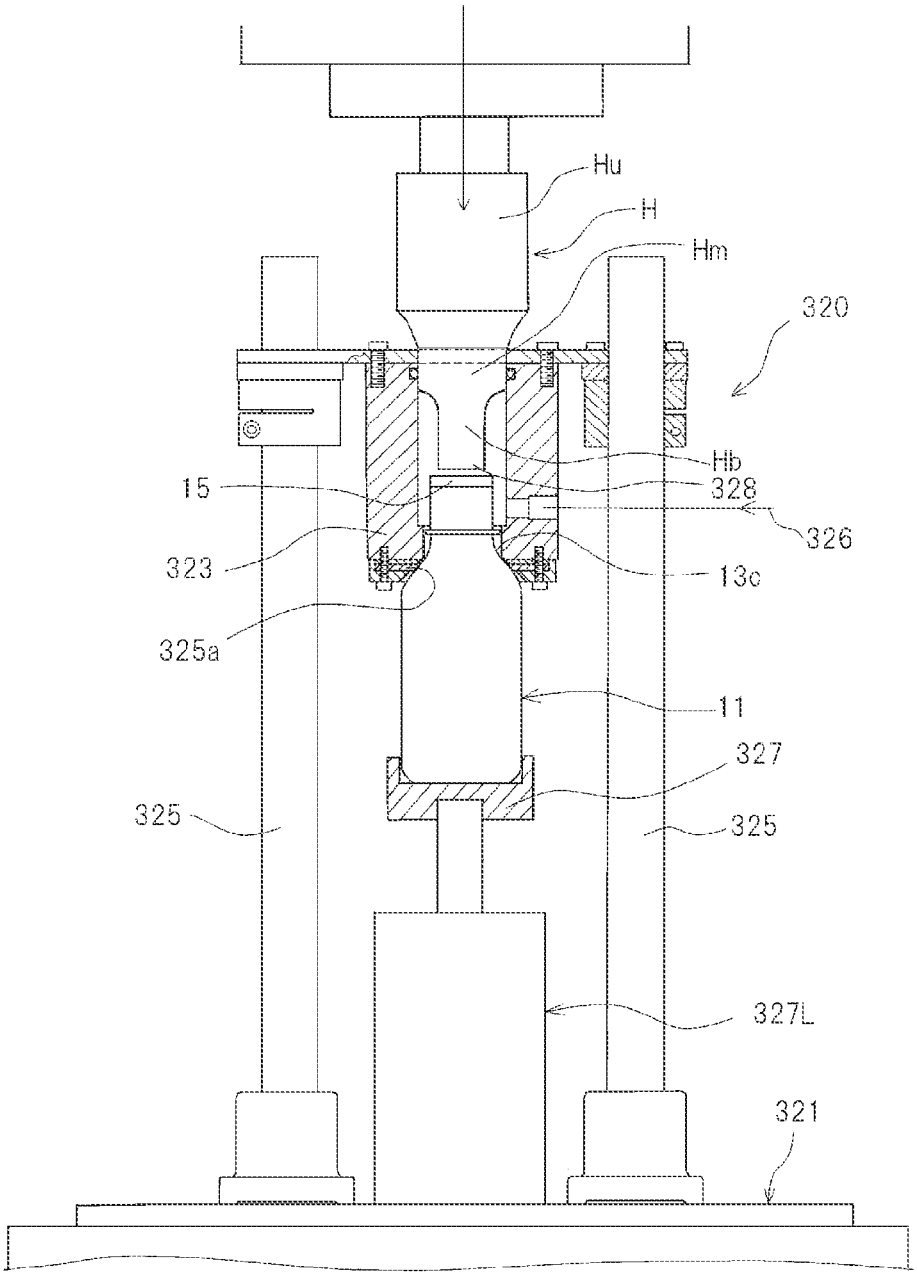
FIG. 38 is a partial cross-sectional front view showing the pressurizing agent charging device used in the manufacturing method of the present invention.

After charging the concentrate C to the concentrate chamber Sc inside the inner container 14, and covering the plug 15 to the opening of the container body 16, the ultrasonic wave welding of the plug 15 can be done by the pressurizing agent charging device assembled with the horn H for welding (see reference numeral 330 of FIG. 38). The ultrasonic wave welding is done after undercup charging the pressurizing agent P to the pressurizing agent chamber Sp between the outer container 13 and the inner container 14.

After welding, as shown in FIG. 37B, the lower surface 17*a*1 of the outer cylindrical part 17*a* is welded with the upper end surface 13*f* of the outer container 13, and the lower surface 17*b* of the flat part 17 is welded with the upper end surface 14*e* of the inner container 14, and it becomes the pressurized product 11*a*. And, as described above, the melted resin is not projected to the outer part from the space between both. Further, since two welding parts Y1, Y2 are continuously and sufficiently formed by welding, the pressurizing agent P is not leaked from the pressurizing agent chamber Sp for a long time, and the concentrate C is not leaked from the concentrate chamber Sc. The resin projecting inwardly at the time of welding is stored in the inclined part (inclined groove) 13*h*, and does not flow into the pressurizing agent chamber Sp.

In a case in which the gas (particularly, gas in the head space Hs which will be described later) G inside the inner container 14 is substituted to another gas, as the substitute gas R, the one satisfying the following relationship with the concentrate C is chosen. It is preferable that the solubility with respect to 1 ml of the concentrate under 1 atm at 25° C. is higher than air, and for example, it is equal to or more than 0.02 ml, and particularly, it is equal to or more than 0.05 ml. When the solubility is high, the substitute gas R which is the gas G inside inner container 14 is quickly dissolved to the concentrate C, so that the gas-phase is easily disappeared, and the pressure of the pressurized product 11*a* can be stabilized in a short period of time.

For example, in the case in which the concentrate C includes equal to or more than 70 mass % of water, the substitute gas R may be soluble compressed gas (carbon dioxide, nitrous oxide) or mixed gas of soluble compressed gas and low solubility gas (compressed air, oxygen, nitrogen, hydrogen), and the gas in which the dissolved amount with respect to 1 ml of the concentrate under 1 atm at 25° C. is 0.02 ml, and it is preferably equal to or more than 0.05 ml, is used.

As the concentrate C including water which is equal to or more than 70 mass %, for example, it can be human body goods such as skin lotions, shaving (foam, gel, post-foaming gel, cream), hand cream, hand soap, body soap, face cleanser, shampoo, hair treatment, hair color, infusion, etc., miscellaneous goods such as pollen adhesion inhibitor, etc. to inhibit pollen adhesion to such as clothing or mask, etc., household goods such as indoor deodorants/fragrances, pollen removers, contact lens cleaners, bath agents, gardening fertilizers, gardening insecticide, etc., and foods such as seasonings, dietary supplements, beverages, whipped cream, etc. However, it is not limited to these uses.

For example, in the case in which the concentrate C includes equal to or more than 20 mass % of alcohol or oil, the substitute gas R includes compressed gas such as carbon dioxide, nitrous oxide, oxygen, nitrogen, hydrogen, etc., vaporized gas of liquefied gas such as liquefied petroleum gas, dimethyl ether, hydrofluoroolefin, etc., and mixed gas thereof, and the gas, in which the dissolved amount with respect to 1 ml of the concentrate under 1 atm at 25° C. is equal to or more than 0.02 ml, and preferably, it is equal to or more than 0.05 ml, is used. In the case in which the concentrate C includes equal to or more than 20 mass % of alcohol or oil, the dissolved amount of the air with respect to 1 ml of the concentrate under 1 atm at 25° C. is also equal to or more than 0.02 ml (equal to or more than 0.05 ml). Accordingly, it does not necessarily substitute the air in the head space Hs to another gas.

As the concentrate which includes equal to or more than 20 mass % of alcohol, for example, it includes human body goods such as hair sprays, sunscreens, antiperspirants, coolants, hand sterilizing disinfectants, pest repellents, etc., household goods such as indoor deodorant/fragrances, sterilizing disinfectants, etc., and batteries such as fuel cell, etc. However, it is not limited to these uses.

As the concentrate which includes equal to or more than 20 mass % of oil, for example, it includes human body goods such as cleansings, sunscreens, etc., household goods/industrial supplies such as lubricants, etc., and edible oil such as olive oil, soybean oil, corn oil, safflower oil, sunflower oil, sesame oil, rice bran oil, etc. However, it is not limited to these uses.

The concentrate C is preferably attached to the inner surface side of the openable seal part 15*d*. With this, when the plug 15 is welded to the container body 16, the openable seal part 15*d* is cooled by the concentrate C. Therefore, the problem such that the openable seal part 15*d* is melted by heat can be solved.

As the pressurizing agent P, it is preferably compressed gas having low solubility in which the solubility is lower than the gas G (substitute gas R) inside the inner container 14 such as nitrogen, compressed air, oxygen, hydrogen, etc. Further, the pressure inside the pressurized container 11 by the pressurizing agent P is 0.2 to 0.6 MPa (25° C., gauge pressure), and particularly, it is preferably 0.3 to 0.5 MPa (25° C., gauge pressure) which is almost the same pressure as carbonated drink.

Note that in the case in which the pressurizing agent P permeates the inner container 14, and is dissolved to the concentrate C, it is preferable to use, as a pressurizing agent P, the soluble compressed gas such as carbon dioxide, nitrous oxide, etc., or mixed gas of the soluble compressed gas and the low solubility gas (compressed air, oxygen, nitrogen, hydrogen), which is higher solubility than the gas G inside the inner container 14, particularly than air. Specifically, the gas, in which the solubility with respect to 1 ml of the concentrate under 1 atm at 25° C. is equal to or more than 0.02 ml, and it is preferably equal to or more than 0.05 ml, is used. Further, the pressurizing agent P is charged to be the pressure of 0.2 to 0.6 MPa (25° C., gauge pressure) in the saturated dissolution state.

The capacity of the outer container 13 is preferably 30 to 500 ml. The capacity of the inner concentrate (concentrate chamber Sc) 14 is preferably approximately 20 to 300 ml. The capacity of the pressurizing agent chamber Sp is preferably approximately 10 to 200 ml.

Next, with reference to FIG. 38, one example of the pressurizing agent charging device used for charging the aforementioned pressurizing agent P and welding will be described. The pressurizing agent charging device 320 of FIG. 38 is provided with a base 321, a support tray (lifting platform) 327 provided at the base 321, a cylindrical charging tool 323 arranged at the upper side of the lifting platform 327, and the horn H for ultrasonic wave welding which closes the upper opening of the charging tool 323 and which is provided inside the charging tool 323 in a vertically movable manner. The charging tool 323 is height adjustably supported by two columns which are stood from the base 321. At the lower end of the charging tool 323, a seal material 325 is provided and air-tightly abuts to the shoulder part 13*c* of the outer container 13. The horn H is mounted to the ultrasonic oscillator via the lifting mechanism which is provided with a drive source such as a fluid cylinder or an electric motor, etc. The support tray 327 is also height adjustably supported by the lifting device 327L.

The middle part Hm of the horn H is set to be fitted with the internal diameter of the charging tool 323 in a vertically sliding manner while sealing the inside of the aforementioned charging tool 323. Further, the horn H is reduced in diameter from the upper part Hu to the middle part Hm in order to amplify the vibration energy from the ultrasonic oscillator toward the lower side, and in addition, it is reduced in diameter from the middle part Hm to the lower part Hb. Accordingly, near the lower end 328 becomes the smallest diameter.

Figure 39:
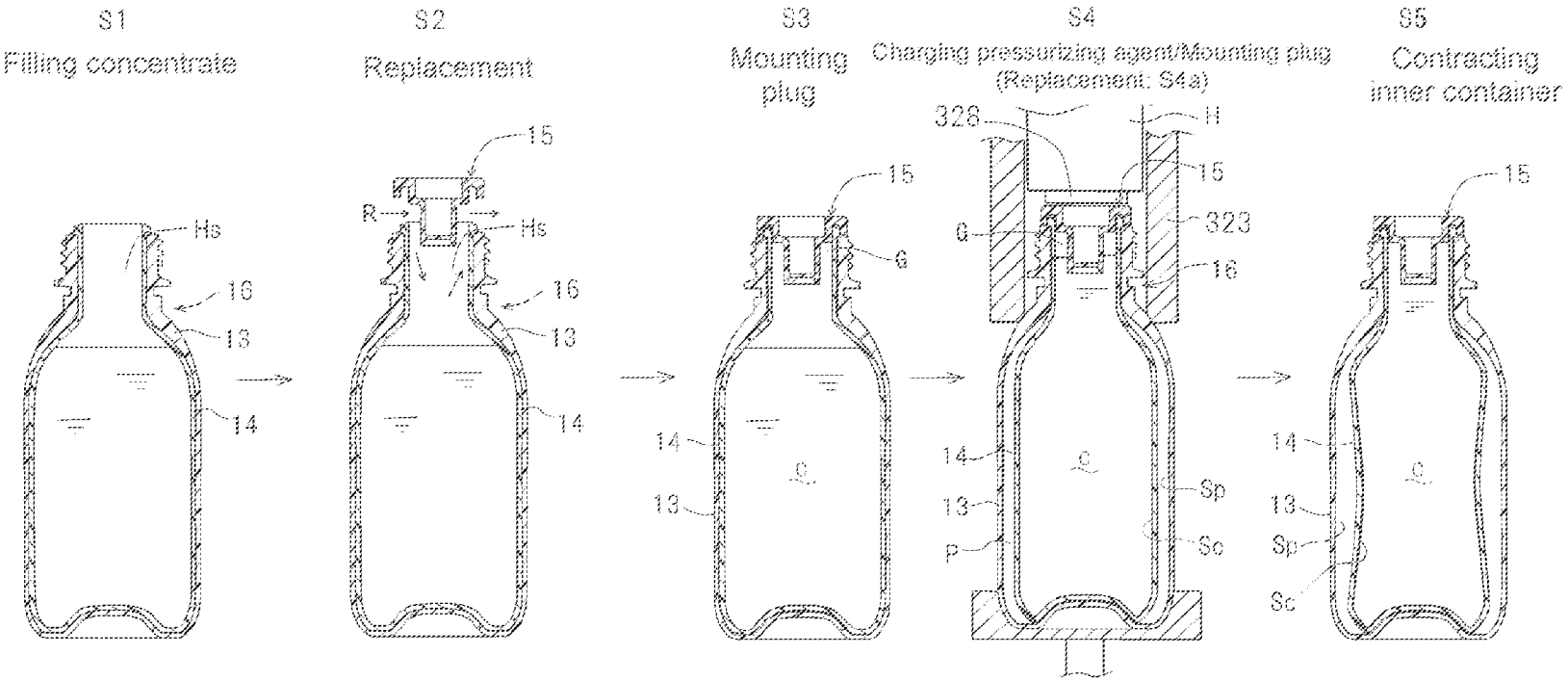
FIG. 39 is a schematic process diagram showing one embodiment of the manufacturing method of the pressurized product of the present invention.

The manufacturing method of the pressurized product 11*a* shown in FIG. 39 includes the concentrate charging step S1, the replacement step S2 in which the gas G inside the inner container 14 is substituted to the substitute gas R, the plug mounting step S3 in which the substitute gas R is confined by the plug 15, the pressurizing agent charging and plug welding step S4, and the inner container contraction step S5. In this manufacturing method, first, the container body 16 in which the inner container 14 is mounted to the outer container 13 is prepared. The double container body 16 can be manufactured by the double blow molding. And, when performing the concentrate charging step S1 in which the concentrate C is charged inside the inner container 14, it leaves a space (head space) Hs in which the concentrate C is not charged at the upper part of the inner container 14.

Next, in the replacement step S2, the plug 15 is held in the state that the gas is capable of entering to and leaving from the concentrate chamber Sc, and the substitute gas R which is high solubility to the concentrate C is charged from the space between the opening of the inner container 14 and the plug 15, and the air in the head space Hs inside the inner container 14 is discharged outside, and the gas G inside the inner container 14 is replaced to the substitute gas R (replacement step). Particularly, it is preferable to replace to the gas which is higher in solubility to the concentrate C than the pressurizing agent P.

Next, in the plug mounting step S3, the plug 15 is put on the opening of the container body 16, and the replaced gas is confined inside the head space Hs. By using gas in which the density (molecular weight) is larger than air, it is easily confined inside the head space Hs.

Next to the plug mounting step S3, the pressurizing agent charging and plug welding step S4 in which the pressurizing agent P is charged to the pressurizing agent chamber Sp between the inner container 14 and the outer container 13, and the plug 15 is welded and fixed to the opening of the inner container 14 and the opening of the outer container 13 is performed. In this step, the pressurizing agent P is charged into the pressurizing agent chamber Sp through the space between the plug 15 and the outer container 13 (undercup charging). After that, the plug 15 is welded to the outer container 13 and the inner container 14 and it is sealed. In this step, for example, the pressurizing agent charging device 320 of FIG. 38, etc. can be used, and the welding method of FIG. 37A can be employed. Accordingly, the welding waste hardly leaks outside, and the sealability between the plug 15 and the outer container 13 is enhanced so as to reduce the leakage, and the pressurized product 11*a* having an excellent appearance can be obtained.

Note that in the case in which the solubility of the pressurizing agent P to the concentrate C is higher than air inside the head space Hs, the pressurizing agent P easily permeates the inner container 14 to be dissolved to the concentrate C, so that the replacement step S2 is not required.

Further, when the pressurizing agent P is charged, the pressurizing agent P may be charged inside the head space Hs. That is, in this step, the air inside the head space Hs can be replaced with the pressurizing agent P (replacement step S4*a*). In this case, the substitute gas R is the pressurizing agent P, and the gas G inside the inner container 14 is the pressurizing agent P.

Note that the inner container 14 may be heat-contracted by charging wormed concentrate C in the concentrate charging step S1, or the inner container 14 may be heat-contracted by blowing heat air before the concentrate charging step S1. After that, the concentrate C is charged. Further, the inner container 14 may be contracted by vacuuming air inside the inner container 14, or the pressurizing agent or the compressed air is charged into the pressurizing agent chamber Sp between the outer container 13 and the inner container 14, so that the inner container 14 is contracted by pressurizing from the outside. When the inner container 14 and the outer container 13 are manufactured by the double blow molding, etc., the inner container 14 and the outer container 13 are tightly attached, so that the pressurizing agent chamber Sp is small and it is hardly filled. With this, when the pressurizing agent chamber Sp is formed by contracting the inner container 14 before charging the pressurizing agent P, it becomes easier to charge the pressurizing agent P. Further, by dissolving the gas which will be described later, it becomes easier to contract the inner container 14.

When completing the plug welding step S4, the pressure inside container body 16 becomes high, so that the gas G inside the head space Hs is compressed, and further, it is dissolved to the concentrate C. Alternatively, since the pressurizing agent P of the pressurizing agent chamber Sp permeate into the inside of the inner container 14, and the concentrate C is dissolved. Therefore, the air (gas) G inside the head space Hs which could not be dissolved is pushed out from the inner container 14, and the gas-phase becomes small, or it is disappeared. Accordingly, the inner container 14 is gradually contracted. This is the inner container contraction step S5.

In this way, according to the manufacturing method of the pressurized production 11*a* of the present invention, the gas G inside the inner container 14 can be dissolved to the concentrate C, or the gas can be pushed out from the inner container 14, so that forming the gas-phase inside the inner container 14 can be suppressed. Specifically, in the case in which the plug 15 is welded by the ultrasonic wave welding, when the concentrate C is positioned at the vicinity of the welding part, the concentrate C is atomized by the ultrasonic vibration, so that there is possibility that the dissolution of the welding part is inhibited, and the welding becomes insufficient. Therefore, it is necessary to provide the gas-phase inside the inner container 14 to separate the liquid surface of the concentrate C from the welding part, and the gas-phase inevitably occurs in the inner container 14. However, since the inner container contraction step S5 is provided, the gas-phase can be minimized or can be disappeared, so that the stable discharge of the concentrate C can be realized.

Example 1

By using the pressurized container 11 provided with the outer container and the inner container which are made of polyethylene terephthalate (full volume 210 ml of the outer container), 120 g of water is charged as the concentrate C inside the inner container. Next, the air in the head space Hs inside the inner container is replaced to carbon dioxide (solubility to water: 0.76 (25° C., 1 atm)), and it is covered by the plug made of polyethylene terephthalate. Further, nitrogen (solubility to water: 0.014 ((25° C., 1 atm)) is charged as the pressurizing agent P in the pressurizing agent chamber Sp through the space between the outer container and the plug, and the plug is fixed to the container body by the ultrasonic wave welding. The pressure immediately after production is 0.5 MPa. After that, when it is stored at the temperature-controlled room at 25° C., after 1 day, the inner container is contracted and the gas-phase is almost disappeared.

Example 2

By using the pressurized container 11 provided with the outer container and the inner container which are both made of polyethylene terephthalate (full volume 210 ml of the outer container), 120 g of water is charged as the concentrate C inside the inner container. Next, the container body is covered by the plug made of polyethylene terephthalate. Further, carbon dioxide (solubility to water: 0.76 (25° C., 1 atm)) is charged as the pressurizing agent P in the pressurizing agent chamber Sp through the space between the outer container and the plug, and the plug is fixed to the container body by the ultrasonic wave welding. The gas G in the head space Hs inside the inner container is air. The pressure immediately after production is 0.5 MPa. After that, when it is stored at the temperature-controlled room at 25° C., after 1 day, the inner container is contracted and the gas-phase is almost disappeared. Accordingly, in example 2, the replacement steps S2, S4*a* are not required.

Example 3

By using the pressurized container 11 provided with the outer container and the inner container which are both made of polyethylene terephthalate (full volume 210 ml of the outer container), 100 g of ethanol is charged as the concentrate C inside the inner container. Next, the plug made of polyethylene terephthalate is put on the container body. Further, nitrogen (solubility to ethanol: 0.14 (25° C., 1 atm)) is charged as the pressurizing agent P in the pressurizing agent chamber Sp through the space between the outer container and the plug, and the plug is fixed to the container body by the ultrasonic wave welding. The gas G in the head space Hs inside the inner container is air. The pressure immediately after production is 0.5 MPa. After that, when it is stored at the temperature-controlled room at 25° C., after 1 day, the inner container is contracted and the gas-phase is almost disappeared. Accordingly, in example 3, the replacement steps S2, S4*a* are not required.

Example 4

By using the pressurized container 11 provided with the outer container and the inner container which are both made of polyethylene terephthalate (full volume 210 ml of the outer container), 100 g of olive oil is charged as the concentrate C inside the inner container. Next, the plug made of polyethylene terephthalate is put on the container body. Further, carbon dioxide (solubility to olive oil: 1.1 ((25° C., 1 atm)) is charged as the pressurizing agent P in the pressurizing agent chamber Sp through the space between the outer container and the plug, and the plug is fixed to the container body by the ultrasonic wave welding. The gas G in the head space Hs inside the inner container is air. The pressure immediately after production is 0.5 MPa. After that, when it is stored at the temperature-controlled room at 25° C., after 1 day, the inner container is contracted and the gas-phase is almost disappeared. Accordingly, in example 4, the replacement steps S2, S4*a* are not required.

In the above, the preferable embodiments of the present invention were described. However, the present invention is not limited to the aforementioned embodiments, and various modifications may be made within the scope of the present invention. For example, the pressurized product 11*a* may not be produced in the air, but it may be produced in the atmosphere such as carbon dioxide, etc. which is higher solubility with respect to the concentrate than the air. In this case, the replacement steps S2, S4*a* are not required.

The aforementioned pressurized production manufacturing method can be applied to a food production method. That is, in the concentrate charging step S1 of FIG. 39, a food as the concentrate C, particularly, liquid foods, beverages, is charged, and in the pressurizing agent charging step, the gas for food dissolution is employed as the pressurizing agent P, so that the gas-containing food can be obtained as the pressurized product 11*a*. Hereinafter, with reference to FIGS. 37 to 39, the gas-containing food and its manufacturing method will be described.

Same as the combination of the aforementioned pressurized product and the discharge product, the gas-containing food 11*a* is sold as a set of products before assembled with the discharge member 12 or in the state that the discharge member 12 is screwed some amount to the upper end of the gas-containing food 11*a* and in an unopened half-assembled state. The gas-containing food 11*a* is sold with the discharge member 12, and other than that, it may be sold individually as a replacement. In this case, the discharge member 12 is repeatedly used, so that it is resource saving. There is a case that the discharge member 12 may be sold individually.

The pressurized container 11 used for the gas-containing food 11*a* is provided with the outer container 13, the inner container 14 stored inside the outer container and having flexibility, the lid (plug) 15 for sealing the outer container 13 and the inner container 14. The valve or the pump is not provided. Further, the outer container 13, the inner container 14, and the plug 15 are made of the same material. Accordingly, the pressurized container 11 is made of a single material. The combination of the outer container 13 and the inner container 14 is the container body 16. The inside of the inner container 14 is the concentrate chamber Sc to be filled with the concentrate C, and the space between the outer container 13 and the inner container 14 is the pressurizing agent chamber Sp to be filled with the pressurizing agent P (see FIG. 37A). They are sealed by the plug 15. Note that FIG. 4A shows the container body in which the concentrate C and the pressurizing agent P are not charged, and the plug is not welded yet. In this embodiment, the concentrate C and the pressurizing agent P are stored with separated state by the inner container 14, and by mounting the discharge member 12, the concentrate C becomes to a state capable of discharging.

Both the outer container 13 and the inner container 14 are made of synthetic resins, and particularly, made of thermoplastic resin such as polyethylene terephthalate, polyethylene naphthalate, polyethylene, polypropylene, etc. With these materials, for example, a preform for the inner container is inserted into a preform for the outer container, and it can be manufactured by blow-molding the parts lower than the lower ends of the neck parts 13*d*, 14*d* at the same time. Specifically, it is preferable to use an injection blow molding method in which a predetermined shaped preform is provided by performing injection molding and next, performing blow molding.

In the inner container 14, the thickness of the body part 14*b* is 0.05 to 0.3 mm which is made thin by performing the blow molding, so that the pressurizing agent P easily permeates. On the other hand, the thickness of the body part 13*b* of the outer container 13 is equal to or more than 0.35 mm which is made thick by performing the blow molding, so that the strength in which it is not deformed largely by the pressure right after the charging (in the state before the pressurizing agent P is dissolved to the concentrate C) is obtained. Accordingly, the thickness of the body part 13*b* of the outer container 13 is preferably thicker than the thickness of the body part 14*b* of the inner container 14.

The aforementioned plug 15 is, for example, provided with the bottomed cylindrical shaped seal part 15*a* which is inserted inside the neck part 14*d* of the inner container 14 shown in FIG. 5, and the annular flange 15*b* which continues to the upper end of the seal part. The upper part of the seal part 15*a* is the inner cylindrical part 15*a*1 which is fitted to the inner surface of the neck part 14*d* of the inner container 14 with a space. And at the lower part, the valve 21 of the discharge member 12 is detachably stored, and it is the valve housing part (fitting cylindrical part) 15*a*2 which is fitted via the seal material (reference numeral 28 of FIG. 1A). The diameter of the valve housing part 15*a*2 is smaller than the inner cylindrical part 15*al*.

The flange 15*b* of the plug 15 is provided with the flat part 17 expanding radially outward from the upper end of the seal part 15*a*, and the outer cylindrical part 17*a* extending downward from the outer edge of the flat part 17. The lower surface 17*b* of the flat part 17 is a part which abuts to the upper end surface 14*e* of the neck part 14*d* of the inner container 14, particularly to the annular projection 14*g*, to form a welding part (reference numeral Y1 of FIG. 37B) and to be sealed. The lower surface 17*a*1 of the outer cylindrical part 17*a* is a part which abuts to the upper end surface 13*f* of the neck part 13*d* of the outer container 13, particularly to the annular projection 13*g*, to form a welding part (reference numeral Y2 of FIG. 37B) and to be sealed. The welding part Y1 of the inner container 14 seals the space between the concentrate chamber Sc and the pressurizing agent chamber Sp. The welding part Y2 of the outer container 13 seals the space between the pressurizing agent chamber Sp and the outer part. The top surface 17*c* of the flat part 17 (top surface of flange 15*b*) is an abutting surface with the horn H oscillating the ultrasonic vibration of the ultrasonic wave welding machine. The horn H is formed in a cylindrical shape, and the lower surface H1 of the horn is flat. The diameter D of the lower surface H1 is equal to the diameter of the annular projection 13*g*.

After the concentrate C is charged inside the concentrate chamber Sc, and the plug 15 is put on the opening of the container body 16, the ultrasonic wave welding of the plug 15 can be performed by the pressurizing agent charging device (see reference numeral 320 of FIG. 39) in which the horn H for welding is assembled. The ultrasonic wave welding is performed after the pressurizing agent P is undercup-charged into the pressurizing agent chamber Sp between the outer container 13 and the inner container 14 as shown in FIGS. 1A and 2A.

After welding, as shown in FIG. 3B, the lower surface 17*a*1 of the outer cylindrical part 17*a* is welded to the upper end surface 13*f* of the outer container 13, and the lower surface 17*b* of the flat part 17 is welded to the upper end surface 14*e* of the inner container 14, and the pressurizing agent P permeates the inner container 14, and it becomes the gas-containing food 11*a* by dissolving the pressurizing agent P to the concentrate C. In order for dissolving the required amount of the pressurizing agent P into the concentrate C, it can be stored (refrigerated) in the atmosphere at, for example, 5° C. (refrigerator, warehouse, transportation container, etc.) for more than 3 hours. However, it does not always have to be refrigerated. And, as described above, the melted resin is not projected to the outer part from the space between both. Further, since two welding parts Y1, Y2 are continuously and sufficiently formed by welding, the pressurizing agent P is not leaked from the pressurizing agent chamber Sp for a long time, and the concentrate C is not leaked from the concentrate chamber Sc. The resin projecting inwardly at the time of welding is stored in the inclined part (inclined groove) 13*h*, and does not flow into the pressurizing agent chamber Sp.

A thermoplastic resin having high thermal bondability with the outer container 13 and the inner container 14 is used for the material of the plug 15, and the material is the same as the material of the outer container 13 and the inner container 14. As shown in FIG. 5B, the concentrate chamber Sc and the pressurizing agent chamber Sp are sealed by the plug 15, and by fixing it to both of the inner container 14 and the outer container 13, the contents (concentrate C, pressurizing agent P) can be safely stored for a long time without leaking. After discharging the concentrate, the pressurized container becomes to a single material, so that it is easily recycled.

In a case in which the gas (particularly, gas in the head space Hs which will be described later) G inside the inner container 14 is substituted to another gas, as the substitute gas R, the one satisfying the following relationship with the concentrate C is chosen. It is preferable to choose the one in which the solubility with respect to 1 ml of concentrate under 1 atm at 25° C. is higher than air, and for example, it may be soluble compressed gas (carbon dioxide, nitrous oxide) or the mixed gas of soluble compressed gas and low solubility gas (compressed air, oxygen, nitrogen, hydrogen), and it is equal to or more than 0.02 ml, and particularly, equal to or more than 0.05 ml. When the solubility is high, the substitute gas R which is gas inside the inner container 14 is quickly dissolved into the concentrate C, so that the gas-phase is easily disappeared, and the pressure of the gas-containing food 11*a* can be stabilized in a short period of time.

The concentrate C includes foods in a liquid state, a jelly state, a gel state such as soft drinks, alcoholic beverages, desserts, seasonings, dietary supplements, whipped cream, etc. However, it is not limited to this use. The air or gas may be dissolved into the concentrate C in advance. However, the dissolved amount of the gas is equal to or less than 0.05. When the dissolved amount of the gas exceeds 0.05, the large amount of the gas escapes and interferes the ultrasonic wave welding at the time of the ultrasonic wave welding. Note that the dissolved amount of gas is the volume (ml) of gas dissolved per 1 ml of the concentrate.

The concentrate C preferably contacts with the inner surface side of the openable seal part 15*d*. Accordingly, at the time of welding the plug 15 and the container body 16, the openable seal part 15*d* is cooled by the concentrate C, so that the problem in which the openable seal part 15*d* is melted by the heat can be solved.

As the pressurizing agent P, it is preferable to use soluble compressed gas such as carbon dioxide (0.76), nitrous oxide (0.059), etc., or mixed gas of soluble compressed gas and low solubility gas (air (0.017), oxygen (0.028), nitrogen (0.014), hydrogen (0.018)), in which the solubility is higher than the gas G inside the inner container 14, particularly, air. Note that the numbers in the parentheses indicate the solubility to water at 25° C. Specifically, the gas, in which the solubility with respect to 1 ml of the concentrate under 1 atm at 25° C. is equal to or more than 0.02 ml, and it is preferably equal to or more than 0.05 ml, is used. Further, the pressurizing agent P is charged, so that the pressure in the saturated dissolution state is 0.2 to 0.6 MPa (25° C., gauge pressure), and it is preferably 0.3 to 0.5 MPa (25° C., gauge pressure) which is almost the same pressure as a carbonated drink.

The capacity of the outer container 13 is preferably 30 to 500 ml. The capacity of the inner concentrate (concentrate chamber Sc) 14 is preferably approximately 20 to 300 ml. The capacity of the pressurizing agent chamber Sp is preferably approximately 10 to 200 ml.

As described above, the gas-containing food 11*a* used for the pressurized container 11 has less number of components, and the valve is not provided, so that it can be manufactured inexpensively, and the pressurized container 11 can be a single material so as to be easily recycled. Further, in the case in which the consumer carries or the distributor delivers, in case, if the outer container 13 is cracked, only the pressurizing agent P is leaked, but the concentrate C inside the inner container 14 is not leaked, so that it is safe. Further, in the case in which the consumer carries after cooling it in a refrigerator at home, the space between the outer container 13 and the inner container 14 is rolled as a cold insulator, so that the outside air temperature is hardly transmitted and it can be taken in the cold state for a long period of time.

In the case in which the user who purchases it uses the discharge device 10, first, the cap 20 is screwed into the male screw 13*e* of the container 13. With this, whole cap 20 and the valve 21 are lowered, and the bottom face 27*a* of the seal opening part 27 pushes down the openable seal part 15*d*. Accordingly, the openable seal part 15*d* is broken at the weakening line 15*f*, and the seal opening part breaks through the bottom part 15*c* of the valve housing part 15*a*2, and the inside of the housing 24 is communicated with the concentrate chamber Sc. After that, by pressing down the operation button 23, the concentrate C can be discharged by the pressure of the pressurizing agent P.

When the concentrate C becomes empty, the gas-containing food 11*a* is removed from the discharge member 12 by reversing the cap 20. The pressurized container 11 in which the concentrate C is empty is made by a single material so as to be easily recycled. Further, since the inner container 13 is thin, when the concentrate C is empty, the pressurizing agent P easily permeates, and the pressurizing agent P is gradually discharged to the outside from the openable seal part 15*d* which is opened. In addition, by replacing the valve 21 or the operation button 23 which contact to the concentrate C, the discharge member 12 can be repeatedly used in a hygienic condition.

The manufacturing method of the gas-containing food (pressurized product) 11*a* as shown in FIG. 39 includes a concentrate charging step S1, a replacement step S2 in which the gas G inside the inner container 14 is replaced to the substitute gas R, a plug mounting step S3 in which the substitute gas R is confined by mounting the plug 15, a pressurizing agent charging and plug welding step S4, and an inner container contraction step S5. However, the replacement step S2 is not always required. In this manufacturing method, first, the container body 16 in which the inner container 14 is mounted to the outer container 13 is prepared. The double container body 16 can be manufactured by the double blow molding. And, in the inner container 14, the concentrate C in which the gas is intentionally not dissolved (gas undissolved food) is charged. In the concentrate C, the dissolved mount may be reduced by the deaeration of the saturated dissolved air which is previously decompressed. Further, the concentrate C is preferably cooled under 5° C. in advance. At the time of the concentrate charging step S1, a blank space (head space) Hs in which the concentrate C is not charged is left at the upper part of the inner container 14.

Next, in the replacement step S2, the plug 15 is held in the state that the gas is capable of entering to and leaving from the concentrate chamber Sc, and the substitute gas R which is high solubility to the concentrate C is charged from the space between the opening of the inner container 14 and the plug 15, and the air in the head space Hs inside the inner container 14 is discharged outside, and the gas G inside the inner container 14 is replaced to the substitute gas R (replacement step). Particularly, it is preferable to replace to the gas which is the one wants to be dissolved into the concentrate C.

Next, in the plug mounting step S3, the plug 15 is put on the opening of the container body 16, and the replaced gas is confined inside the head space Hs. By using gas in which the density (molecular weight) is larger than air, it is easily confined inside the head space Hs.

Next to the plug mounting step S3, the pressurizing agent charging and plug welding step S4 in which the pressurizing agent P is charged to the pressurizing agent chamber Sp between the inner container 14 and the outer container 13, and the plug 15 is welded and fixed to the opening of the inner container 14 and the opening of the outer container 13 is performed. In this step, the pressurizing agent P is charged into the pressurizing agent chamber Sp through the space between the plug 15 and the outer container 13 (undercup charging). After that, the plug 15 is welded to the outer container 13 and the inner container 14 and it is sealed. In this step, for example, the pressurizing agent charging device 320 of FIG. 4 can be used, and the welding method of FIG. 2A can be employed. Accordingly, the welding waste is hardly projected outside, and the sealability of the plug 15 and the outer container 13 is enhanced, so that the leakage is few, and the gas-containing food 11*a* with excellent appearance can be obtained.

Note that in the case in which the solubility of the pressurizing agent P to the concentrate C is higher than air inside the head space Hs, the pressurizing agent P easily permeates the inner container 14 to be dissolved to the concentrate C, so that the replacement step S2 is not required.

Further, when the pressurizing agent P is charged, the pressurizing agent P may be charged inside the head space Hs. That is, in this step, the air inside the head space Hs can be replaced with the pressurizing agent P (replacement step S4*a*). In this case, the substitute gas R is the pressurizing agent P, and the gas G inside the inner container 14 is the pressurizing agent P.

Note that the inner container 14 may be heat-contracted by charging wormed concentrate C in the concentrate charging step S1, or the inner container 14 may be heat-contracted by blowing heat air before the concentrate charging step S1. After that, the concentrate C is charged. Further, the inner container 14 may be contracted by vacuuming air inside the inner container 14, or the pressurizing agent or the compressed air is charged into the pressurizing agent chamber Sp between the outer container 13 and the inner container 14, so that the inner container 14 is contracted by pressurizing from the outside. When the inner container 14 and the outer container 13 are manufactured by the double blow molding, etc., the inner container 14 and the outer container 13 are tightly attached, so that the pressurizing agent chamber Sp is small and it is hardly filled. With this, when the pressurizing agent chamber Sp is formed by contracting the inner container 14 before charging the pressurizing agent P, it becomes easier to charge the pressurizing agent P. Further, by dissolving the gas which will be described later, it becomes easier to contract the inner container 14.

When completing the plug welding step S4, the pressure inside container body 16 becomes high, so that the gas G inside the head space Hs is compressed, and further, it is dissolved to the concentrate C. Alternatively, since the pressurizing agent P of the pressurizing agent chamber Sp permeate into the inside of the inner container 14, the concentrate C is dissolved. Therefore, the air (gas) G inside the head space Hs which could not be dissolved is pushed out from the inner container 14, and the gas-phase becomes small, or it is disappeared. Accordingly, the inner container 14 is gradually contracted. This inner container contraction step S5 is preferably performed in a refrigerated state.

With this, according to the manufacturing method of the gas-containing food 11*a* of the present invention, since the gas G inside the inner container 14 is dissolved into the concentrate C, or the gas is pushed out from the inner container 14, the formation of the gas-phase inside the inner container 14 can be suppressed. Specifically, in the case in which the plug 15 is welded by the ultrasonic wave welding, when the concentrate C is positioned at the vicinity of the welding part, the concentrate C is atomized by the ultrasonic vibration, so that there is possibility that the dissolution of the welding part is inhibited, and the welding becomes insufficient. Therefore, it is necessary to provide the gas-phase inside the inner container 14 to separate the liquid surface of the concentrate C from the welding part, and the gas-phase inevitably occurs in the inner container 14. However, since the inner container contraction step S5 is provided, the gas-phase can be minimized or can be disappeared, so that the stable discharge of the concentrate C can be realized.

Further, when using carbon dioxide as the pressurizing agent P, the carbon dioxide can be dissolved into the concentrate C, and the food including carbon dioxide (carbonated water, carbonated drink, etc.) can be manufactured.

Example 1

By using the pressurized container 11 provided with the outer container and the inner container which are made of polyethylene terephthalate (full volume 250 ml of the outer container), 150 g of water (dissolved amount 0.017), adjusting at 25° C., in which air is saturated and dissolved is charged inside the inner container as the concentrate C. Next, the plug made of polyethylene terephthalate is put on the container body. Further, carbon dioxide (solubility to water: 0.76 ((25° C., 1 atm)) is charged as the pressurizing agent P in the pressurizing agent chamber Sp through the space between the outer container and the plug, and the plug is fixed to the container body by the ultrasonic wave welding. The gas G in the head space Hs inside the inner container is air. The pressure immediately after production is 0.55 MPa. After that, when it is stored at the refrigerator at 5° C. After 6 hours, the inner container is contracted and the gas-phase is almost disappeared, and the pressure is lowered to 0.4 MPa. Accordingly, in example 1, the replacement steps S2, S4*a* are not required. When the completed gas-containing food 11*a* is opened by using the discharge member 12 and the concentrate C is discharged, the stimulation which is almost the same as the commercial carbonated drink charged in a PET bottle is obtained, and it is recognized that the sufficient amount of the pressurizing agent P is dissolved into the concentrate C. Further, after discharging almost all of the concentrate C, the discharge member is removed, and it is left for 3 days at a room temperature. In this case, the pressurizing agent inside the pressurizing agent chamber Sp permeates the inner container, and it is discharged outside through the openable seal part, so that when grabbing the container body, it can be easily deformed.

Comparative Example 1

By using the pressurized container 11 provided with the outer container and the inner container which are made of polyethylene terephthalate (full volume 250 ml of the outer container), 150 g of carbonated water (dissolved amount 0.76) adjusting at 25° C. in which carbon dioxide is saturated and dissolved is charged inside the inner container as the concentrate C. Next, the plug made of polyethylene terephthalate is put on the container body. Further, when the carbon dioxide is charged as the pressurizing agent P in the pressurizing agent chamber Sp through the space between the outer container and the plug, and the plug is welded to the container body by the ultrasonic wave welding, the carbonated water is overflowed, so that it cannot be welded.

In the above, the preferable embodiments of the present invention were described. However, the present invention is not limited to the aforementioned embodiments, and various modifications may be made within the scope of the present invention. For example, not in the air, in the atmosphere such as carbon dioxide, etc. which is the one wants to be dissolved to the concentrate C, the gas-containing food 11*a* may be manufactured. In this case, the replacement steps S2, S4*a* are not required. In this case, since the pressurizing agent P which permeates the inner container 14 is dissolved into the concentrate C, the gas-containing food is obtained. Further, other than the case in which the plug 15 is opened by the discharge member 12, a picking part which continues to the openable seal part 15*d* may be provided so that, as a pull top, the openable seal part 15*d* can be teared off by picking and pulling the picking part etc.

Figure 40:
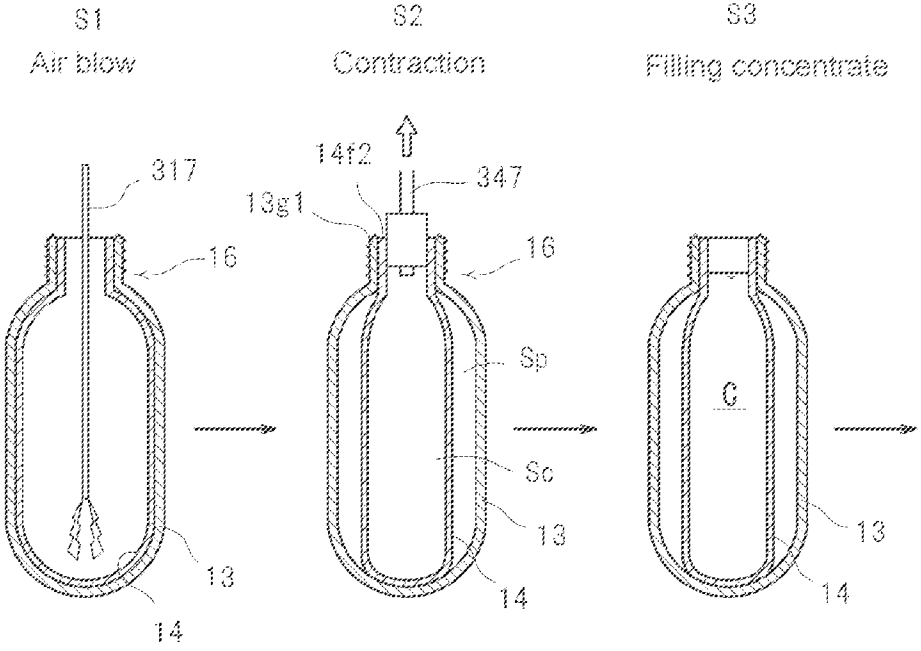
FIG. 40 is a partial process diagram showing one embodiment of the manufacturing method of the present invention.

Next, with reference to FIGS. 40 and 41, the manufacturing method of the double pressurized product 10 will be described. The air nozzle 17 is inserted into the inside of the double container body 16 which is molded by the blow molding from the double preform as described above, and the inside is cleaned up by the air blow (air blow step S1).

Next, in the state in which the space between the mouth 13*g*1 of the outer container 13 and the mouth 14/2 of the inner container 14 is opened, the inner container 14 is contracted by depressurizing the inside of the inner container 14. Specifically, a vacuum piping 347 is connected to the seal opening member of the inner container 14, and the air inside the inner container 14 is vacuumed (depressurizing the inside of the inner container 14). The lower end of the suction nozzle of vacuum piping 347 extends to the vicinity of the bottom part of the inner container, and a suction hole is provided at the side surface of the suction nozzle. The inside of the inner container is depressurized by the vacuum piping, but it is abutted, so that the inner container is not contracted to the opening side by the bottom part of the suction nozzle. With this depressurization, the capacity inside the inner container 14 is reduced to a predetermined volume.

Specifically, the inner container 14 is contracted to the capacity of 40 to 70% from the capacity before the inner container 14 is contracted. At the time of depressurization, since the space between the mouth 13*g*1 of the outer container 13 and the mouth 14/2 of the inner container 14 is opened, the outside air is introduced between the outer container 13 and the inner container 14 through the space. Accordingly, the outer container 13 is not contracted, and only the inner container 14 is contracted (contraction step S2). With this, the outer container 13 and inner container 14 blow molded from the double preform are smoothly separated, so that the pressurizing agent chamber Sp is formed between them. After the inner container 14 is contracted to the predetermined amount, the vacuum piping 347 is removed. The thickness of the body part 14*b* of the inner container 14 is 0.1 to 0.3 mm, and since it has hardness almost maintaining the contracted state, the inner container 14 maintains to be contacted even when the vacuum piping 347 is removed. In fact, it is slightly expanded elastically, but it does not return to the original shape, so that it maintains the predetermined capacity.

Note that in order to surely maintain the contracted state of the inner container 14, it may be performed that the space between the mouth 13*g*1 of the outer container 13 and the mouth 14*f*2 of the inner container 14 is airtightly closed, and then, the vacuum piping 347 is removed. Further, the airtightly closed state in the space between the mouth 13*g*1 of the outer container 13 and the mouth 14*f*2 of the inner container 14 may be maintained until the plug mounting step (S4) which will be described later.

Next, the concentrate C is charged in the inner container 14 (concentrate charging step S3). The amount of the concentrate C is preferably such that the bottom part of the plug 15 contacts to the concentrate C and no vacant space remains when mounting the plug 15. With this, at the time of welding the plug 15, the openable seal part 15*d* is cooled by the concentrate C so as not to be melted. Further, by not leaving the vacant space or reducing the vacant space, the discharge becomes smooth.

Figure 41:
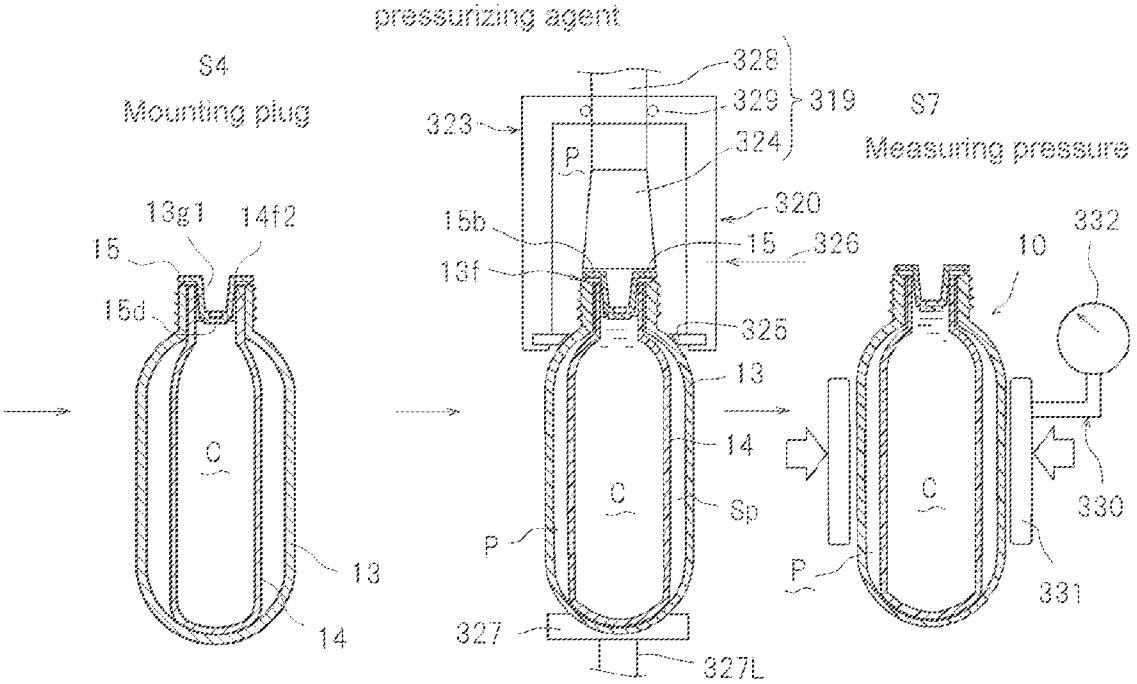
FIG. 41 is a partial process diagram continued from FIG. 40.

Next, as shown in FIG. 41, the plug 15 is airtightly mounted to the mouth 14*f*2 of the inner container 14, and the inner container 14 is sealed (plug mounting step S4).

Next, the outer container 13 and the inner container 14 are set to the pressurizing agent charging device 320 provided with the ultrasonic wave welding machine 319, and the pressurizing agent P is charged to the pressurizing agent chamber Sp by the undercup charging (pressurizing agent charging step S5). Next, by the ultrasonic wave welding machine 39, the plug 15 is fixed to the outer container 13 and the inner container 14 by the ultrasonic wave welding (welding step S6). The pressurizing agent charging device 320 is provided with a cylindrical shaped charging tool 323 which opens at the lower side, and a horn 324 for ultrasonic wave welding which closes the upper part opening of the charging tool 323 and is provided inside the charging tool 323 in a vertically movable manner.

At the lower end of the charging tool 323, an annular seal material 325 abutting to the shoulder part 13*c* of the outer container 13 is provided. At the charging tool 323, a pressurizing agent supply pipe 326 is connected. In the pressurizing agent charging device 320, the charging tool 323 and the outer container 13 are placed close to each other in an axial direction, and it provides a mechanism to press each other. Such pressing mechanism is constituted with a mechanism for lifting the charging tool 323 or a lifting mechanism 327L for lifting a support tray 327 which supports the outer container 13. The ultrasonic wave welding machine 319 is provided with the lifting mechanism 328 for lifting the aforementioned horn 324, and the annular seal material 329 which allows sliding is intervened between the lifting mechanism 328 and the charging tool 323.

When charging the pressurizing agent P, first, the charging tool 323 and the outer container 13 are brought close to each other, and the space between the charging tool 323 and the outer container 13 is sealed by the seal material 325 of the lower part of the charging tool 323. Next, the pressurizing agent P is supplied to the charging tool 323 from the pressurizing agent supply pipe 326. With this, the pressurizing agent P is undercup-charged in the pressurizing agent chamber Sp through the space between the upper end of the neck part 13*d* of the outer container 13 and the flange 15*b* of the plug 15, and the space between the opening part 13*g*1 of the outer container 13 and the opening part 14*f*2 of the inner container 14, and further, the passage through between the neck part 13*d* of the outer container 13 and the neck part 14*d* of the inner container 14 (pressurizing agent charging step S5).

As the pressurizing agent P, it is preferable to include compressed gas such as nitrogen gas, compressed air, carbon dioxide, nitrous oxide gas, etc. The pressure inside the double pressurized container by the pressurizing agent is 0.1 to 0.5 MPa (25° C., gauge pressure), and particularly, it is preferably 0.3 to 0.5 MPa (25° C., gauge pressure) which is almost the same pressure as carbonated drink. Further, the capacity of the outer container is preferably 30 to 500 ml. The capacity of the concentrate chamber Sc is preferably approximately 20 to 300 ml. The capacity of the pressurizing agent chamber Sp is preferably approximately 10 to 200 ml After charging the pressurizing agent P, while maintaining the sealing by the seal material 325, the horn 324 is lowered, and the ultrasonic vibration is transmitted to the horn 324 in the state in which the plug 15 is pressurized downwardly. Accordingly, the flange 15*b* of the plug 15 is welded to the upper end surface 13*f* of the neck part 13*d* of the outer container 13 and the upper end surface 14*e* of the neck part 14*d* of the inner container 14 by the ultrasonic wave welding (welding step S6). Therefore, the double pressurized product 10 is obtained.

After welding, the double pressurized product 10 is taken out from the pressurizing agent charging device 320 by lifting the charging tool 323 or lowering the support tray 327. Next, by using the pressure measuring device 330 which detects internal pressure of the double pressurized product 10, the internal pressure is confirmed within the predetermined range (pressure measuring step S7). The pressure measuring device 330 is provided with a grip 331 pressurizing the body part 13*b* of the outer container 13, a load cell 332 detecting a pressure force by the grip, and a sensor detecting a deformation amount of the body part 13*b*, and the internal pressure is measured based on the calibration curve of the deformation amount and the pressure force.

Figure 42:
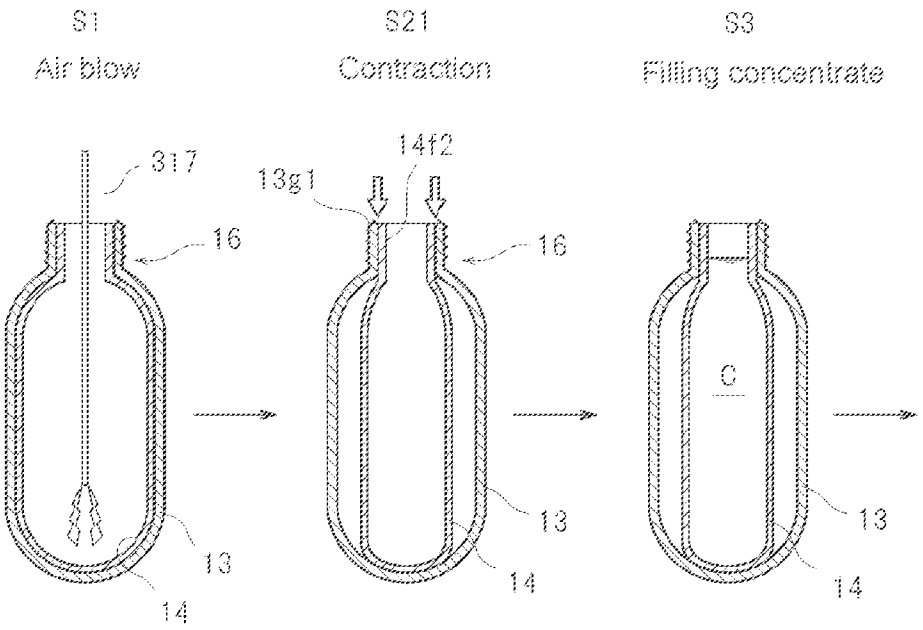
FIG. 42 is a process diagram showing another embodiment of the concentrate charging step.

Next, with reference to FIG. 42, another embodiment of the manufacturing method of the double pressurized product of the present invention will be described. First, the inside of the double container body 16 is cleaned by air blow (air blow step S1). Next, in the opening state of the mouth 14*f*2 of the inner container 14, the fluid (air, gas, liquid) is fed into the space between the outer container 13 and the inner container 14 by passing through the space between the mouth 13*g*1 of the outer container 13 and the mouth 14*f*2 of the inner container 14, so that the inner container 14 is contracted. In this case, the capacity inside the inner container 14 is reduced to the predetermined volume. Specifically, the inner container 14 is contracted to the capacity of 40 to 70% from the capacity before the inner container 14 is contracted (contraction step S21). By this contraction step S21, the outer container 13 and the inner container 14 blow molded from the double preform are smoothly separated, and the pressurizing agent chamber Sp is formed between them.

Since the thickness of the body part 14*b* of the inner container 14 is 0.1 to 0.3 mm and it has the hardness to maintain the contracted state, even if the fluid (air, gas, liquid) stops to be fed into the space between the outer container 13 and the inner container 14, the inner container 14 maintains to be contracted. However, in order to ensure the maintaining of the contraction of the inner container 14, at the same time when the fluid (air, gas, liquid) is stopped from being sent between the outer container 13 and the inner container 14, the gap may be closed airtightly. It can be realized while the feeding device (not shown) is being mounted. Further, the state in which the space of the mouths of the outer container 13 and the inner container 14 is airtightly closed may continues to the plug mounting step (S4) which will be described later.

Next, the concentrate C is charged inside the inner container 14 (concentrate charging step S3). After that, it is the same as the aforementioned embodiment, and the plug mounting step S4 in which the plug 15 is airtightly mounted to the mouth of the inner container 14 and the inner container 14 is sealed, is performed. Further, the pressurizing agent charging step S5 in which the pressurizing agent P is undercup-charged into the pressurizing agent chamber Sp, the welding step S6 in which the plug 15 is fixed to the outer container 13 and the inner container 14 by the ultrasonic wave welding, and the pressure measuring step S7 are performed in its order.

What is claimed is:

1. A method for manufacturing a discharge product comprising:

preparing the double pressurized container comprising an outer container; an inner container stored inside the outer container and having flexibility; and a plug for sealing both of the outer container and the inner container;

charging a concentrate inside the inner container;

contracting the inner container before or after charging the concentrate;

tightly mounting the plug to a mouth of the inner container;

charging a pressurizing agent between the outer container and the inner container through a space between a mouth of the outer container and the mouth of the inner container; and tightly closing the space between the mouth of the outer container and the mouth of the inner container by the plug.

2. The method for manufacturing a discharge product according to claim 1, wherein the inner container is contracted by reducing a pressure inside the inner container in an opening state of the space between the mouth of the outer container and the mouth of the inner container.

3. The method for manufacturing a discharge product according to claim 1, wherein the inner container is contracted by charging fluid between the outer container and the inner container through the space between the mouth of the outer container and the mouth of the inner container in an opening state of the mouth of the inner container.

4. The method for manufacturing a discharge product according to claim 1, wherein the inner container is contracted by being compressed by compressing the outer container.

5. The method for manufacturing a discharge product according to claim 1, wherein the space between the outer container and the plug, the space between the inner container and the plug, or both of the spaces are tightly closed by an ultrasonic wave welding.

6. The method for manufacturing a discharge product according to claim 2, wherein the space between the outer container and the plug, the space between the inner container and the plug, or both of the spaces are tightly closed by an ultrasonic wave welding.

7. The method for manufacturing a discharge product according to claim 3, wherein the space between the outer container and the plug, the space between the inner container and the plug, or both of the spaces is tightly closed by an ultrasonic wave welding.

8. The method for manufacturing a discharge product according to claim 4, wherein the space between the outer container and the plug, the space between the inner container and the plug, or both of the spaces is tightly closed by an ultrasonic wave welding.

9. A method for manufacturing a discharge product comprising the steps of:

preparing a double pressurized container comprising an outer container; an inner container stored inside the outer container and having flexibility; and a plug for sealing both of the outer container and the inner container;

charging the concentrate inside the inner container;

charging a pressurizing agent between the inner container and the outer container;

replacing a gas inside the inner container with a gas which has a solubility to the concentrate higher than that of air;

fixing the plug to an opening of the outer container and the inner container; and contracting the inner container by dissolving gas inside the inner container into the concentrate.

10. A method for manufacturing a discharge product comprising the steps of:

preparing a double pressurized container comprising an outer container; a gas permeable inner container stored inside the outer container and having flexibility; and a plug for sealing both of the outer container and the inner container;

charging a concentrate inside the inner container;

charging a pressurizing agent which has a solubility to the concentrate higher than air into a space between the inner container and the outer container;

fixing the plug to an opening of the outer container and the inner container; and contracting the inner container by dissolving the pressurizing agent charged between the inner container and the outer container into the concentrate by permeating the inner container.

* * * * *